US008679714B2

(12) United States Patent
Inoue et al.

(10) Patent No.: US 8,679,714 B2
(45) Date of Patent: Mar. 25, 2014

(54) TONER, DEVELOPER, AND IMAGE FORMING METHOD

(75) Inventors: Ryota Inoue, Osaka (JP); Akihiro Kotsugai, Shizuoka (JP); Yoshihiro Moriya, Shizuoka (JP); Akiyoshi Sabu, Kanagawa (JP); Shingo Sakashita, Shizuoka (JP); Keiko Osaka, Shizuoka (JP); Yukiko Nakajima, Shizuoka (JP); Yoshitaka Yamauchi, Shizuoka (JP); Daiki Yamashita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 85 days.

(21) Appl. No.: 12/878,750

(22) Filed: Sep. 9, 2010

(65) Prior Publication Data

US 2011/0065036 A1 Mar. 17, 2011

(30) Foreign Application Priority Data

Sep. 14, 2009 (JP) ..... 2009-212168
Jan. 19, 2010 (JP) ..... 2010-009046

(51) Int. Cl.
*G03G 9/087* (2006.01)

(52) U.S. Cl.
USPC ..... 430/108.2; 430/109.4; 430/108.1; 430/108.4; 430/111.4; 430/123.52; 430/110.2

(58) Field of Classification Search
USPC ..... 430/109.4, 110.2, 108.1, 108.4, 111.4, 430/123.52
See application file for complete search history.

(56) References Cited

U.S. PATENT DOCUMENTS

| | | | | |
|---|---|---|---|---|
| 5,387,665 | A | 2/1995 | Misawa et al. | |
| 2006/0057488 | A1 * | 3/2006 | Inoue et al. | 430/109.4 |
| 2006/0160011 | A1 | 7/2006 | Inoue et al. | |
| 2006/0177756 | A1 | 8/2006 | Sugimoto et al. | |
| 2007/0015077 | A1 * | 1/2007 | Yamashita et al. | 430/109.4 |

(Continued)

FOREIGN PATENT DOCUMENTS

| | | | |
|---|---|---|---|
| CN | 1797222 | A | 7/2006 |
| EP | 0 615 166 | A1 | 9/1994 |

(Continued)

OTHER PUBLICATIONS

Office Action issued Apr. 12, 2012 in Chinese Application No. 201010283317.2.

(Continued)

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

A toner including: a first binder resin; a colorant; a releasing agent; and a crystalline organic compound, wherein the first binder resin contains an amorphous polyester resin (a) having a polyhydroxycarboxylic acid skeleton derived from optically active monomers in a part of a main chain of the amorphous polyester resin, and the polyhydroxycarboxylic acid skeleton has an optical purity X, calculated on the monomer basis, of 80% or less, and the optical purity X is determined from the equation, $$\text{Optical Purity } X\,(\%) = |X(L\text{-form}) - X(D\text{-form})|$$

wherein the crystalline organic compound is any one of a crystalline polyester resin (b) and a crystalline low molecular compound having a melting point of 60° C. to 100° C., and being selected from a group consisting of fatty acid having 16 to 24 carbon atoms, alcohol having 16 to 24 carbon atoms, a fatty acid ester compound, and aliphatic carboxylic acid amide.

12 Claims, 4 Drawing Sheets

(56) References Cited

U.S. PATENT DOCUMENTS

| | | | | |
|---|---|---|---|---|
| 2007/0160782 | A1* | 7/2007 | Yatsuzuka et al. | 428/34.2 |
| 2008/0171280 | A1* | 7/2008 | Ohmura et al. | 430/109.4 |
| 2008/0227002 | A1 | 9/2008 | Moriya et al. | |
| 2009/0003885 | A1 | 1/2009 | Sabu et al. | |
| 2009/0142687 | A1* | 6/2009 | Ariyoshi et al. | 430/109.4 |
| 2009/0220883 | A1* | 9/2009 | Sugiura | 430/110.2 |
| 2010/0104965 | A1 | 4/2010 | Inoue et al. | |
| 2010/0183967 | A1 | 7/2010 | Sabu et al. | |
| 2010/0216068 | A1 | 8/2010 | Kotsugai et al. | |
| 2011/0053078 | A1* | 3/2011 | Zwartz et al. | 430/124.4 |
| 2011/0065036 | A1* | 3/2011 | Inoue et al. | 430/108.2 |

FOREIGN PATENT DOCUMENTS

| | | | |
|---|---|---|---|
| EP | 1 677 159 | A2 | 7/2006 |
| EP | 1 677 159 | A3 | 7/2006 |
| EP | 1 744 222 | A2 | 1/2007 |
| EP | 1 744 222 | A3 | 1/2007 |
| JP | 8-328302 | | 12/1996 |
| JP | 2005-15589 | | 1/2005 |
| JP | 2005-84407 | | 3/2005 |
| JP | 2006-65025 | | 3/2006 |
| JP | 2006-267980 | | 10/2006 |
| JP | 2006-276074 | | 10/2006 |
| JP | 2007-199314 | | 8/2007 |
| JP | 2007-233169 | | 9/2007 |
| JP | 2008-262179 | | 10/2008 |
| JP | 2008-281884 | | 11/2008 |
| JP | 2009-75544 | | 4/2009 |
| JP | 4365347 | | 8/2009 |

OTHER PUBLICATIONS

Extended European Search Report issued Jan. 7, 2011, in Patent Application No. 10251588.9.

Office Action issued Sep. 17, 2013, in Japanese Patent Application No. 2009-212168, filed Sep. 14, 2009.

* cited by examiner

TONER, DEVELOPER, AND IMAGE FORMING METHOD

BACKGROUND OF THE INVENTION

1. Field of the Invention

The present invention relates to a toner for use in an electrophotographic image forming apparatus such as copying machines, electrostatic printing, facsimiles, printers and electrostatic recording, a developer using the toner, and an image forming method using the toner.

2. Description of the Related Art

Conventionally, in electrophotographic image forming apparatuses and electrostatic recording apparatuses, electric or magnetic latent images are developed into images by the use of toner. For example, in an electrophotographic process, an electrostatic image or latent image is formed on a photoconductor, and then the latent image is developed by use of toner to form a toner image. Typically, the toner image is transferred onto a recording medium such as paper and then fixed thereto by means of heating or the like.

In an image forming apparatus employing the heat fixing system, a large amount of electric power is necessary in the course of heat melting and fixing a toner onto a recording medium such as paper. Thus, from the viewpoint of energy saving, the low temperature fixing ability of the toner is one of the important properties.

To achieve fixation of a toner at low temperature, it is important to control the heat properties of a binder resin, which accounts for a large percent of a toner. For example, by adding a material which is compatible with the binder resin and exhibits plasticization effect (hereinafter, referred to as a fixing aid) to a toner, the glass transition temperature (Tg) of the binder resin can be decreased. There has been proposals of toners, for example, a toner containing a crystalline resin, a certain polycarbonate resin, a polyarylate resin, and a polyvinyl acetal resin (see, Japanese Patent Application Laid-Open (JP-A) No. 2006-267980), and a toner containing a cycloolefin copolymer resin and a crystalline resin (see, Japanese Patent Application Laid-Open (JP-A) No. 2006-276074). However, when the glass transition temperature of the binder resin is excessively decreased, such problems occur that the heat resistant storage stability is degraded, and the toner is solidified in an image forming apparatus. Generally, there is a trade-off relation between the low temperature fixing ability and the heat resistant storage stability of a toner, and satisfaction of both properties is an important task in the development of a toner.

The aforementioned problems have been studied, and many proposals have been made. For example, JP-A No. 2007-199314 proposes a core shell-type toner, in which a surface of a core particle containing a first binder resin, a colorant and a plasticizer is coated with shell particles each formed of a second binder resin. This toner is designed to satisfy both the low temperature fixing ability and a mechanical strength, by use of the plasticizer and formation of the core shell structure. However, as the binder resin is compatible with the plasticizer in the toner from the time when toner particles are formed, the binder resin is plasticized, and the heat resistant storage stability is degraded.

Moreover, JP-A No. 08-328302 proposes a toner containing a matrix phase formed of a resin containing a styrene monomer as a structural unit and a domain phase formed of a resin containing an acrylic acid monomer as a structural unit dispersed in the matrix phase, wherein at least any one of the phases contains a fixing aid, and the relation between the resin constituting two phases, with respect to the molecular weight and the glass transition temperature are defined. This toner is designed to satisfy both the low temperature fixing ability and the heat resistant storage stability, by controlling affinity between the fixing aid and the binder resin to selectively affect softening of the resin by the use of the fixing aid on one phase. However, a resin, which forms a phase containing no fixing aid, is not softened, and there is such problem that the low temperature fixing ability cannot be sufficiently achieved.

JP-A No. 2008-281884 proposes a toner, which contains, as a binder resin, a polyester resin obtained by condensation polymerization between an alcohol component containing 1,2-propane diol and a carboxylic acid component containing a refined rosin, and a fixing aid existing as a crystalline domain. JP-A No. 2007-233169 proposes definition of the relation between a first temperature increase value and a second temperature increase value in the endotherm of a melting peak derived from a fixing aid in DSC measurement of a toner. Japanese Patent (JP-B) No. 4365347 proposes a toner containing a plasticizer which is incompatible with a binder resin and a wax, wherein the a plasticizer and the wax are incompatible with each other, and the plasticizer becomes compatible with the binder resin by heating at a glass transition temperature of the plasticizer or higher, or at a glass transition temperature of the resin or higher. In JP-A Nos. 2008-281884 and 2007-233169, and JP-B No. 4365347, both the low temperature fixing ability and the heat resistant storage stability are satisfied at a certain level. However, the low temperature fixing ability is demanded for further improvement, from the viewpoint of energy saving.

A toner contains a binder resin in an amount of 70% or more. Since most of the conventional binder resins are made from oil resources, there are concerns of depletion of the oil resources and the issue of global warming caused by discharge of a carbon dioxide gas into the air due to heavy consumption of the oil resources. If a binder resin can be synthesized from a plant (so-called, a plant-derived resin) which grows by utilizing carbon dioxide gas in the air, the carbon dioxide gas can be circulated. Namely, there is a possibility of preventing the global warming and the depletion of the oil resources. Various toners using plant-derived resins as binder resins have been proposed.

As widely-used, and easily obtainable plant-derived resins, polylactic acid is exemplified. However, polylactic acid is very hard resin and difficult to use for toner production by a pulverization method. Moreover, since poly-L-lactic acid or poly-D-lactic acid alone has high crystallinity, it has extremely low solubility in an organic solvent, and is difficult to use for toner production by a polymerization method such as a suspension method by dissolving resins. On the other hand, JP-A No. 2008-262179 discloses that poly-L-lactic acid and poly-D-lactic acid are mixed together so as to decrease crystallinity and improve their solubility in an organic solvent.

However, polylactic acid contains low molecular weight of monomer unit, and a large number of polar groups per unit molecule, so that in the case where a toner is produced using polylactic acid(s) with reduced crystallinity, the toner is affected by moisture to a greater extent than in the case of polylactic acid(s) with high crystallinity. This leads to degradation of the storage stability of the toner, variation in the fluidity of the toner caused by moisture absorption and difficulty in controlling the charge amount. It is particularly difficult to maintain a charge amount at a certain level under a condition which can belong to anywhere between a low-temperature, low-humidity condition and a high-temperature, high-humidity condition, and thus there are problems of unstable image density.

Accordingly, a toner which has a wide range of fixing temperature, is superior in low temperature fixing ability, heat resistant storage stability, haze degree, has high stability of image density against change in usage environment, such as temperature, humidity, etc., and contains a polylactic acid, and the related techniques have not yet been achieved, and further improvements and developments are still desired.

BRIEF SUMMARY OF THE INVENTION

The present invention has been made in light of the present situation to overcome the above-mentioned conventional problems. An object of the present invention is to provide a toner which has a wide range of fixing temperature, is superior in low temperature fixing ability, heat resistant storage stability, haze degree, has high stability of image density against change in usage environment, such as temperature, humidity, etc., and contains a plant-derived resin, and a developer using the toner, and an image forming method.

The inventors of the present invention have considered the above problems and intensively studied, and attained the following findings. A toner contains at least a first binder resin, a colorant, a releasing agent, and a crystalline organic compound, wherein the first binder resin contains an amorphous polyester resin (a) having a polyhydroxycarboxylic acid skeleton derived from optically active monomers in a part of a main chain of the amorphous polyester resin, and the polyhydroxycarboxylic acid skeleton has an optical purity X, calculated on the monomer basis, of 80% or less, and the optical purity X is determined from the following equation, $$\text{Optical Purity } X\,(\%)=|X(L\text{-form})-X(D\text{-form})|$$

where X (L-form) represents, calculated on the monomer basis, an L-form ratio (mol %), and X (D-form) represents, calculated on the monomer basis, a D-form ratio (mol %), and wherein the crystalline organic compound is any one of a crystalline polyester resin (b) and a crystalline low molecular compound which has a melting point of 60° C. to 100° C., and is selected from a group consisting of fatty acid having 16 to 24 carbon atoms, alcohol having 16 to 24 carbon atoms, a fatty acid ester compound, and aliphatic carboxylic acid amide, thereby effectively achieving the object of the present invention.

Moreover, the inventors of the present invention have found that the resin is crystallized so that the bleeding out of the crystalline organic compound is prevented, and the low temperature fixing ability is further improved, and images excellent in transparency (haze degree) can be obtained, because the amorphous polyester resin (a) has a polyhydroxycarboxylic acid skeleton derived from optically active monomers, the polyhydroxycarboxylic acid skeleton is superior in low temperature fixing ability, and the optical purity of the polyhydroxycarboxylic acid skeleton is defined in an appropriate range.

The present invention is based on the findings of the inventors of the present invention, and means for solving the problems are as follows.

<1> A toner containing: a first binder resin; a colorant; a releasing agent; and a crystalline organic compound, wherein the first binder resin contains an amorphous polyester resin (a) having a polyhydroxycarboxylic acid skeleton derived from optically active monomers in a part of a main chain of the amorphous polyester resin, and the polyhydroxycarboxylic acid skeleton has an optical purity X, calculated on the monomer basis, of 80% or less, and the optical purity X is determined from the following equation, $$\text{Optical Purity } X\,(\%)=|X(L\text{-form})-X(D\text{-form})|$$

where X (L-form) represents, calculated on the monomer basis, an L-form ratio (mol %), and X (D-form) represents, calculated on the monomer basis, a D-form ratio (mol %), and wherein the crystalline organic compound is any one of a crystalline polyester resin (b) and a crystalline low molecular compound which has a melting point of 60° C. to 100° C., and is selected from a group consisting of fatty acid having 16 to 24 carbon atoms, alcohol having 16 to 24 carbon atoms, a fatty acid ester compound, and aliphatic carboxylic acid amide.

<2> The toner according to <1>, wherein the crystalline polyester resin (b) has a melting point of 50° C. to 150° C.

<3> The toner according to any of <1> and <2>, wherein the crystalline polyester resin (b) is represented by General Formula (1):

General Formula (1)

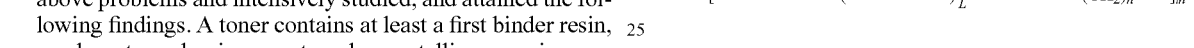

where "n" and "m" each denote a repeating unit, L denotes an integer of 1 to 3, $R^1$ and $R^2$ may be the same to or different from each other, and each denotes a hydrogen atom or a hydrocarbon group.

<4> The toner according to any of <1> to <3>, further containing shell particles each containing a second binder resin, wherein the toner has a core shell structure, in which the shell particles are attached to a surface of the toner.

<5> The toner according to any of <1> to <4>, wherein the toner satisfies the following formula (2):

$$0\leq(Q2/Q1)\leq0.30 \qquad \text{Formula (2)}$$

where Q1 is an endotherm of a melting peak derived from the crystalline organic compound when a temperature of the toner is increased from 20° C. to 150° C. at a temperature increasing rate of 10° C./min (first temperature increase), and Q2 is an endotherm of a melting peak derived from the crystalline organic compound when, after the first temperature increase, the temperature is dropped to 0° C. at a temperature decreasing rate of 10° C./min, followed by increasing to 150° C. at a temperature increasing rate of 10° C./min (second temperature increase), in DSC measurement of the toner.

<6> The toner according to any of <4> and <5>, wherein the second binder resin is a polyester resin (c) having a glass transition temperature of 55° C. to 80° C.

<7> The toner according to any of <1> to <6>, wherein the amorphous polyester resin (a) is a linear polyester diol (a11) having a polyhydroxycarboxylic acid skeleton.

<8> The toner according to any of <1> to <6>, wherein the amorphous polyester resin (a) contains a linear polyester resin (A) which is obtained by reaction of the linear polyester diol (a11) having a polyhydroxycarboxylic acid skeleton with a polyester diol (a12) other than the polyester diol (a11), in the presence of a chain extending agent.

<9> The toner according to <8>, wherein a mass ratio, (a11)/(a12), of the linear polyester diol (a11) having a polyhydroxycarboxylic acid skeleton to the polyester diol (a12) other than the polyester diol (a11) is 31/69 to 90/10.

<10> The toner according to any of <1> to <9>, wherein a mass ratio, (a)/(b), of the amorphous polyester resin (a) to the crystalline polyester resin (b) is 99/1 to 70/30.

<11> The toner according to any of <1> to <10>, wherein the polyhydroxycarboxylic acid skeleton of the amorphous polyester resin (a) is obtained by ring-opening polymerizing a mixture of L-lactide and D-lactide.

<12> The toner according to any of <1> to <10>, wherein the polyhydroxycarboxylic acid skeleton of the amorphous polyester resin (a) is obtained by ring-opening polymerizing meso-DL-lactide.

<13> A developer including the toner according to any of claims <1> to <12> and a carrier.

<14> An image forming method including: forming a latent electrostatic image on a latent electrostatic image bearing member; developing the latent electrostatic image using the developer according to <13> so as to form a visible image; transferring the visible image on a recording medium; and fixing the transferred image on the recording medium.

Accordingly, the present invention enables to provide a toner which has a wide range of fixing temperature, are superior in low temperature fixing ability, heat resistant storage stability, haze degree, has high stability of image density against change in usage environment, such as temperature, humidity, etc., and contains a plant-derived resin, and a developer using the toner, and an image forming method using the toner.

DETAILED DESCRIPTION OF THE INVENTION

Figure 1:
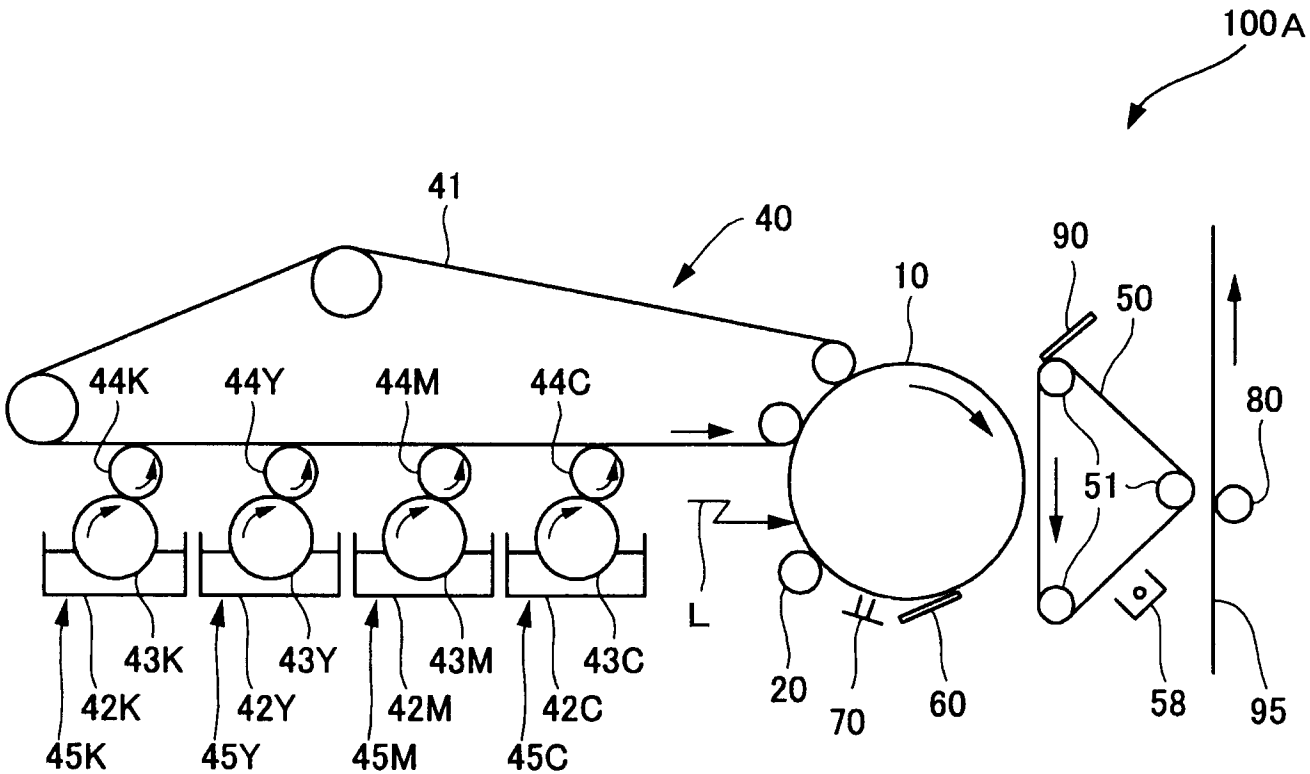
FIG. 1 is a schematic explanatory view showing an example of performing an image forming method of the present invention using an image forming apparatus.

Material of a toner of the present invention will be described. It should be appreciated that various changes and modifications are apparent to those skilled in the art and such changes and modifications are within the scope of the appended claims. The following description is intended to illustrate the best mode of the present invention by way of example only and should not be construed as a limitation to the scope of the appended claims.

(Toner)

The toner of the present invention contains at least a first binder resin, a colorant, a releasing agent, and a crystalline organic compound, and further contains other components as necessary. Moreover, the toner of the present invention preferably has a core-shell structure, in which shell particles each contain at least a second binder resin, and are attached to a surface of the toner particle.

—First Binder Resin—

The first binder resin contains at least an amorphous polyester resin (a) having a polyhydroxycarboxylic acid skeleton derived from optically active monomers in a part of a main chain of the amorphous polyester resin, wherein the polyhydroxycarboxylic acid skeleton has an optical purity X, calculated on the monomer basis, of 80% or less, and the optical purity X is determined from the following equation, $$\text{Optical Purity } X\,(\%) = |X(L\text{-form}) - X(D\text{-form})|$$

where X (L-form) represents, calculated on the monomer basis, an L-form ratio (mol %), and X (D-form) represents, calculated on the monomer basis, a D-form ratio (mol %).

Since the first binder resin is an amorphous polyester resin having the polyhydroxycarboxylic acid skeleton in a part of a main chain of the amorphous polyester resin, the amorphous polyester resin has ester groups at a high proportion in the main chain and a short-chained alkyl group in a side chain. Thus, the first binder resin has more ester groups per molecular weight than a conventional polyester resin having an aromatic chain as the main chain, and has high transparency in an amorphous state. Moreover, the first binder resin has high affinity with various colorants, though it has a small amount of functional groups such as organic acid, hydroxyl group, etc. which is typified by carboxylic acid.

The polyhydroxycarboxylic acid skeleton is a skeleton obtained by copolymerizing or polymerizing hydroxycarboxylic acid, and can be formed by directly dehydration-condensating hydroxycarboxylic acid, by ring-opening polymerizing a suitable cyclic ester, or by enzyme reaction, for example, using lipase. As the polymerization method, ring-opening polymerizing is preferable from the viewpoint of increasing the molecular weight of the polyhydroxycarboxylic acid to be polymerized.

The optically active monomers for forming the polyhydroxycarboxylic acid skeleton are not particularly limited and may be appropriately selected depending on the intended purpose. From the perspective of transparency and thermal properties of the toner, as the optically active monomers forming a polyhydroxycarboxylic acid skeleton, preferred are aliphatic hydroxycarboxylic acids; more preferred are hydroxycarboxylic acids having 3 to 6 carbon atoms, such as lactic acid, 3-hydroxybutyric acid; even more preferred are lactic acids. As materials of polymer other than hydroxy carboxylic acids, cyclic esters of hydroxy carboxylic acids can also be used. In this case, a hydroxycarboxylic acid skeleton of the resin obtainable by polymerization has a structure in which the hydroxycarboxylic acid constituting the cyclic ester is polymerized. For example, a polyhydroxycarboxylic acid skeleton of the resin obtainable by using lactide has a structure in which the lactic acid is polymerized.

The optical purity X of the polyhydroxycarboxylic acid skeleton calculated on the monomer basis [i.e., Optical Purity X (%)=|X (L-form)−X (D-form)|, with the proviso that X (L-form) represents, calculated on the monomer basis, an L-form ratio (mol %), and X (D-form) represents, calculated on the monomer basis, a D-form ratio (mol %)], is preferably 80% or less, and more preferably 60% or less. When the optical purity X (%) is within the above range, the resin is amorphous, and the solubility in solvents and transparency of the resin can be improved. When a cyclic ester of the optically active monomers is used as the materials of polymer, L-forms and D-forms can be respectively mixed. Moreover, by ring-opening polymerizing meso form, or mixing either D-form or L-form with meso form, the optical purity can be within the above range, and the same effect as above description can be obtained. Among these, the polyhydroxycarboxylic acid skeleton is preferably obtained by ring-opening polymerizing a mixture of L-lactide and D-lactide, or by ring-opening polymerizing meso-DL-lactide.

Moreover, resins having skeletons other than polyhydroxycarboxylic acid skeleton can be copolymerized as long as crystallinity and transparency are not impaired. For example, as a monomer, polyhydric alcohols such as various diols, dicarboxylic acids, glycerin, glycolic acids; polyhydroxy acids such as malic acid, tartaric acid, or the like are used so as to change the composition of the resin.

The weight average molecular weight (hereinafter, abbreviated as Mw) of the amorphous polyester resin (a) is not particularly limited and may be appropriately determined depending on the intended purpose. It is preferably 7,000 to 70,000, more preferably 10,000 to 40,000, and particularly preferably 15,000 to 35,000, in terms of the heat resistant storage stability and low temperature fixing ability.

The glass transition temperature of the amorphous polyester resin (a) is preferably 50° C. to 70° C., more preferably 55° C. to 65° C. When the glass transition temperature is lower than 50° C., the heat resistant storage stability may be insufficient. When the glass transition temperature is higher than 70° C., the low temperature fixing ability may be insufficient.

The method of measuring the optical purity X is not particularly limited and may be appropriately selected depending on the intended purpose. Nevertheless, the method is preferably as follows. First of all, a toner or a polymer which has a polyester skeleton is added to a mixed solvent of purified water, 1 N sodium hydroxide and isopropyl alcohol, then hydrolysis is carried out by heating and stirring the mixed solvent at 70° C. Subsequently, the solution is filtered so as to remove the solid content present in the solution, then sulfuric acid is added for neutralization, and an aqueous solution containing L-hydroxycarboxylic acid and/or D-hydroxycarboxylic acid, into which a polyester resin has been decomposed, is thus obtained. Regarding this aqueous solution, the peak area S (L) corresponding to L-hydroxycarboxylic acid and the peak area S (D) corresponding to the D-hydroxycarboxylic acid were measured by means of a high-speed liquid chromatograph using the chiral ligand exchange column SUMICHIRAL OA-5000 (manufactured by Sumika Chemical Analysis Service, Ltd.). Based upon these peak areas, the optical purity X can be calculated as follows.

$$X(L\text{-form})\ \%=100\times S(L)/(S(L)+S(D))$$

$$X(D\text{-form})\ \%=100\times S(D)/(S(L)+S(D))$$

$$\text{Optical purity } X\ \%=|X(L\text{-form})-X(D\text{-form})|$$

The amorphous polyester resin (a) is preferably polyester diol (a11) containing a polyhydroxycarboxylic acid skeleton, and contains a linear polyester resin (A) which is obtained by reaction of a linear polyester diol (a11) having a polyhydroxycarboxylic acid skeleton with a polyester diol (a12) other than the polyester diol (a11), in the presence of a chain extending agent. When the polyhydroxycarboxylic acid skeleton is formed, copolymerization is performed with addition of the diol (11), the polyester diol (a11) having the polyhydroxycarboxylic acid skeleton is obtained.

The diol (11) is not particularly limited and may be appropriately determined depending on the intended purpose. Preferred diols are 1,2-propane diol, 1,3-propane diol, 1,4-butane diol, 1,6-hexane diol, alkylene oxide adducts (the added mole number: 2 to 30) of bisphenols (bisphenol A, bisphenol F, bisphenol S, etc.) (hereinbelow, "alkylene oxide" is simply abbreviated as "AO"; specific examples thereof are ethylene oxide (hereinbelow, abbreviated as "EO"), propylene oxide (hereinbelow, abbreviated as "PO"), butylene oxide (hereinbelow, abbreviated as "BO"), etc.) and combinations thereof. More preferred diols are 1,2-propane diol, 1,3-propane diol, 1,4-butane diol, and AO adducts of bisphenol A. Particularly preferred diol is 1,3-propane diol.

It is preferred that the amorphous polyester resin (a) contain the linear polyester diol (a11) having a polyhydroxycarboxylic acid skeleton, since low temperature fixing ability is further enhanced. Moreover, it is preferred that the amorphous polyester resin (a) contain the linear polyester resin (A) obtained by reaction of the linear polyester diol (a11) having a polyhydroxycarboxylic acid skeleton with the polyester diol (a12) other than the polyester diol (a11), in the presence of a chain extending agent, since the heat resistant storage stability is further enhanced.

A linear polyester has a simple structure, and the molecular weight and physical properties (thermal properties and solubility with other resins) derived therefrom can be easily controlled. In addition, the linear polyester resin (A) in the present invention is composed of a unit of the linear polyester diol (a11) having a polyhydroxycarboxylic acid and the polyester diol (a12) other than (a11) and has an advantage in that physical properties of the linear polyester resin (A) can be controlled by the type of polyester, the molecular weight and the structure thereof used in the polyester diol (a12) other than (a11), and is characterized by being definitely provided with physical property-controllability as compared to conventional compositions containing lactic acid(s).

The polyester diol (a12) other than (a11) is not particularly limited and may be appropriately selected depending on the intended purpose, as long as it is polyester diol other than the linear polyester diol (a11) having a polyhydroxycarboxylic acid skeleton. For example, it is possible to use those equivalent to a reaction product between a diol (11) and a dicarboxylic acid (13), and these can be obtained by adjusting the charging ratio of the diol and the dicarboxylic acid in the polymerization process so as to increase the number of hydroxyl groups. Among these, preferred polyester diol (a12) other than (a11) are reaction products between one or more types of diols selected from 1,2-propane diol, 1,3-propane diol, 1,4-butane diol, 1,6-hexane diol, AO (EO, PO, BO, etc.) adducts (the added mole number: 2 to 30) of bisphenols (bisphenol A, bisphenol F, bisphenol S, etc.), and combinations thereof, and one or more types of dicarboxylic acids selected from terephthalic acids, isophthalic acids, adipic acids, succinic acids and combinations thereof.

The number average molecular weight (hereinafter, abbreviated as "Mn") of the linear polyester diol (a11) having a polyhydroxycarboxylic acid skeleton and the polyester diol (a12) other than (a11) is not particularly limited and may be appropriately selected depending on the intended purpose. It is preferably 500 to 30,000, more preferably 1,000 to 20,000, and particularly preferably 2,000 to 5,000, from the viewpoint of controlling physical properties of the linear polyester resin (A).

A chain extending agent used for chain extension of the polyester diol (a11) having a polyhydroxycarboxylic acid skeleton and the polyester diol (a12) other than (a11) is not particularly limited, as long as it has two functional groups which are reactable with hydroxyl groups contained in the polyester diol (a11) and the polyester diol (a12). For example, two functional groups of dicarboxylic acids (13), anhydrides thereof, polyisocyanates (15) and polyepoxides (19) are exemplified. Of these, from the viewpoint of compatibility of the chain extending agent with the linear polyester diol (a11) having a polyhydroxycarboxylic acid skeleton and the polyester diol (a12) other than (a11), preferred are diisocyanate compounds, and dicarboxylic acid compounds. More preferred are diisocyanate compounds. Specific examples of the chain extending agent include succinic acid, adipic acid, maleic acid and anhydrides thereof, fumaric acid and anhydrides thereof, phthalic acid, isophthalic acid, terephthalic acid, 1,3- and/or 1,4-phenylene diisocyanate, 2,4- and/or 2,6-tolylene diisocyanate (TDI), 2,4'- and/or 4,4'-diphenylmethane diisocyanate (MDI), hexamethylene diisocyanate (HDI), dicyclohexyl methane-4,4'-diisocyanate (hydrogenerated MDI), isophorone diisocyanate (IPDI), and diglycidyl ether of bisphenol A. Among these, preferred are succinic acid, adipic acid, isophthalic acid, terephthalic acid, maleic acid (anhydrides thereof), fumaric acid (anhydrides thereof), HDI, and IPDI. Particularly preferred are maleic acid (anhydride thereof), fumaric acid (anhydride thereof), and IPDI.

The amount of the chain extending agent in the linear polyester resin (A) is not particularly limited and may be appropriately determined depending on the intended purpose. It is preferably 0.1% by mass to 30% by mass, and more preferably 1% by mass to 20% by mass, from the viewpoint of the transparency and thermal properties.

The mass ratio (a11)/(a12) of the polyester diol (a11) having a polyhydroxycarboxylic acid skeleton to the polyester diol (a12) other than the polyester diol (a11) each constituting the linear polyester resin (A) is not particularly limited and may be appropriately determined depending on the intended purpose. It is preferably 31/69 to 90/10, and from the viewpoint of the transparency and thermal properties of the toner, more preferably 40/60 to 80/20.

As the first binder resin, a known resin other than the amorphous polyester resin (a) can be appropriately used as a third binder resin in combination with the amorphous polyester resin (a), as necessary.

Examples of the third binder resin include a vinyl resin, a polyester resin, a polyurethane resin, and an epoxy resin. Preferred are a polyether resin and a polyurethane resin. Alternatively, the third binder resin may be a resin obtained by reacting a reactive group-containing prepolymer with an active hydrogen group-containing compound, both of which are used in a production method (I) described below.

—Second Binder Resin—

The toner of the present invention has preferably a core shell structure, in which shell particles each contain at least a second binder resin and are attached to a surface of the toner particle. The toner has the core shell structure so that the heat resistant storage stability of the toner, particularly the storage stability of the toner under high humidity conditions is outstandingly improved.

The second binder resin is not particularly limited and may be appropriately selected from known resins. The second binder resin is preferably a polyester resin having a glass transition temperature of 55° C. to 80° C. When the glass transition temperature is lower than 55° C., the heat resistant storage stability may be insufficient. When the glass transition temperature is higher than 80° C., the low temperature fixing ability may be insufficient. Thus, it may be difficult to satisfy both the heat resistant storage stability and the low temperature fixing ability, in the case where the glass transition temperature is lower than 55° C. or higher than 80° C.

The weight average molecular weight of the second binder resin is not particularly limited and may be appropriately selected depending on the intended purpose. It is preferably 9,000 to 45,000.

As the second binder resin, a known resin as a fourth binder resin may be further used in combination, as necessary.

Examples of the fourth binder resin include a vinyl resin, a polyester resin, a polyurethane resin, and an epoxy resin. Of these, polyester resins, and polyurethane resins are preferable. Alternatively, the fourth binder resin may be a resin obtained by reacting a reactive group-containing prepolymer with an active hydrogen group-containing compound, both of which are used in a production method (I) described below.

The glass transition temperature (Tg) of a resin, such as the first binder resin, the second binder resin, the third binder resin, the fourth binder resin, and a crystalline polyester resin (b) described below can be determined from a DSC measurement method or a flow tester measurement method (in the case where it cannot be measured by DSC).

In the DSC measurement, the DSC method specified in ASTM D 3418-82, using a DSC-60, product of Shimadzu Corporation.

In the flow tester measurement, an elevated type flow tester, Model CFT 500 manufactured by Shimadzu Corporation, may be used. Conditions for the flow tester measurement are as follows. In the present invention, every flow tester measurements are carried out under the following conditions.

(Conditions for Flow Tester Measurement)

Load applied: 30 kg/cm$^2$

Temperature increase rate: 3.0° C./min

Die aperture diameter: 0.50 mm

Die length: 10.0 mm

In the present invention, the number average molecular weight (Mn) and weight average molecular weight (Mw) of resins other then polyurethane resins are measured for a tetrahydrofuran (THF) soluble fraction using Gel Permeation Chromatography (GPC) under the following conditions:

Apparatus (e.g.): HLC-8120, manufactured by Tosoh Corporation

Column (e.g.): TSK-GEL GMHXL (two columns), TSK-GEL MULTIPORE HXL-M (one column)

Sample solution: 0.25% THF solution

Injected amount of sample solution: 100 μL

Flow rate: 1 mL/min

Measurement temperature: 40° C.

Detection device: refractive index detector

Reference material: standard polystyrene, produced by Tosoh Corporation (TSK Standard POLYSTYRENE) 12 types (molecular weight: 500, 1,050, 2,800, 5,970, 9,100, 18,100, 37,900, 96,400, 190,000, 355,000, 1,090,000, 2,890,000)

In addition, the Mn and Mw of the polyurethane are measured by GPC under the following conditions:

Apparatus (e.g.): HLC-8220GPC, manufactured by Tosoh Corporation

Column (e.g.): Guard column αTSK-GELα-M

Sample solution: 0.125% dimethyl formaldehyde solution

Injected amount of sample solution: 100 μL

Flow rate: 1 mL/min

Measurement temperature: 40° C.

Detection device: refractive index detector

Reference material: standard polystyrene, produced by Tosoh Corporation (TSK Standard POLYSTYRENE) 12 types (molecular weight: 500, 1,050, 2,800, 5,970, 9,100, 18,100, 37,900, 96,400, 190,000, 355,000, 1,090,000, 2,890,000)

—Crystalline Organic Compound—

The crystalline organic compound used in the toner of the present invention is any one of a crystalline polyester resin (b) and a crystalline low molecular compound which has a melting point of 60° C. to 100° C., which is selected from a group consisting of fatty acid having 16 to 24 carbon atoms, alcohol having 16 to 24 carbon atoms, a fatty acid ester compound, and aliphatic carboxylic acid amide.

—Fatty Acid Having 16 to 24 Carbon Atoms—

The fatty acid having 16 to 24 carbon atoms is not particularly limited and may be appropriately selected depending on the intended purpose. Examples thereof include palmitic acid, stearic acid, arachidic acid, eicosanoic acid, behenic acid, lignoceric acid, and mixture thereof. When the carbon atom is less than 16, the melting point is lowered, and the sufficient heat resistant storage stability may not be obtained.

—Alcohol Having 16 to 24 Carbon Atoms—

The alcohol having 16 to 24 carbon atoms is not particularly limited and may be appropriately selected depending on the intended purpose. Examples thereof include hexyl alcohol, stearyl alcohol, eicosanol, behenyl alcohol and mixture thereof. When the carbon atom is less than 16, the melting point is lowered, and the heat resistant storage stability may not be sufficiently obtained.

—Fatty Acid Ester Compound—

The fatty acid ester compound is not particularly limited and may be appropriately selected depending on the intended purpose. For example, a compound obtained by esterifying the following alcohol component and fatty acid component, is exemplified.

The alcohol component is not particularly limited and may be appropriately selected depending on the intended purpose. Examples thereof include polyols such as ethylene glycol, propylene glycol, butylene glycol, tetramethylene glycol, glycerin, and these polyols subjected to condensation polymerization as necessary. When the condensation polymerized product is used as the alcohol component, a polymerization degree is preferably 2 or more to less than 20. When the polymerization degree is 20 or more, the crystallinity is decreased, causing impairment of the sharp-melt property, and failing to obtain sufficient low temperature fixing ability.

The fatty acid component is not particularly limited and may be appropriately selected depending on the intended purpose. Preferred is the fatty acid having 12 to 24 carbon atoms, more preferred is the fatty acid having 16 to 24 carbon atoms and mixtures thereof. Specific examples thereof include lauric acid, palmitic acid, stearic acid, arachidic acid, eicosanoic acid, behenic acid, lignoceric acid, and mixtures thereof. When the fatty acid having less than 12 carbon atoms, the crystallinity is decreased, causing a decrease in the melting point of the compound and failing to obtaining sufficient heat resistant storage stability. Moreover, sharp melt properties is impaired, and low temperature fixing effect may not be sufficiently obtained.

The fatty acid ester compound is not particularly limited and can be obtained by appropriately selecting the fatty acid component and the alcohol component, and followed by esterification of these. Particularly preferred are diglycerine distearate, distearyl monostearate, stearyl stearate, etc. Moreover, the esterification degree of the polyol ester compound may be appropriately selected depending on the intended purpose.

The fatty acid ester compound can be fixed at low temperature by softening the amorphous polyester resin (a) which is a main component of the toner by heating. Thus, the fatty acid ester compound preferably has an acid value or hydroxyl value to some extend.

When the fatty acid ester compound has an acid value, the acid value is preferably 20 mgKOH/g or more to less than 200 mgKOH/g. When the acid value is less than 20 mgKOH/g, the fatty acid ester compound does not have sufficient compatibility to the amorphous polyester resin (a) upon heating, thus, low temperature fixing effect may not be sufficiently obtained. When the acid value is 200 mgKOH/g or more, the charging ability of the toner may be decreased under high temperature and high humidity conditions.

When the fatty acid ester compound has a hydroxyl value, the hydroxyl value is preferably 10 mgKOH/g or more to less than 200 mgKOH/g. When the hydroxyl value is less than 10 mgKOH/g, the fatty acid ester compound does not have sufficient compatibility to the amorphous polyester resin (a) upon heating, thus, low temperature fixing effect may not be sufficiently obtained. When the hydroxyl value is 200 mgKOH/g or more, the charging ability of the toner may be decreased under high temperature and high humidity conditions.

Here, a sample for measuring an acid value and a hydroxyl value is prepared in the following manner. Specifically, 0.5 g of a fatty acid ester compound is added and dissolved in 120 mL of toluene by stirring at room temperature (23° C.) for about 10 hours. In the mixture, 30 mL of ethanol is added to obtain a sample solution. The measurement is performed in accordance with the measurement method described in JIS K0070.

—Aliphatic Carboxylic Acid Amide—

The aliphatic carboxylic acid amide is obtained by amide bonding between aliphatic carboxylic acid and amine. The aliphatic carboxylic acid amide is not particularly limited and may be appropriately selected depending on the intended purpose. Examples thereof include ethylene bis stearamide, oleamide, erucamide, stearamide, behenamide, n-stearyl erucamide, n-oleyl palmitamide, n-stearyl stearamide, ethylene bis isostearamide, methylol stearamide, ethylene bis oleamide, hexamethylene stearamide, ethylene bis behenamide, methylene bis stearamide, ethylene bis hydroxyl stearamide, propionamide, lactamide, and mixtures thereof.

The melting point of the crystalline low molecular compound is 60° C. to 100° C., more preferably 60° C. to 90° C. When the melting point of the crystalline low molecular compound is lower than 60° C., the crystalline low molecular compound easily melts, and heat resistant storage stability of the toner may be poor. When the melting point of the crystalline low molecular compound is higher than 100° C., the amorphous polyester resin (a) having the polyhydroxycarboxylic acid skeleton in a part of the main chain may not be sufficiently plasticized, and the low temperature fixing ability may not be sufficiently obtained.

The amount of the crystalline low molecular compound in the toner is preferably 1% by mass or more to less than 20% by mass, more preferably 3% by mass to 10% by mass, because both the low temperature fixing ability and the heat resistant storage stability are satisfied, and excellent toner properties such as charging ability and resolution can be maintained. When the amount is less than 1% by mass, the low temperature fixing ability may be poor. When the amount is 20% by mass or more, the area of the crystalline low molecular compound in the toner surface increases, causing poor fluidity.

—Crystalline Polyester Resin (b)—

The crystalline polyester resin (b) is not particularly limited and may be appropriately selected depending on the intended purpose, as long as it is a polyester resin having crystallinity. For example, the crystalline polyester resin (b) is a polymer containing the following compound as a main polymerization unit. Examples of the compound contained in the polymer as the main polymerization unit include polymers polyesters obtained by condensation polymerization between polyols (such as ethylene glycol, 1,3-propylene glycol, 1,4-butane diol, 1,5-pentane diol, 1,6-hexane diol, hexamethylene glycol, tetramethylene glycol) and polybasic acids (such as fumaric acid, maleic acid, itaconic acid, terephthalic acid, succinic acid, adipic acid and sebacic acid); polyethers such as polyethylene glycol, polypropylene glycol; linear alkyl ester such as behenyl acrylate, behenyl methacrylate, behenyl itaconate, stearyl itaconate. Specific examples include HP-320 manufactured by the Nippon Synthetic Chemical Industry Co., Ltd.

As the crystalline polyester resin (b), a resin obtained by synthesizing an alcohol component and an acid component, and represented by General Formula (1) is preferably used.

The alcohol component contains 80 mol % or more, more preferably 85 mol % to 100 mol % of a diol compound having 2 to 6 carbon atoms, particularly, 1,4-butane diol, 1,6-hexane diol, or derivatives thereof, and the acid component is fumaric acid, maleic acid, succinic acid or derivatives thereof.

General Formula (1)

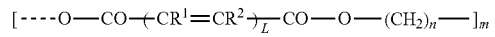

where "n" and "m" each denote a repeating unit, L denotes an integer of 1 to 3, $R^1$ and $R^2$ may be the same to or different from each other, and each denotes a hydrogen atom or a hydrocarbon group.

To control the crystallinity and softening point of the crystalline polyester resin (b), when the crystalline polyester resin (b) is synthesized, a non-linear polyester obtained by condensation polymerization with the addition of trivalent or higher polyols such as glycerin as the alcohol component, or a non-linear polyester obtained by condensation polymerization with the addition of trivalent or higher polycarboxylic acid such as trimellitic anhydride as the acid component may be used. The molecular structure of the crystalline polyester resin (b) can be confirmed by solid-state NMR.

The melting point of the crystalline polyester resin (b) is not particularly limited and may be appropriately determined depending on the intended purpose. It is preferably 50° C. to 150° C., more preferably 60° C. to 100° C. When the melting point is lower than 50° C., the heat resistant storage stability may be degraded, and blocking may occur due to the temperature inside a developing device. When the melting point is higher than 150° C., the minimum limit fixing temperature may be increased, failing to obtain the sufficient low temperature fixing ability.

The weight average molecular weight (Mw) of the crystalline polyester resin (b) is not particularly limited and may be appropriately determined depending on the intended purpose. The average molecular weight (Mw) of the crystalline polyester resin (b), in terms of molecular weight distribution by gel permeation chromatography (GPC) of orthodichlorobenzene soluble content, is preferably 1,000 to 30,000, and more preferably 1,000 to 6,500. When the average molecular weight (Mw) is less than 1,000, the heat resistant storage stability of the toner may deteriorate. When the average molecular weight (Mw) is more than 30,000, the low temperature fixing ability of the toner may not be sufficiently obtained.

The number average molecular weight (Mn) of the crystalline polyester resin (b) is not particularly limited and may be appropriately determined depending on the intended purpose. The number average molecular weight (Mn) of the crystalline polyester resin (b), in terms of molecular weight distribution by gel permeation chromatography (GPC) of orthodichlorobenzene soluble content, is preferably 500 to 6,000 and more preferably 500 to 2,000.

The ratio (Mw/Mn) of the average molecular weight (Mw) to the number average molecular weight (Mn) is preferably 1.7 to 8, more preferably 2 to 5.

Moreover, in the molecular weight distribution of the crystalline polyester resin (b) by gel permeation chromatography, it is preferred that a peak be located in a range of 3.5 to 4.0, and that the half width of the peak be 1.5 or less in a molecular weight distribution plot with a horizontal axis representing log (M) and a vertical axis representing % by mass.

The measurement of molecular weight distribution using gel permeation chromatography (GPC) can be performed as follows. For example, at first, a column is equilibrated in a heat chamber at 40° C. At this temperature orthodichlorobenzene, as a column solvent, is passed through the column at the flow rate of 1 mL/min. To this column, 50 μL to 200 μL of the orthodichlorobenzene solution in which a sample concentration is adjusted to 0.05% by mass to 0.6% by mass are added. Then, the molecular weight distribution is measured by a detector. In this measurement, the molecular weight distribution is obtained from the relationship between the logarithm value of analysis curve prepared from several standard samples and counts. The standard samples for the analysis curve are, for example, monodispersed polystyrene samples respectively having a molecular weight of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$ (available from Pressure Chemical Co. or Toyo Soda Co. Ltd.). It is preferable to use at least about 10 standard samples. Note that a refractive index (RI) detector can be used as the detector.

The crystalline polyester resin (b) has an absorption at wavelengths of 965 $cm^{-1}\pm10$ $cm^{-1}$ or 990 $cm^{-1}\pm10$ $cm^{-1}$, which is based on an out-of-plane bending vibration (δCH) of an olefin in the infrared absorption spectrum. When the absorption based on the out-of-plane bending vibration (δCH) of the olefin resides at the position, low temperature fixing ability of the toner is improved.

The acid value of the crystalline polyester resin (b) is preferably 8 mgKOH/g or more, and more preferably 20 mgKOH/g or more, in the case where affinity between paper and the crystalline polyester resin (b) is considered to achieve low temperature fixing ability. On the other hand, in order to improve hot-offset property, the acid value is preferably 45 mgKOH/g or less.

The hydroxyl value of the crystalline polyester resin (b) is preferably 0 mgKOH/g to 50 mgKOH/g, and more preferably 5 mgKOH/g to 50 mgKOH/g from the perspective of low temperature fixing ability and charging ability.

The amount of the crystalline polyester resin (b) is indicated by the amorphous polyester resin (a) contained in the first binder resin to the mass ratio of the crystalline polyester resin (b), and the mass ratio (a)/(b) of amorphous polyester resin (a) to the crystalline polyester resin (b) is preferably 99/1 to 70/30. When the mass ratio is more than 99/1, the low temperature fixing ability of the toner may not be sufficiently obtained. When the mass ratio is less than 70/30, the plasticization of the binder resin composition is accelerated, and the heat resistant storage stability of the toner may decrease.

The crystalline organic compound has sharp melt properties that cause a crystal transformation at the melting point and at the same time, causing rapid decrease in the melt viscosity thereof from the solid state. Moreover, by controlling the compatibility between the crystalline organic compound and the amorphous polyester resin (a), when the sharp melting of the crystalline organic compound occurs, the crystalline organic compound is melt together with the amorphous polyester resin (a), and exhibits plasticization effect, so as to decrease the melt viscosity of the amorphous polyester resin (a). As a result, the low temperature fixing ability of the toner can be improved. The compatibility between the crystalline organic compound and the amorphous polyester resin (a) can be improved by selecting the types of materials having above-described properties as the crystalline organic compound.

On the other hand, from the viewpoint of maintaining the heat resistant storage stability of the toner, it is important that the crystalline organic compound is present in a crystal state in the toner so as not to plasticize the amorphous polyester resin (a) except during fixation of toner. Thus, the crystalline organic compound exhibits the plasticization effect on the amorphous polyester resin (a), only when the crystalline organic compound is heated at a temperature higher than its melting point in the same manner as when a toner is fixed, and the crystalline organic compound does not exhibit the plasticization effect other than the case described above. Therefore, both the low temperature fixing ability and the heat resistant storage stability can be satisfied. It is not preferred that the crystalline organic compound contain a large amount of amorphous portion, because the amorphous portion easily causes toner blocking.

Specifically, the melting point of the crystalline organic compound can be measured using a DSC system, such as a differential scanning calorimeter ("DSC-60", product of Shimadzu Corporation) in accordance with the following procedure. First, the crystalline organic compound (5.0 mg) is placed in a sample container made of aluminum; the sample container is placed on a holder unit; and the holder unit is set in an electric furnace. Subsequently, DSC curve of the crystalline organic compound is obtained by increasing or decreasing its temperature in a nitrogen atmosphere as follows. Specifically, it is heated from 20° C. to 150° C. at a temperature increasing rate of 10° C./min; it is cooled from 150° C. to 0° C. at a temperature decreasing rate of 10° C./min; and it is heated again to 150° C. at a temperature increasing rate of 10° C./min. Using the thus-obtained DSC curve and an analysis program of a DSC-60 system, the melting point (Tmp) of the crystalline organic compound is calculated from an endothermic peak of the DSC curve corresponding to the second temperature increase.

It is preferred that the crystalline organic compound become compatible with the binder resin of the toner by heating, and do not bleed out from the toner. Due to the bleeding of the crystalline organic compound, the melted crystalline organic compound adheres to a surface of a fixing roller, so as to increase the tackiness between a toner and the fixing roller, possibly failing to obtain the sufficient low temperature fixing ability.

The state where crystalline organic compound is compatible with the binder resin, and does not bleed out from the toner is achieved under the following conditions. In DSC measurement of the toner, when a temperature is increased from 20° C. to 150° C. at a temperature increasing rate of 10° C./min (first temperature increase), an endotherm of a melting peak derived from the crystalline organic compound is defined as Q1, and after the first temperature increase, when a temperature is once dropped to 0° C. at a temperature decreasing rate of 10° C./min, followed by increasing to 150° C. at a temperature increasing rate of 10° C./min (second temperature increase), an endotherm of a melting peak derived from the crystalline organic compound is defined as Q2, and then the relation between Q1 and Q2 satisfies the following Formula (2).

$$0 \leq (Q2/Q1) \leq 0.30 \qquad \text{Formula (2)}$$

When the crystalline organic compound is excellently compatible with the binder resin, the endotherm of a melting peak derived from the crystalline organic compound is decreased by heating in the first temperature increase. Thus, the endotherm of a melting peak derived from the crystalline organic compound in the second temperature increase is smaller than that in the first temperature increase. In the case where the crystalline organic compound is sufficiently compatible with the binder resin, for preventing the crystalline organic compound from bleeding out from the toner, it is necessary to satisfy the formula $0 \leq (Q2/Q1) \leq 0.30$, with preference being given to $0 \leq (Q2/Q1) \leq 0.20$. When the ratio (Q2/Q1) is more than 0.30, the crystalline organic compound and the binder resin are not sufficiently compatible upon heating for fixation, and the crystalline organic compound bleeds out and adheres to a surface of a fixing roller, increasing tackiness between the toner and the fixing roller, possibly causing decrease in the low temperature fixing ability. Note that when the ratio (Q2/Q1) is 0, a peak of Q2 cannot be detected, and that when the crystalline organic compound is not contained, peaks of Q1 and Q2 are 0.

<<Measurement of Melting Peak Endotherm of Crystalline Organic Compound>>

A melting peak endotherm of the crystalline organic compound may be measured using a differential scanning calorimeter (DSC) system ("DSC-60", product of Shimadzu Corporation). First, about 5.0 mg of a binder resin or a toner (sample) is placed in a sample container made of aluminum; the sample container is placed on a holder unit; and the holder unit is set in an electric furnace. Using a differential scanning calorimeter ("DSC-60", product of Shimadzu Corporation), a DSC curve of the sample is obtained by increasing or decreasing its temperature in a nitrogen atmosphere as follows. A melting peak endotherm of the crystalline organic compound in the first temperature increase (hereinafter, referred to as Q 1) is calculated in the following manner. The sample is heated from 20° C. to 150° C. at a temperature increasing rate of 10° C./min; Using the thus-obtained DSC curve and an analysis program of a DSC-60 system, Q1 is calculated in a shoulder of the melting peak endotherm of the crystalline organic compound corresponding to the first temperature increase.

A melting peak endotherm of the crystalline organic compound in the second temperature increase (hereinafter, referred to as Q2) is calculated in the following manner. After the first temperature increase, the sample is cooled from 150° C. to 0° C. at a temperature decreasing rate of 10° C./min, and heated again to 150° C. at a temperature increasing rate of 10° C./min; Using the thus-obtained DSC curve and an analysis program of a DSC-60 system, Q2 is calculated in a shoulder of the melting peak endotherm of the crystalline organic compound corresponding to the second temperature increase.

In the case where the melting peak of the crystalline organic compound overlaps with that of other materials, such as resins, waxes, etc., the DSC measurement of each of the other materials alone, and the crystalline organic compound alone are performed in the same manner as described above, and a melting peak derived from the crystalline organic compound is identified, and a melting peak derived from the other material is identified, followed by subtracting the melting peak derived from the other material from the melting peak derived from the crystalline organic compound, to thereby obtain Q1 and Q2.

When the ratio (Q2/Q1) of the melting peak of the crystalline organic compound in the second temperature increase to the melting peak of the crystalline organic compound in the first temperature increase is 0 to 0.30, the bleeding out of the crystalline organic compound from the toner can be prevented and the low temperature fixing ability can be sufficiently obtained.

The crystalline organic compound exists in the toner as crystalline domain, and preferably melts together with the amorphous polyester resin (a) when it is heated at the melting point or higher of the crystalline organic compound. The crystalline organic compound having crystallinity is confirmed by judging whether or not the crystalline organic compound is dissolved based on its X-ray diffraction chart, as an index of its crystallinity. Specifically, using a crystal analysis X-ray diffraction apparatus (X'Pert MRDX'Pert MRD, product of Philips Co.), it can be confirmed that a crystalline organic compound has crystallinity in a toner. First, only a crystalline organic compound is brayed in a mortar to prepare sample powder. The thus-prepared sample powder is uniformly coated on a sample holder. Subsequently, the sample holder is set in the diffraction apparatus, following by measurement, to thereby give diffraction spectra of the crystalline organic compound. Next, toner powder is coated on the holder, and then the holder is subjected to measurement similar to the above. Based on the diffraction spectra obtained in the case where only the crystalline organic compound is used, the crystalline organic compound contained in the toner can be identified. Also, in this diffraction apparatus, using a heating unit attached thereto, a change in diffraction spectra can be measured in accordance with a change in temperature. When X-ray diffraction spectra attributed to the crystalline organic compound are measured at normal temperature and 150° C. using the heating unit and then a change in peak area is determined between these temperatures, there can be measured the ratio of the amount of the crystalline organic compound dissolved in the resin after heating to that of the crystalline organic compound dissolved in the binder resin before heating. The greater a change in peak area attributed to the crystalline organic compound between before heating and after heating, the more the degree of dissolution of the crystalline organic compound in the binder resin through heating upon fixation. The toner contains the crystalline organic compound whose change in peak area is large between before heating and after heating and thus, is excellent in low temperature fixing ability.

The crystalline domain diameter of the crystalline organic compound in a toner is not particularly limited and may be appropriately determined depending on the intended purpose. For example, it is preferably 10 nm to 3 μm, more preferably 50 nm to 1 μm, as the largest particle diameter. When the diameter is smaller than 10 nm, the crystalline organic compound comes into contact with the binder resin in an increased surface area, potentially degrading heat resistant storage stability of the formed toner. Whereas when the diameter is greater than 3 μm, the crystalline organic compound is not sufficiently dissolved in the binder resin during heating upon fixation, potentially degrading a low temperature fixing ability of the formed toner.

The crystalline domain diameter of the crystalline organic compound is not particularly limited and may be appropriately determined depending on the intended purpose. For example, toner is embedded in an epoxy resin, and then the resultant product is sliced to a thickness of about 100 nm. The thus-obtained piece is stained with ruthenium tetroxide, and then is observed with a transmission electron microscope (TEM) at ×10,000 magnification, followed by photographing. The photograph is evaluated for dispersion state of the crystalline organic compound, to thereby measuring the domain diameter. Notably, in order to distinguish the crystalline organic compound from the releasing agent contained in the toner, the following is performed in advance. Specifically, the above procedure is repeated, except that the toner is changed to each of the crystalline organic compound and the releasing agent, to thereby confirm the difference in contrast between the crystalline organic compound and the releasing agent. When the above-confirmed difference in contrast is compared with the difference in contrast between the crystalline organic compound and the releasing agent contained in the actually observed toner, the crystalline organic compound can be distinguished from the releasing agent in the toner.

<Colorant>

The colorants is not particularly limited and may be appropriately selected from known colorants depending on the intended purpose; examples thereof include carbon blacks, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fiser Red, parachloroorthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine OX, Permanent Red FSR, Brilliant Carmine 6B, Pigment Scarlet 3B, Bordeaux 5B, Toluidine Maroon, Permanent Bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indanthrene blue (RS, BC), indigo, ultramarine blue, iron blue, anthraquinone blue, fast violet B, methylviolet lake, cobalt purple, manganese violet, dioxane violet, anthraquinone violet, chrome green, zinc green, chromium oxide, viridian green, emerald green, pigment green B, naphthol green B, green gold, acid green lake, malachite green lake, phthalocyanine green, anthraquinone green, titanium oxide, zinc flower, lithopone, and the like. These may be used alone or in combination.

The color of the colorant of the toner is not particularly limited and may be appropriately selected depending on the intended purpose. The colorant may be at least one selected from a colorant of a black toner, a colorant of a cyan toner, a colorant of a magenta toner and a colorant of a yellow toner, and toners of each color can be obtained by appropriately selecting each type of colorant. It is preferred that the colorant be a colorant of a color toner.

Examples of color pigments for the black toner include carbon blacks (C.I. Pigment Black 7) such as furnace black, lamp black, acetylene black and channel black; metals such as copper, iron (C.I. Pigment Black 11) and titanium oxide; and organic pigments such as aniline black (C.I. Pigment Black 1).

Examples of color pigments for the magenta toner include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209 and 211; C.I. Pigment Violet 19; and C.I. Vat Red 1, 2, 10, 13, 15, 23, 29 and 35.

Examples of color pigments for the cyan toner include C.I. Pigment Blue 2, 3, 15, 15:1, 15:2, 15:3, 15:4, 15:6, 16, 17 and 60; C.I. Vat Blue 6; C.I. Acid Blue 45, copper phthalocyanine pigments each having as substituent(s) one to five phthalimidemethyl groups on the phthalocyanine skeleton, Green 7 and Green 36.

Examples of color pigments for the yellow toner include C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154 and 180; C.I. Vat Yellow 1, 3 and 20, and Orange 36.

The amount of colorants contained in the toner is preferably 1% by mass to 15% by mass, and more preferably 3% by mass to 10% by mass. When the amount of colorants is less than 1% by mass, the tinting power of the toner may degrade, whereas, when the amount is more than 15% by mass, a pigment-dispersion defect occurs in the toner, which may cause de gradation of the coloring power and degradation of electric properties of the toner.

The colorant may also be used as a masterbatch obtained by combining with a resin. Examples of such resin include polyester, polylactic acid, polymers of styrene or substitution products thereof, styrene copolymers, polymethyl methacrylate, polybutyl methacrylate, polyvinyl chloride, polyvinyl acetate, polyethylene, polypropylene, epoxy resins, epoxy polyol resins, polyurethane, polyamide, polyvinyl butyral, polyacrylic resins, rosins, modified rosins, terpene resins, aliphatic hydrocarbon resins, alicyclic hydrocarbon resins, aromatic petroleum resins, chlorinated paraffin, and paraffin wax. These resins may be used alone or in combination. Among these resins, particularly preferred are polyester, and polylactic acid in terms of compatibility with the binder resin used in the present invention.

The masterbatch can be obtained by mixing and kneading the resin and the colorant under application of high shear force. On that occasion, it is preferable to use an organic solvent to enhance the interaction between the colorant and the resin. A so-called flashing method, where an aqueous paste containing colorant water is mixed and kneaded with a resin and an organic solvent to transfer the colorant to the resin, and water content and organic solvent component are removed, may also be preferably used because a wet cake of the colorant may be directly used without drying the cake. For the mixing and kneading, a high-shearing dispersion apparatus such as a triple roll mill is preferably used.

—Releasing Agent—

As releasing agents for use in the toner of the present invention, any known releasing agents can be used, as long as the releasing agents are not compatible with the amorphous polyester resin (a) which is contained in the first binder resin at the time of heat melting. Particularly, de-free fatty acid carnauba wax, polyethylene wax, montan wax and oxidized rice wax can be used alone or in combination. As the carnauba wax, preferred is a wax which is formed of microscopic crystalline particles, has an acid value of 5 mgKOH/g or less and a particle diameter, when dispersed in the toner binder, of 1 μm or smaller. As the montan wax, it is, generally, a montan-based wax which is refined with minerals, and preferred is a wax formed of microscopic crystalline particles similarly to the carnauba wax, and having an acid value of 5 mgKOH/g to 14 mgKOH/g. The oxidized rice wax is obtained by oxidizing rice bran wax in the air and preferably has an acid value of 10 mgKOH/g to 30 mgKOH/g. The reason of use of these waxes is that they can be moderately finely dispersed in the toner binder resin, thereby making it possible to readily obtain a toner which is superior in offset resistance, transferring property and durability, as described below. These waxes may be used alone or in combination.

As releasing agents other than described above, any conventionally known releasing agents, such as solid silicone wax, montan ester wax, polyethylene wax and polypropylene wax, can be used in the form of a mixture.

The melting point of the releasing agent is not particularly limited and may be suitably adjusted in accordance with the intended use, however, it is preferably 40° C. to 120° C., more preferably 70° C. to 90° C. When the melting point of the releasing agent is lower than 40° C., it may adversely affect the heat resistant storage stability of the toner, and when higher than 120° C., cold-offset may easily occur at the time of fixing an image at a low-temperature.

The melting point of the releasing agent is measured in the following manner. For example, using a differential scanning calorimeter (DSC210, manufactured by Seiko Instruments Inc.), a sample of the releasing agent is heated to 200° C., and then cooled from 200° C. to 0° C. at a temperature decreasing rate of 10° C./min, and then heated again at a temperature increasing rate of 10° C./min, to thereby obtain the maximum peak temperature of heat of melting as the melting point.

The melt viscosity of the releasing agent is, measured at the temperature 20° C. higher than the melting point of the releasing agent preferably 5 cps to 1,000 cps and, more preferably 10 cps to 100 cps. In cases where the melt viscosity is less than 5 cps, releasing ability may deteriorate, and when the melt viscosity is more than 1,000 cps, the hot offset resistance and the low temperature fixing ability may be improved insufficiently.

The amount of the releasing agent in the toner may be appropriately selected depending on the intended purpose; preferably, it is 1% by mass to 20% by mass, more preferably 3% by mass to 10% by mass, with respect to a toner resin component. When the amount is less than 1% by mass, offset prevention effect may not be sufficiently obtained. When the amount is more than 20% by mass, the transferring property and durability of the toner decrease.

A method for introducing the releasing agent is not particularly limited and may be appropriately selected depending on the intended purpose. Examples of the method include a method in which the releasing agent is kneaded and dispersed inside of a resin, a method of introducing the releasing agent by dispersing and/or dissolving in a solvent or a monomer droplet in the case of the chemical toner produced by a dissolution suspension method or an emulsion polymerization method, a method in which the releasing agent dispersed in water is aggregated and incorporated in particles, and a method in which the releasing agent is chemically attached to a particle surface.

—Other Components—

Other components of the toner are not particularly limited and may be appropriately selected depending on the intended purpose. Examples thereof include a charge control agent, a shape modifying agent, an external additive, a flowability improver, a cleaning improver, and a magnetic material.

—Charge Control Agent—

The charge control agent may be contained in the toner to impart appropriate charging ability, as necessary.

The charge control agent may be appropriately selected from known charge control agents depending on the intended purpose; it is preferable to employ such charge control agent that is close to either transparent or white as those made of colored materials change the color tone. Examples of charge control agent include triphenylmethane dyes, chelate molybdate pigment, rhodamine dyes, alkoxy amine, quaternary ammonium salt (including fluorine modified quaternary ammonium salt), alkylamide, phosphorus alone or compounds thereof, tungsten alone or compounds thereof, fluorine-based active agents, salicylic acid metal salts, and metal salts of salicylic acid derivatives. These may be used alone or in combination.

The charge control agent may be of commercially available ones. Specific examples thereof include quaternary ammonium salt BONTRON P-51, oxynaphthoic acid metal complex E-82, salicylic metal complex E-84, phenolic condensate E-89 (which are produced by Orient Chemical Industries Ltd.), molybdenum complex with quaternary ammonium salt TP-302 and TP-415 (which are produced by Hodogaya Chemical Co., Ltd.), quaternary ammonium salt copy charge PSY VP2038, triphenylmethane derivatives copy blue PR, quaternary ammonium salt copy charge NEG VP2036, copy charge NX VP434 (which are produced by Hochst), LRA-901, boron complex LR-147 (which are produced by Japan Carlit Co., Ltd.), quinacridone, azo pigment, and high-molecular-weight-compounds having sulfonic acid group, carboxyl group, or quaternary ammonium salt group.

The charge control agent may be dissolved and/or dispersed in the toner-forming materials after melting and kneading with a masterbatch which is a composite of a colorant and a resin, may be dissolved and/or dispersed into the organic solvent together with toner components, or may be immobilized to the surface of the resultant toner particles. Of these, a method of attaching fluorine-containing quaternary ammonium salt as the charge control agent to a particle surface is preferably used.

The amount of the charge control agent in the toner is determined depending on types of binder resin, and toner production methods including a dispersion method, and therefore cannot be uniquely determined. However, the amount of charge control agent is preferably 0.01% by mass to 5% by mass, and more preferably 0.02% by mass to 2% by mass based on the binder resin. When the amount is more than 5% by mass, charging ability of the toner becomes excessively significant, which lessens the effect of charge control agent itself and increases electrostatic attraction force with a developing roller, leading to decrease of developer flowability or image density degradation. When the amount is less than 0.01% by mass, the charge rising property and the charge amount are not insufficient, which may affect toner images.

—Shape Modifying Agent—

The shape modifying agent may be added to the toner for the purpose of modifying a toner shape, as necessary.

The shape modifying agent is not particularly limited and may be appropriately selected depending on the intended purpose. The shape modifying agent preferably contains a layered inorganic mineral in which a portion of interlayer ions is modified with organic ions. The modified layered inorganic mineral is preferably mineral having smectite-based basic crystal structure modified with organic cations. It is also possible to introduce metal anions into the layered inorganic mineral by substituting a part of divalent metal in the layered inorganic mineral with trivalent metal. However, when metal anions are introduced thereinto, the resulting mineral becomes highly hydrophilic. Therefore, a layered inorganic compound in which at least a part of metal anions is modified with organic anions is preferred.

As an organic cation modifier used for the layered inorganic mineral, quaternary alkyl ammonium salts, phosphonium salts and imidazole salts are exemplified. Among these, preferred are quaternary alkyl ammonium salts. Specific examples of the quaternary alkyl ammonium salts, trimethyl stearyl ammonium, dimethyl stearyl benzyl ammonium, and oleylbis(2-hydroxyethyl)methyl ammonium.

Specific examples of the organic anion modifier include sulfates, sulfonates, carboxylates or phosphates each further having a branched, unbranched or cyclic alkyl (C1-C44), alkenyl (C1-C22), alkoxy (C8-C32), hydroxyalkyl (C2-C22), ethylene oxide, and propylene oxide. Carboxylic acids having an ethylene oxide skeleton are preferable.

By partially modifying interlayer ions of the layered inorganic mineral with organic ions, it is possible to moderately impart hydrophobicity to the resulting toner. In addition, the toner will have moderate hydrophobicity, the oil phase containing the toner composition will have a non-Newtonian viscosity, and the resulting toner can be made to have a modified shape. At that occasion, the amount of the layered inorganic mineral in which a part of the toner material is modified with the organic ions is preferably 0.05% by mass to 10% by mass, and more preferably 0.05% by mass to 5% by mass.

The layered inorganic mineral in which a part thereof is modified with organic ions is not particularly limited and may be appropriately selected depending on the intended purpose. Examples thereof include montmorillonite, bentonite, hectorite, attapulgite, sepiolite, and mixtures thereof. Among these, organically modified montmorillonite or bentonite is preferable in terms that they do not influence on toner properties, their viscosities can be easily adjusted, and they are effective in a small additive amount.

Specific examples of commercially available layered inorganic mineral in which a part thereof is modified with organic cations include quaternium-18 bentonite such as BENTONE 3, BENTONE 38 and BENTONE 38V (produced by Rheox); TIXOGEL VP (produced by United Catalyst Inc.); CLAYTON 34, CLAYTON 40, and CLAYTON XL (produced by CLAYTON APA Southern Clay Product, Inc.); and stearalkonium bentonite such as BENTONE 27 (produced by Rheox), TIXOGEL LG (produced by United Catalyst Inc.), and CLAYTON AF and CLAYTON APA (produced by CLAYTON APA Southern Clay Product, Inc.); and quaternium-18 benzalkonium bentonite such as CLAYTON HT and CLAYTON PS (produced by Southern Clay Products, Inc.). Particularly preferred are CLAYTON AF and CLAYTON APA.

Further, as a layered inorganic mineral in which a part thereof is modified with organic anions, layered inorganic minerals obtained by modification of DHT-4A (Kyowa Chemical Industry Co., Ltd.) with an organic anion represented by the following General Formula (3) are particularly preferable. As a compound represented by the following General Formula (3), for example, HITENOL 330T (produced by DAI-ICHI KOGYO SEIYAKU CO., LTD.) is exemplified.

$$R^1(OR^2)nOSO_3M \qquad \text{General Formula (3)}$$

In the In General Formula (3), $R^1$ represents an alkyl group having 13 carbon atoms; $R^2$ represents an alkylene group having 2 to 6 carbon atoms; n is an integer of 2 to 10; and M represents a monovalent metal element.

—External Additive—

Various external additives can be added to the toner, for the purpose of improving flowability, and adjusting charge amount and electric properties.

The external additives are not particularly limited and may be appropriately selected from known external additives. Examples thereof include silica fine particles, hydrophobized silica fine particles, fatty acid metal salts such as zinc stearate and aluminum stearate; metal oxides, such as titania, alumina, tin oxide and antimony oxide, or hydrophobized metal oxides and fluoropolymer. Of these, the hydrophobized silica fine particles, titania particles, and hydrophobized titania particles are preferred.

The hydrophobized silica fine particles are not particularly limited and may be appropriately selected depending on the intended purpose. Examples thereof include HDK H 2000, HDK H2000/4, HDK H2050EP, HVK21, and HDK H1303 (all produced by Hoechst A G); and R972, R974, RX200, RY200, R202, R805, and R812 (all produced by Japan AEROSIL Inc.). Titania fine particles are not particularly limited and may be appropriately selected depending on the intended purpose. Examples thereof include P-25 (produced by Japan AEROSIL Inc.); STT-30 and STT-65C-S (both produced by Titan Kogyo Ltd.); TAF-140 (produced by Fuji Titanium Industry Co., Ltd.); and MT-150W, MT-500B, MT-600B, and MT-150A (all produced by TAYCA CORPORATION). The hydrophobized titanium oxide fine particles are not particularly limited and may be appropriately selected depending on the intended purpose. Examples thereof include T-805 (produced by Japan AEROSIL Inc.); STT-30A and STT-65S-S (both produced by Titan Kogyo Ltd.); TAF-500T and TAF-1500T (both produced by Fuji Titanium Industry Co., Ltd.); MT-100S and MT-100T (both produced by TAYCA CORPORATION); and IT-S (produced by ISHIHARA SANGYO KAISHA LTD.).

The hydrophobized silica fine particles, hydrophobized titania fine particles, and hydrophobized alumina fine particles can be obtained by subjecting hydrophilic fine particles to a surface treatment with a silane coupling agent such as methyl trimethoxy silane, methyl triethoxy silane, octyl trimethoxy silane or the like.

The hydrophobizing agent is not particularly limited and may be appropriately selected depending on the intended purpose. Examples thereof include silane coupling agents such as dialkyl-dihaloganated silane, trialkyl halogenated silane, alkyl trihalogenated silane, and hexaalkyl disilazane coupling agents; silylation agents, silane coupling agents having a fluoride alkyl group, organic titanate-based coupling agents, aluminum-based coupling agents, silicone oils and varnishes.

A silicone oil-treated inorganic fine particle is also suitably used, which is obtained by treating an inorganic fine particle with silicone oil, if necessary, under application of heat.

The inorganic fine particles are not particularly limited and may be appropriately selected depending on the intended purpose. Examples of the inorganic fine particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. Of these, silica and titanium dioxide are particularly preferable.

The silicone oil is not particularly limited and may be appropriately selected depending on the intended purpose. Examples thereof include dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl or methacryl-modified silicone oil, and α-methylstyrene-modified silicone oil.

The average primary particle diameter of the inorganic fine particles is not particularly limited and may be appropriately selected depending on the intended purpose; it is preferably 1 nm to 100 nm, and more preferably 3 nm to 70 nm. When the average primary particle diameter is smaller than 1 nm, the inorganic fine particles are embedded in the toner, and the function of the inorganic fine particles sometimes may not be sufficiently exhibited. When it is larger than 100 nm, the surface of an electrostatic image bearing member may be unevenly damaged with the organic fine particles. As the external additive, an inorganic fine particle and a hydrophobized inorganic fine particle can be used in combination. In this case, the average particle diameter of primary particles that have been hydrophobized is preferably 1 nm to 100 nm, and more preferably 5 nm to 70 nm. It is preferable that the toner contain at least two different types of inorganic fine particles of which the average particle diameter of primary particles that have been hydrophobized is 20 nm or smaller and at least one type of inorganic fine particle whose particle diameter is 30 nm or larger. The specific surface area of the inorganic fine particle determined by BET method is preferably 20 $m^2/g$ to 500 $m^2/g$.

The amount of the external additive added to the toner is preferably 0.1% by mass to 5% by mass, and more preferably 0.3% by mass to 3% by mass.

As the external additive, resin fine particles may also be added. Examples thereof include polystyrene obtained by soap-free emulsification polymerization, suspension polymerization, or dispersion polymerization; copolymers of methacrylic acid ester or acrylic acid ester; polycondensates of silicone, benzoguanamine, nylon or the like; and polymer particles obtained from thermosetting resins. Use of such resin fine particles in combination makes it possible to enhance the chargeability of the resulting toner and to reduce the amount of inversely charged toner, thereby reducing background smear. The amount of the resin fine particles added to the toner is preferably 0.01% by mass to 5% by mass, and more preferably 0.1% by mass to 2% by mass.

—Flowability Improver—

The flowability improver is an agent applying surface treatment to improve hydrophobic properties, and is capable of inhibiting the degradation of flowability or charging ability in high humidity environment. Examples of the flowability improver include silane coupling agents, silylating agents, fluorinated alkyl group-containing silane coupling agents, organic titanate-based coupling agents, aluminum-based coupling agents, silicone oil and modified silicone oil. When silica and titanium oxide are used, preferably, they are subjected to a surface treatment using the flowability improver and used as hydrophobic silica and hydrophobic titanium oxide.

—Cleaning Improver—

The cleaning improver is used for the purpose of easily removing developer remaining after transfer on a photoconductor and a primary transfer medium. The cleaning improver is not particularly limited and may be appropriately selected depending on the intended purpose. Examples thereof include fatty acid metal salts (e.g., zinc stearate and calcium stearate, stearic acid) and polymer fine particles produced through soap-free emulsification polymerization (e.g., polymethyl methacrylate fine particles and polystyrene fine particles). Preferably, the polymer fine particles have a relatively narrow particle size distribution and a volume average particle diameter of 0.01 μm to 1 μm.

—Magnetic Material—

The magnetic material is not particularly limited and may be appropriately selected depending on the intended purpose. Examples thereof include iron powder, magnetite and ferrite. Note that the magnetic material is preferably white in consideration of the color tone.

—Method for Producing Toner—

The method for producing a toner is not particularly limited and may be appropriately selected depending on the intended purpose. Examples of the method for producing a toner include pulverization method; polymerization method (suspension polymerization method, emulsification polymerization method) in which a monomer composition containing a polymerizable monomer is directly polymerized in an aqueous phase; polyaddition reaction method in which a composition containing an isocyanate group-containing prepolymer is directly elongated or crosslinked with amines in an aqueous phase, polyaddition reaction method using an isocyanate group-containing prepolymer; pulverization method in which a toner material is dissolved with a solvent, the solvent is removed, and the toner material is pulverized; and fusion spraying method.

The pulverization method is a method of obtaining the toner base particle, for example, by fusing and/or kneading, pulverizing a toner material and then classifying the particle. In a case of the pulverization method, for the purpose of increasing the average circularity of the toner, the obtained toner base particle may be controlled by applying a mechanical impulse force. In this case, the mechanical impulse force can be applied to the toner base particle using equipment such as hybridizer and mechanofusion.

Toner materials at least containing a first binder resin, a colorant, a releasing agent, a crystalline organic compound is mixed, and then the resultant mixture is melt-kneaded with a melt kneader. Examples of the melt kneader include uniaxial or biaxial continuous kneaders and batch kneaders using a roll mill. Preferred examples thereof include a KTK-type biaxial extruder (product of KOBE STEEL. Ltd.), a TEM-type extruder (product of TOSHIBA MACHINE CO., LTD.), a biaxial extruder (product of KCK Co., Ltd.), a PCM-type biaxial extruder (product of IKEGAI LTD.) and a co-kneader (product of BUSS Company). Preferably, the melt-kneading is performed under appropriate conditions so as not to cleave the molecular chains of the binder resin. The temperature during melt-kneading is determined in consideration of the softening point of the binder resin. Specifically, when the temperature is much higher than the softening point, cleavage of the molecular chains occurs to a considerable extent; whereas when the temperature is much lower than the softening point, a sufficient dispersion state is difficult to attain.

The thus-kneaded product is pulverized to form particles. In this pulverization, the kneaded product is roughly pulverized and then finely pulverized. Preferred examples of pulverizing methods include a method in which the kneaded product is crushed against a collision plate under a jet stream for pulverization, a method in which the kneaded particles are crushed one another under a jet stream for pulverization, and a method in which the kneaded product is pulverized by passage through the narrow gap between a mechanically rotating rotor and a stator.

The thus-pulverized product is classified to prepare particles having a predetermined particle diameter. This classification is performed by removing fine particles with a cyclone, a decanter, a centrifugal separator, etc.

After the pulverization and classification are completed, pulverized products are classified in flow air by centrifugal force or the like, to thereby produce toner particles each having a certain particle size.

Moreover, to each of the thus-produced toner particles, shell particles containing the second binder resin is attached using a device such as a hybridizer and mechanofusion, to thereby obtain toner base particles.

If necessary, the surface of the toner base particle may be coated with the external additives described above using a HENSCHEL MIXER, or the like.

The suspension polymerization method is performed in the following manner. In an oil-soluble polymerization initiator and a polymerizable monomer, a first binder resin, a colorant, a releasing agent, a crystalline organic compound are dispersed, and then this dispersion is emulsified and dispersed in an aqueous medium containing a surfactant, and other solid dispersant by the emulsification method described below. Thereafter, polymerization reaction is performed to form particles. Moreover, to a surface of each of the thus-obtained toner particles, shell particles containing the second binder resin are attached by a wet process, to thereby obtain a core shell-type toner base particle. If necessary, wet process for attaching inorganic fine particles to a surface of toner base particle may be performed. When the wet process is performed, an excess amount of a surfactant is preferably washed out, before the toner particles are subjected to wet process.

The polymerizable monomer is not particularly limited and may be appropriately selected depending on the intended purpose. Examples thereof include acids such as acrylic acid, methacrylic acid, α-cyanoacrylic acid, α-cyanomethacrylic acid, itaconic acid, crotonic acid, fumaric acid, maleic acid and maleic anhydride; acrylamide, methacrylamide, diacetone acrylamide and methylol compounds thereof, (meth) acrylate having amino groups such as vinyl pyridine, vinyl pyrrolidone, vinyl imidazole, ethylene imine, dimethylaminoethy methacrylate. By using the polymerizable monomer in a part, a functional group can be introduced into the surface of the toner particle.

Moreover, by using a dispersant having an acid group or a basic group, the dispersant is adsorbed and remains onto the particle surface, so as to introduce a functional group thereto.

The emulsion polymerization method is performed in the following manner. A water-soluble polymerization initiator and a polymerizable monomer are emulsified in water using a surfactant, and a latex is synthesized by typical emulsion polymerization. Separately, a dispersion is prepared by dispersing a first binder resin, a colorant, a releasing agent, a crystalline organic compound, etc. in an aqueous medium. The latex and the dispersion are mixed, and the dispersed elements therein are aggregated in a size of a toner, and fused by heating, to thereby obtain core particles. Thereafter, shell particles containing the second binder resin are attached to a surface of each of the core particles by wet process, to thereby obtain a core shell toner base particles. If necessary, a wet process of inorganic fine particles may be performed. A functional group can be introduced into a toner particle surface by using a monomer similar to the monomer used in suspension polymerization method, as the latex.

Among these, a toner obtained by the following production method (I) is preferable, because the resulting toner has high selectivity of resin, high low temperature fixing ability, and excellent granulation properties, and the particle size, particle size distribution, and shape of the toner can be easily controlled. Specifically, a toner material containing a reactive group-containing prepolymer (α), an active hydrogen group-containing compound (β), a first binder resin containing an amorphous polyester resin (a), a colorant, a releasing agent, and a crystalline organic compound is dissolved and/or dispersed in an organic solvent to prepare a toner solution. The toner solution is emulsified and/or dispersed in an aqueous medium which contains shell particles containing a second binder resin, to prepare a dispersion solution. In the aqueous medium, the reactive group-containing prepolymer (α) is reacted with the active hydrogen group-containing compound (β) to form particles of adhesive material, and the organic solvent is removed, to thereby obtain a toner (production method (I)).

The shell particles containing the second binder resin can be formed by known polymerization method. The shell particles are preferably obtained as an aqueous dispersion liquid of the shell particles. Examples of preparation processes of the aqueous dispersion liquid of the shell particles include (i) a direct preparation process of aqueous dispersion liquid of the resin fine particles in which a vinyl monomer as a raw material is polymerized by suspension-polymerization process, emulsification-polymerization process, seed polymerization process or dispersion-polymerization process; (ii) a preparation process of aqueous dispersion of the resin fine particles in which, in the case of the polyaddition or condensation resin such as polyester resin, polyurethane resin, or epoxy resin, a precursor (monomer, oligomer or the like) or solvent solution thereof is dispersed in an aqueous medium in the presence of a dispersing agent, and heated or added with a curing agent so as to be cured, thereby producing the aqueous dispersion of the resin fine particles; (iii) a preparation process of aqueous dispersion liquid of the resin fine particles in which, in the case of the polyaddition or condensation resin such as polyester resin, polyurethane resin, or epoxy resin, an appropriately selected emulsifier is dissolved in a precursor (monomer, oligomer or the like) or solvent solution thereof (preferably being liquid, or being liquidized by heating), and then water is added so as to induce phase inversion emulsification, thereby producing the aqueous dispersion of the resin fine particles; (iv) a preparation process of aqueous dispersion liquid of the resin fine particles, in which a resin, previously prepared by polymerization process which may be any of addition polymerization, ring-opening polymerization, polyaddition, addition condensation, or condensation polymerization, is pulverized by means of a pulverizing mill such as mechanical rotation-type, jet-type or the like, and classified to obtain resin fine particles, and then the resin fine particles are dispersed in an aqueous medium in the presence of an appropriately selected dispersing agent, thereby producing the aqueous dispersion of the resin fine particles; (v) a preparation process of aqueous dispersion liquid of the resin fine particles, in which a resin, previously prepared by a polymerization process which may be any of addition polymerization, ring-opening polymerization, polyaddition, addition condensation or condensation polymerization, is dissolved in a solvent, the resultant resin solution is sprayed in the form of a mist to thereby obtain resin fine particles, and then the resulting resin fine particles are dispersed in an aqueous medium in the presence of a appropriately selected dispersing agent, thereby producing the aqueous dispersion of the resin fine particles; (vi) a preparation process of aqueous dispersion liquid of the resin fine particles, in which a resin, previously prepared by a polymerization process, which may be any of addition polymerization, ring-opening polymerization, polyaddition, addition condensation or condensation polymerization, is dissolved in a solvent, the resultant resin solution is subjected to precipitation by adding a poor solvent or cooling after heating and dissolving, the solvent is removed to thereby obtain resin fine particles, and then the resulting resin fine particles are dispersed in an aqueous medium in the presence of a appropriately selected dispersing agent, thereby producing the aqueous dispersion of the resin fine particles; (vii) a preparation process of aqueous dispersion liquid of the resin fine particles, in which a resin, previously prepared by a polymerization process, which may be any of addition polymerization, ring-opening polymerization, polyaddition, addition condensation or condensation polymerization, is dissolved in a solvent to thereby obtain a resin solution, the resin solution is dispersed in an aqueous medium in the presence of a appropriately selected dispersing agent, and then the solvent is removed by heating or reduced pressure to thereby obtain the aqueous dispersion of the resin fine particles; (viii) a preparation process of aqueous dispersion liquid of the resin fine particles, in which a resin, previously prepared by a polymerization process, which is any of addition polymerization, ring-opening polymerization, polyaddition, addition condensation or condensation polymerization, is dissolved in a solvent to thereby obtain a resin solution, a appropriately selected emulsifier is dissolved in the resin solution, and then water is added to the resin solution so as to induce phase inversion emulsification, thereby producing the aqueous dispersion of the resin fine particles.

The volume average particle diameter of the shell particles is not particularly limited and may be appropriately selected depending on the intended purpose. It is preferably 10 nm to 300 nm, more preferably 30 nm to 120 nm.

—Reactive Group-Containing Prepolymer (α)—

The reactive group-containing prepolymer (α) is a polymer having a functional group (α1) capable of reacting with the active hydrogen group containing compound (β).

Examples of the functional group (α1) capable of reacting with the active hydrogen group containing compound include an isocyanate group (α1a), a blocked isocyanate group (α1b), an epoxy group (α1c), an acid anhydride group (α1d) and an acid halide group (α1e). Among these, preferred are (α1a), (α1b) and (α1c), and particularly referred are (α1a) and (α1b). A blocked isocyanate group (α1b) is an isocyanate group blocked by a blocking agent. Examples of the blocking agent include oximes, such as acetoxime, methylisobutylketoxime, diethylketoxime, cyclopentanone oxime, cyclohexanone oxime, methylethylketoxime, etc.; lactams, such as γ-butyrolactame, ε-caprolactam, γ-valerolactam, etc.; aliphatic alcohols having 1 to 20 carbon atoms, such as ethanol, methanol, octanol, etc.; phenols, such as phenol, cresol, xylenol, nonylphenol, etc.; active methylene compounds, such as acetylacetone, ethyl malonate, ethyl acetoacetate, etc.; basic nitrogen-containing compounds, such as N,N-diethylhydroxylamine, 2-hydroxypyridine, pyridine-N-oxide, 2-mercaptopyridine, etc.; and mixtures thereof. Among these, preferred are oximes, and particularly preferred are methylethylketoxime.

As a skeleton of the reactive group-containing prepolymer (α), polyether (αw), polyester (αx), epoxy resin (αy) and polyurethane (αz) are exemplified. Among these, preferred are (αx), (αy) and (αz), and particularly preferred are (αx) and (αz). Examples of the polyether (αw) include polyethylene oxide, polypropylene oxide, polybutylene oxide, and polytetramethylene oxide. Examples of the polyester (αx) include polycondensation products between a diol and a dicarboxylic acid, and polylactone (such as ring-opening polymer of ε-caprolactone, etc.). Examples of the epoxy resin (αy) include addition condensation products between bisphenol (such as bisphenol A, bisphenol F, bisphenol S, etc.) and epichlorohydrin. Examples of the polyurethane (αz) include polyaddition products between a diol and a polyisocyanate, and polyaddition products between the polyester (αx) and the polyisocyanate.

As a method of introducing a reactive group into the polyester (αx), epoxy resin (αy), polyurethane (αz) or the like, the following methods are exemplified:

I. a method in which one of two or more components is excessively used in amount to make its functional group of the component present at the ends of the skeleton; and II. a method in which one of two or more components is excessively used in amount to make its functional group of the components reside at the ends of the skeleton, and further, a compound containing a functional group capable of reacting with the remaining functional group and a reactive group is added so as to react with each other.

In the method I described above, it is possible to obtain a hydroxyl group-containing polyester prepolymer, a carboxyl group-containing polyester prepolymer, an acid halide group-containing polyester prepolymer, a hydroxyl group-containing epoxy resin prepolymer, an epoxy group-containing epoxy resin prepolymer, a hydroxyl group-containing polyurethane prepolymer, an isocyanate group-containing polyurethane prepolymer, etc. As for the ratio of constitutional components, for example, in the case of a hydroxyl group-containing polyester prepolymer, the mixing ratio of the polyol to the polycarboxylic acid, as an equivalent ratio [OH]/[COOH] of hydroxyl group [OH] content relative to carboxyl group [COOH] content in the polyester resin, is preferably 2/1 to 1/1, more preferably 1.5/1 to 1/1, and particularly preferably 1.3/1 to 1.02/1. In the case of a prepolymer having a different skeleton and different end groups therefrom, the same applies to the mixing ratio, with only a change in their components.

In the method II described above, to a prepolymer obtained by the method I, a polyisocyanate is reacted to thereby an isocyanate group-containing prepolymer can be obtained; a blocked polyisocyanate is reacted to thereby obtain a blocked isocyanate group-containing prepolymer; a polyepoxide is reacted to thereby obtain an epoxy group-containing prepolymer; and a polyacid anhydride is reacted to thereby obtain an acid anhydride group-containing prepolymer. As for the amount of a compound containing a functional group and a reactive group used, for example, when a polyisocyanate is reacted to a hydroxyl group-containing polyester to obtain an isocyanate group-containing polyester prepolymer, the mixing ratio of the polyisocyanate, as an equivalent ratio [NCO]/[OH] of isocyanate group [NCO] content in the polyisocyanate to hydroxyl group [OH] content in the hydroxyl group-containing polyester, is preferably 5/1 to 1/1, more preferably 4/1 to 1.2/1, and particularly preferably 2.5/1 to 1.5/1. In the case of a prepolymer having a different skeleton and different end groups therefrom, the same applies to the mixing ratio, with only a change in their components The number of reactive groups per molecule in the reactive group-containing prepolymer (α) is usually one or more, preferably 1.5 to 3 on average, and more preferably 1.8 to 2.5 on average. Within the above range, the molecular weight of a cured product to be obtained by reacting with the active hydrogen group containing compound (β) becomes higher. The Mn of the reactive group-containing prepolymer (α) is preferably 500 to 30,000, more preferably 1,000 to 20,000, and particularly preferably 2,000 to 10,000. The weight average molecular weight of the reactive group-containing prepolymer (α) is preferably 1,000 to 50,000, more preferably 2,000 to 40,000, and still more preferably 4,000 to 20,000. The viscosity of the reactive group-containing prepolymer (α) is preferably 2,000 poises or less, and more preferably 1,000 poises or less at 100° C. By setting the viscosity to 2,000 poises or less, it is preferable in that toner base particles having a sharp particle size distribution is obtained with a small amount of an organic solvent.

—Active Hydroxyl Group-Containing Compound (β)—

Examples of the active hydroxyl group-containing compound (β) include polyamine (βa) which may be blocked with a compound capable of eliminating it, polyol (βb), polymercaptane (βc), and water (βd). Among these, polyamine (βa), polyol (βb), and water (βd) are preferable, polyamine (βa), and water (βd) are more preferable, and blocked polyamines and water (βd) are particularly preferable.

The polyamines (βa) are not particularly limited and may be appropriately selected depending on the intended purpose. Examples thereof include aliphatic polyamines (C2 to C18) such as [1] aliphatic polyamines, for example, C2-C6 alkylenediamines, such as ethylenediamine, propylenediamine, trimethylenediamine, tetramethylenediamine, hexamethylenediamine, etc.; polyalkylene (C2-C6) polyamines, such as diethylenetriamine, iminobispropylamine, bis(hexamethylene)triamine, triethylenetetramine, tetraethylenepentamine, pentaethylenehexamine, etc.; [2] alkyl (C1-C4) or hydroxyalkyl (C2-C4) substitution products of the above aliphatic polyamines, for example, dialkyl (C1-C3) aminopropylamines, trimethylhexamethylenediamine, aminoethylethanolamine, 2,5-dimethyl-2,5-hexamethylenediamine, methyliminobispropylamine, etc.; [3] alicyclic or heterocyclic ring-containing aliphatic polyamines, for example, 3,9-bis(3-aminopropyl)-2,4,8,10-tetraoxaspiro[5,5]undecane, etc.; [4] aromatic ring-containing aliphatic amines (C8-C15), such as xylylenediamine, tetrachloro-p-xylylenediamine, etc.; alicyclic polyamines (C4-C15) such as 1,3-diaminocyclohexane, isophoronediamine, menthenediamine, 4,4'-methylenedicyclohexanediamine (hydrogenated methylenedianiline), etc.; and heterocyclic polyamines (C4-C15) such as piperazine, N-aminoethylpiperazine, 1,4-diaminoethylpiperazine and 1,4-bis(2-amino-2-methylpropyl)piperazine; aromatic polyamines (C6-C20) such as [1] unsubstituted aromatic polyamines, for example, 1,2-phenylenediamine, 1,3-phenylenediamine, 1,4-phenylenediamine, 2,4-diphenylmethanediamine, 4,4'-diphenylmethanediamine, crude diphenylmethanediamine (polyphenylpolymethylenepolyamine), diaminodiphenylsulfone, benzidine, thiodianiline, bis(3,4-diaminophenyl)sulfone, 2,6-diaminopyridine, m-aminobenzylamine, triphenylmethane-4,4',4"-triamine, naphthylenediamine, etc.; [2] aromatic polyamines containing nuclear-substituted alkyl groups, for example, C1-C4 alkyl group such as methyl group, ethyl group, n-propyl group and i-propyl group, such as 2,4-tolylenediamine, 2,6-tolylenediamine, crude tolylenediamine, diethyltolylenediamine, 4,4'-diamino-3,3'-dimethyldiphenylmethane, 4,4'-bis(o-toluidine), dianisidine, diaminoditolylsulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2,4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diaminodiphenylether, 3,3',5,5'-tetraisopropyl-4,4'-diaminodiphenylsulfone, etc.; and mixtures of various proportions of isomers of these aromatic polyamines; [3] aromatic polyamines containing nuclear-substituted electron-withdrawing groups, e.g., halogen groups such as Cl group, Br group, I group and F group; alkoxy groups such as methoxy group and ethoxy group; nitro group etc., for example, methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline, 4,4'-diamino-3,3'-dimethyl-5,5'-dibromo-diphenylmethane, 3,3'-dichlorobenzidine, 3,3'-dimethoxybenzidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline), 4-aminophenyl-2-chloroaniline, etc.; and [4] secondary amino group-containing aromatic polyamines, for example, polyamines obtained by replacing some or all of —$NH_2$ groups in the aromatic polyamines of [1] to [3] with —NH—R' groups (R' denotes a lower alkyl group such as methyl group or ethyl group), such as 4,4'-di(methylamino)diphenylmethane, 1-methyl-2-methylamino-4-aminobenzene, etc.; polyamide polyamines such as low-molecular-weight polyamide polyamines obtained by condensation between dicarboxylic acids (e.g. dimer acids) and excess amounts (2 moles or more per mole of acid) of polyamines (e.g., the above-mentioned alkylenediamines and polyalkylenepolyamines), and; polyether polyamines, for example, hydrogenated products of cyanoethylated products of polyether polyols (e.g. polyalkyleneglycols). Preferable among these examples of the polyamines (βa) are 4,4'-diaminodiphenyl methane, xylylenediamine, isophoronediamine, ethylenediamine, diethylenetriamine, triethylenetetramine, and mixtures thereof.

Examples of the polyamines (βa), in the case where the polyamines (βa) are blocked with compounds capable of eliminating, include ketimine compounds obtained from the above-mentioned polyamines and C3-C8 ketones (e.g. acetone, methyl ethyl ketone and methyl isobutyl ketone), aldimine compounds obtained from C2-C8 aldehyde compounds (e.g. formaldehyde and acetaldehyde), enamine compounds and oxazolidine compounds.

Examples of the polyols (βb) include the same diols and polyols as de scribed above. Use of any of the diols alone, or a mixture of any of the diols and a small amount of any of the polyols is preferable.

Examples of the polymercaptan (βc) include ethylene diol, 1,4-butanedithiol and 1,6-hexanedithiol.

If necessary, a reaction terminator (βs) may be used together with the active hydrogen group-containing compound (β). By also using the reaction terminator (βs) such that the ratio of the reaction terminator (βs) to the active hydrogen group-containing compound (β) is kept constant, the molecular weight of the resin obtained by the reaction between the reactive group-containing prepolymer (α) and the active hydrogen group-containing compound (β) can be adjusted to a predetermined molecular weight. Examples of the reaction terminator (βs) include monoamines (such as diethylamine, dibutylamine, butylamine, laurylamine, monoethanolamine and diethanolamine); blocked monoamines (such as ketimine compounds); monools (such as methanol, ethanol, isopropanol, butanol and phenol); monomercaptans (such as butylmercaptan and laurylmercaptan); monoisocyanates (such as lauryl isocyanate and phenyl isocyanate); and monoepoxides (such as butyl glycidyl ether).

As for the ratio of the reactive group-containing prepolymer (α) to the active hydrogen group-containing compound (β), the ratio ([α]/[β]) of the equivalent amount [α] of reactive groups contained in the reactive group-containing prepolymer (α) to the equivalent amount [β] of active hydrogen-containing groups contained in the active hydrogen group-containing compound (β) is preferably in the range of 1/2 to 2/1, more preferably 1.5/1 to 1/1.5, even more preferably 1.2/1 to 1/1.2. When the active hydrogen group-containing compound (β) is water (βd), the water is regarded as a divalent active hydrogen compound.

In the method (I) for producing the resin particle, besides water, an organic solvent (acetone, methyl ethyl ketone, etc.) which is miscible with water, among any of the after-mentioned examples of the organic solvent (u), may be contained in the aqueous dispersion liquid. The organic solvent with the miscibility is not particularly limited and may be appropriately selected depending on the intended purpose, as long as it does not hinder formation of the resin particle. The amount of the organic solvent with the miscibility is not particularly limited either, as long as the foregoing requirements are satisfied. Use of such an organic solvent which occupies 40% by mass or less of the total amount of water and the organic solvent and which does not remain in the dried resin particle is preferable.

—Organic Solvent—

In the production method (I), an organic solvent for dissolving/dispersing the toner materials is not particularly limited and may be appropriately selected depending on the intended purpose. Examples thereof include aromatic hydrocarbon solvents such as toluene, xylene, ethylbenzene, and tetralin; aliphatic or alicyclic hydrocarbon solvents such as n-hexane, n-heptane, mineral split, and cyclohexane; halogen solvents such as methyl chloride, methyl bromide, methyl iodide, methylene dichloride, carbon tetrachloride, trichloroethylene, and perchloroethylene; ester or ester-ether solvents such as ethyl acetate, butyl acetate, methoxybutyl acetate, methylcellosolve acetate, and ethylcellosolve acetate; ether solvents such as diethylether, tetrahydrofuran, dioxane, ethylcellosolve, butylcellosolve, propylene glycol monomethyl ether; ketone solvents such as acetone, methylethylketone, methylisobutylketone, di-n-butylketone, and cyclohexanone; alcohol solvents such as methanol, ethanol, n-propanol, isopropanol, n-butanol, isobutanol, t-butanol, 2-ethylhexyl alcohol, benzyl alcohol; amide solvents such as dimethylformamide, and dimethylacetoamide; sulfooxide solvents such as diemthylsulfoxide; heterocyclic compound based solvents such as N-methylpyrollidone; and mixture solvents thereof.

—Emulsifier or Dispersant—

An emulsifier or dispersant may be used for the purpose of emulsification and/or dispersion of the constituents in the production method (I). As the emulsifier or dispersant, known surfactants, water-soluble polymers, or the like can be used. Moreover, as an auxiliary agent of the emulsifier or dispersant, the above-described organic solvents and plasticizers, etc. may be used in combination with the emulsifier or dispersant. The surfactants are not particularly limited and may be appropriately selected depending on the intended purpose. Examples thereof include anionic surfactants, cationic surfactants, ampholytic surfactants, and nonionic surfactants. These may be used alone or in combination. Specific examples of the surfactants will be described hereinafter.

—Anionic Surfactant—

The anionic surfactants are not particularly limited and may be appropriately selected depending on the intended purpose. Examples thereof include carboxylic acids or salts thereof, sulfate salts, salts of carboxymethylated compounds, sulfonic acid salts, and phosphate salts.

The carboxylic acids or the salts of the anionic surfactants are not particularly limited and may be appropriately selected depending on the intended purpose. Examples thereof include C8-C22 saturated or unsaturated fatty acids or salts thereof, such as capric acid, lauric acid, myristic acid, palmitic acid, stearic acid, arachidic acid, behenic acid, oleic acid, linoleic acid, ricinoleic acid, and mixtures of higher fatty acids obtained by saponifying coconut oil, palm oil, rice bran oil, beef fat, etc. Examples of salts thereof include sodium salts, potassium salts, amine salts, ammonium salts, quaternary ammonium salts and alkanolamine salts (monoethanolamine salts, diethanol amine salts, triethanol amine salts, etc.) thereof.

The sulfate salts of the anionic surfactants are not particularly limited and may be appropriately selected depending on the intended purpose. Examples thereof include higher alcohol sulfate salts (sulfate salts of C8-C18 aliphatic alcohols), higher alkyl ether sulfate salts (sulfate salts of EO or PO (1 mol to 10 mol) adducts of C8-C18 aliphatic alcohols), sulfated oils (obtained by directly sulfating C12-C50 natural unsaturated fats or unsaturated waxes, and thereby neutralizing these), sulfated fatty acid esters (obtained by sulfating lower alcohol (C1-C8) esters of unsaturated fatty acids (C6-C40) and thereby neutralizing these), and sulfated olefins (obtained by sulfating C12-C18 olefins and thereby neutralizing these). Examples of salts of the sulfate salts include sodium salts, potassium salts, amine salts, ammonium salts, quaternary ammonium salts, and alkanolamine salts (e.g. monoethanolamine salts, diethanol amine salts and triethanol amine salts). Examples of the higher alcohol sulfate salts include octyl alcohol sulfate salt, decyl alcohol sulfate salt, lauryl alcohol sulfate salt, stearyl alcohol sulfate salt, sulfate salts of alcohols (e.g. ALFOL 1214 (product name), manufactured by CONDEA) synthesized using a Ziegler catalyst, and sulfate salts of alcohols (e.g. DOBANOL 23, 25 and 45 and DIADOL 115, 115H and 135 (product name), manufactured by Mitsubishi Chemical Corporation; TRIDECANOL (product name), manufactured by Kyowa Hakko Co., Ltd.; and OXOCOL 1213, 1215 and 1415 (product name), manufactured by Nissan Chemical Industries, Ltd.) synthesized by the oxo method. Examples of the higher alkyl ether sulfate salts include sulfate salts of EO (2 mol) adducts of lauryl alcohol, and sulfate salts of EO (3 mol) adducts of octyl alcohol. Examples of the sulfated oils include salts of sulfated compounds such as castor oil, peanut oil, olive oil, canola oil, beef fat and sheep fat. Examples of the sulfated fatty acid esters include salts of sulfated compounds such as butyl oleate and butyl ricinolate. Examples of the sulfated olefins include TEEPOL (product name), manufactured by Shell Chemicals.

The salts of the carboxymethylated compounds of the anionic surfactants are not particularly limited and may be appropriately selected depending on the intended purpose. Examples thereof include salts of carboxymethylated compounds of C8-C16 aliphatic alcohols, and salts of carboxymethylated compounds of EO or PO (1 mol to 10 mol) adducts of C8-C16 aliphatic alcohols. Examples of the salts of the carboxymethylated compounds of the C8-C16 aliphatic alcohols include octyl alcohol carboxymethylated sodium salt, lauryl alcohol carboxymethylated sodium salt, carboxymethylated sodium salt of DOBANOL 23, and tridecanol carboxymethylated sodium salt. Examples of the salts of the carboxymethylated compounds of the EO or PO (1 mol to 10 mol) adducts of the C8-C16 aliphatic alcohols include octyl alcohol EO or PO (3 mol) adduct carboxymethylated sodium salt, lauryl alcohol EO or PO (4 mol) adduct carboxymethylated sodium salt, and tridecanol EO or PO (5 mol) adduct carboxymethylated sodium salt.

The sulfonic acid salts of the anionic surfactants are not particularly limited and may be appropriately selected depending on the intended purpose. Examples thereof include alkyl benzene sulfonates, alkyl naphthalene sulfonates, sulfosuccinic acid diester salts, Igepon T, and sulfonic acid salts of aromatic ring-containing compounds. Examples of the alkyl benzene sulfonates include dodecyl benzene sulfonic acid sodium salt. Examples of the alkyl naphthalene sulfonates include dodecyl naphthalene sulfonic acid sodium salt. Examples of the sulfosuccinic acid diester salts include sulfosuccinic acid di-2-ethylhexyl ester sodium salt. Examples of the sulfonic acid salts of the aromatic ring-containing compounds include monosulfonic or disulfonic acid salts of alkylated diphenyl ethers, and styrenated phenol sulfones.

The phosphate salts of the anionic surfactants are not particularly limited and may be appropriately selected depending on the intended purpose. Examples thereof include higher alcohol phosphate salts and higher alcohol EO adduct phosphate salts. Examples of the higher alcohol phosphate salts include lauryl alcohol phosphoric acid monoester disodium salt and lauryl alcohol phosphoric acid diester sodium salt. Examples of the higher alcohol EO adduct phosphate salts include oleyl alcohol EO (5 mol) adduct phosphoric acid monoester disodium salt.

—Cationic Surfactant—

The cationic surfactants are not particularly limited and may be appropriately selected depending on the intended purpose. Examples thereof include quaternary ammonium salt surfactants and amine salt surfactants.

The quaternary ammonium salt surfactants can be obtained, for example, by reacting C3-C40 tertiary amines and quaternizing agents (e.g., alkylating agents such as methyl chloride, methyl bromide, ethyl chloride, benzyl chloride and dimethylsulfuric acid, and EO). Examples thereof include lauryltrimethylammonium chloride, didecyldimethylammonium chloride, dioctyldimethylammonium bromide, stearyltrimethylammonium bromide, lauryldimethylbenzylammmonium chloride (benzalkonium chloride), cetylpyridinium chloride, polyoxyethylenetrimethylammonium chloride and stearamideethyldiethylmethylammonium methosulfate.

As the amine salt surfactants, primary to tertiary amine salt surfactants which can be obtained by neutralizing primary to tertiary amines with inorganic acids (e.g. hydrochloric acid, nitric acid, sulfuric acid, hydroiodic acid, phosphoric acid, and perchloric acid) or organic acids (acetic acid, formic acid, oxalic acid, lactic acid, gluconic acid, adipic acid, C2-C24 alkyl phosphoric acid, malic acid and citric acid), are exemplified. Examples of the primary amine salt surfactants include inorganic acid salts or organic acid salts of C8-C40 aliphatic higher amines (e.g. higher amines such as laurylamine, stearylamine, cetylamine, cured beef fat amine and rosin amine), and higher fatty acids (C8-C40, exemplified by stearic acid and oleic acid) of lower amines (C2-C6). Examples of the secondary amine salt surfactants include inorganic acid salts or organic acid salts of EO adduct of C4-C40 aliphatic amines. Examples of the tertiary amine salt surfactants include C4-C40 aliphatic amines (e.g. triethylamine, ethyldimethylamine and N,N,N',N'-tetramethylethylenediamine), EO (2 or more moles) adducts of aliphatic amines (C2-C40), C6-C40 alicyclic amines (e.g. N-methylpyrrolidine, N-methylpiperidine, N-methylhexamethyleneimine, N-methylmorpholine and 1,8-diazabicyclo(5,4,0)-7-undecene), inorganic acid salts or organic acid salts of C5-C30 nitrogen-containing hetero ring aromatic amines (e.g. 4-dimethylainopyridine, N-methylimidazol and 4,4'-dipyridyl), and inorganic acid salts or organic acid salts of tertiary amines such as triethanolamine monostearate and stearamideethyldiethylmethylethanolamine.

—Amphoteric Surfactant—

The amphoteric surfactants are not particularly limited and may be appropriately selected depending on the intended purpose. Examples thereof include carboxylate amphoteric surfactants, sulfate amphoteric surfactants, sulfonate amphoteric surfactants and phosphate amphoteric surfactants.

Examples of the carboxylate amphoteric surfactants include amino acid amphoteric surfactants, betaine amphoteric surfactants and imidazoline amphoteric surfactants.

The amino acid amphoteric surfactants are amphoteric surfactants having amino groups and carboxyl groups in the molecules. Examples thereof include compounds represented by General Formula (4) below.

$$R—NH—(CH_2)_n—COO]_mM \qquad \text{General Formula (4)}$$

In General Formula (4), R denotes a monovalent hydrocarbon group, n denotes 1 or 2, m denotes 1 or 2, M denotes a hydrogen ion, an alkali metal ion, an alkaline earth metal ion, an ammonium cation, an amine cation, an alkanolamine cation or the like.

Examples of amphoteric surfactants represented by General Formula (4) include alkyl (C6-C40) aminopropionic acid amphoteric surfactants (such as sodium stearylaminopropionate and sodium laurylaminopropionate); alkyl (C4-C24) aminoacetic acid amphoteric surfactants (such as sodium laurylaminoacetate).

The betaine amphoteric surfactants are amphoteric surfactants having quaternary ammonium salt-based cations and carboxylic acid-based anions in the molecules. Examples thereof include alkyl (C6-C40) dimethyl betaines (such as betaine stearyldimethylaminoacetate and betaine lauryldimethylaminoacetate), C6-C40 amide betaines (such as coconut oil fatty acid amide propyl betaine), alkyl (C6-C40) dihydroxyalkyl (C6-C40) betaines (such as lauryldihydroxyethyl betaine).

The imidazoline amphoteric surfactants are amphoteric surfactants having imidazoline ring-containing cations and carboxylic acid-based anions. Examples thereof include 2-undecyl-N-carboxymethyl-N-hydroxyethylimidazolinium betaine.

Examples of other amphoteric surfactants include glycine amphoteric surfactants such as sodium lauroyl glycine, sodium lauryl diaminoethyl glycine, lauryl diaminoethyl glycine hydrochloride and dioctyl diaminoethyl glycine hydrochloride, sulfobetaine amphoteric surfactants such as pentadecylsulfotaurine, sulfonate amphoteric surfactants, and phosphate amphoteric surfactants.

—Nonionic Surfactant—

The nonionic surfactants are not particularly limited and may be appropriately selected depending on the intended purpose. Examples thereof include AO-attached nonionic surfactants and polyol nonionic surfactants.

The AO-attached nonionic surfactants can be obtained by directly attaching C2-C20 AO to C8-C40 higher alcohols, C8-C40 higher fatty acids, C8-C40 alkylamines, etc. or reacting polyalkylene glycols (obtained by attaching AO to glycols) with higher fatty acids, etc. or attaching AO to esterified compounds (obtained by reacting polyhydric alcohols with higher fatty acids) or attaching AO to higher fatty acid amides.

Examples of the AO include EO, PO and BO. Preferable among these are EO and combinations of EO and PO (randomly or in the form of blocks). The number of moles of AO attached is preferably in the range of 10 to 50, and it is preferred that EO occupy 50% to 100% of the AO.

The AO-attached nonionic surfactants are not particularly limited and may be appropriately selected depending on the intended purpose. Examples thereof include oxyalkylene alkyl ethers (alkylene: C2-C24, alkyl: C8-C40) (such as octyl alcohol EO adduct (20 mol), lauryl alcohol EO adduct (20 mol), stearyl alcohol EO adduct (10 mol), oleyl alcohol EO adduct (5 mol), and lauryl alcohol EO adduct (10 mol) PO (20 mol) block addition product); polyoxyalkylene higher fatty acid esters (alkylene: C2-C24, higher fatty acid: C8-C40) (such as EO adduct (10 mol) of stearic acid, and EO adduct (10 mol) of lauric acid); polyoxyalkylene polyhydric alcohol higher fatty acid esters (alkylene: C2-C24, polyhydric alcohol: C3-C40, higher fatty acid: C8-C40) (such as lauric acid diester of polyethylene glycol (polymerization degree: 20), and oleic acid diester of polyethylene glycol (polymerization degree: 20)); polyoxyalkylene alkyl phenyl ethers (alkylene: C2-C24, alkyl: C8-C40) (such as nonylphenol EO (4 mol) adduct, nonylphenol EO (8 mol) PO (20 mol) block addition product, octylphenol EO (10 mol) adduct, bisphenol A EO (10 mol) adduct and styrenated phenol EO (20 mol) adduct); polyoxyalkylene alkyl amino ethers (alkylene: C2-C24, alkyl: C8-C40) (such as laurylamine EO (10 mol) adduct and stearylamine EO (10 mol) adduct); and polyoxyalkylene alkanolamides (alkylene: C2-C24, amide (acyl): C8-C24) (such as EO (10 mol) adduct of hydroxyethyl lauric acid amide, and EO (20 mol) adduct of hydroxy propyl oleic acid amide).

The polyol nonionic surfactants are not particularly limited and may be appropriately selected depending on the intended purpose. Examples of the polyol nonionic surfactants include polyhydric alcohol fatty acid esters, polyol fatty acid ester AO adducts, polyol alkyl ethers, and polyol alkyl ether AO adducts. The number of carbon atoms contained in each polyol is 3 to 24, the number of carbon atoms contained in each fatty acid is 8 to 40, and the number of carbon atoms contained in each AO is 2 to 24.

Examples of the polyol fatty acid esters include pentaerythritol monolaurate, pentaerythritol monooleate, sorbitan monolaurate, sorbitan monostearate, sorbitan dilaurate, sorbitan dioleate and sucrose monostearate.

Examples of the polyol fatty acid ester AO adducts include ethylene glycol monooleate EO (10 mol) adduct, ethylene glycol monostearate EO (20 mol) adduct, trimethylolpropane monostearate EO (20 mol) PO (10 mol) random addition product, sorbitan monolaurate EO (10 mol) adduct, sorbitan distearate EO (20 mol) adduct, and sorbitan dilaurate EO (12 mol) PO (24 mol) random addition product.

Examples of the polyol alkyl ethers include pentaerythritol monobutyl ether, pentaerythritol monolauryl ether, sorbitan monomethyl ether, sorbitan monostearyl ether, methyl glycoside and lauryl glycoside.

Examples of the polyol alkyl ether AO adducts include sorbitan monostearyl ether EO (10 mol) adduct, methyl glycoside EO (20 mol) PO (10 mol) random addition product, lauryl glycoside EO (10 mol) addition product, and stearyl glycoside EO (20 mol) PO (20 mol) random addition product.

—Water-Soluble Polymer—

The water-soluble polymers are not particularly limited and may be appropriately selected depending on the intended purpose. Examples of the water-soluble polymers include cellulose compounds (such as methyl cellulose, ethyl cellulose, hydroxyethyl cellulose, ethylhydroxyethyl cellulose, carboxymethyl cellulose, hydroxypropyl cellulose, and saponified products thereof), gelatin, starch, dextrin, gum arabic, chitin, chitosan, polyvinyl alcohol, polyvinylpyrrolidine, polyethylene glycol, polyethylene imine, polyacrylamide, polymers each containing an acrylic acid (salt) (such as sodium polyacrylate, potassium polyacrylate, ammonium polyacrylate, sodium hydroxide partially neutralized product of polyacrylic acid, and sodium acrylate-acrylic acid ester copolymer), sodium hydroxide partially neutralized product of styrene-maleic anhydride copolymer, water-soluble polyurethanes (such as reaction products of polyethylene glycol, polycaprolactone diol, etc. and polyisocyanates).

Further, to improve the flowability, storage stability, developing property, transferring property of the toner, an inorganic fine particle such as hydrophobic silica fine powder may be added and mixed in the toner base particle produced as described above.

For mixing additives, a mixer generally used for powder is used, however, the mixer is preferably equipped with a jacket or the like such that the inside temperature can be adjusted. To change history of load applied to additives, the additives can be added in the mixer in the middle of the mixing or gradually. In this case, the rotation number, rolling rate, time, temperature etc. of the mixer may be changed. In the mixing, first a strong load may be applied to the toner material and then a relatively weak load may be applied, or the load application order may be reversed. For usable mixing equipment, for example, V-type mixer, rocking mixer, LOEDIGE mixer, NAUTA mixer, and HENSCHEL mixer. Next, the mixture is filtered through a screen with a mesh of 250 or more to remove coarse particles and flocculate particle to thereby obtain a toner.

The toner is not particularly limited as to the shape and size, and may be appropriately selected depending on the intended purpose, however, the toner preferably has the following average circularity, volume average particle diameter, ratio of volume average particle diameter to number average particle diameter (volume average particle diameter/number average particle diameter).

The average circularity is a value that the circumferential length of a circle that has an equivalent shape and an equivalent projected area to those of the toner is divided by the circumferential length of an actual particle, and not particularly limited and may be appropriately selected depending on the intended purpose. For example, the average circularity is preferably 0.900 to 0.980 and more preferably 0.950 to 0.975. Note that, a toner containing particles that have an average circularity less than 0.94 at 15% or less is preferable.

When the average circularity is less than 0.900, a high-quality image having satisfiable transferring property and causing no dust may not be obtained, and when more than 0.980, in an image forming system using blade cleaning technique, cleaning defects occur on the photoconductor and the transfer belt in the system, image smear, for example, in a case of formation of an image having a high-image area ratio such as photographic image, a toner forming an untransferred image due to a paper-feeding defect or the like accumulates on the photoconductor remains an untransferred toner thereon, and the untransferred toner may cause background smear on images, or a charging roller etc. that contact-charges the photoconductor is contaminated with the untransferred toner, thereby the toner may not exert its intrinsic chargeability.

The average circularity is measured using a flow particle image analyzer ("FPIA-2100", manufactured by SYSMEX Corp.) and then analyzed using analysis software (FPIA-2100 Data Processing Program for FPIA version 00-10). Specifically, the average circularity is measured as follows. In a 100 mL glass beaker, 0.1 mL to 0.5 mL of 10% by mass of a surfactant (alkylbenzene sulfonate, NEOGEN SC-A, manufactured by Dai-ichi Kogyo Seiyaku Co., Ltd.) is added, 0.1 g to 0.5 g of each toner is added thereto, and the toner is mixed with the surfactant using a micro-spatula. Next, 80 mL of ion exchange water is added thereto. The obtained dispersion liquid is subjected to a dispersion treatment in an ultrasonic dispersing device (manufactured by HONDA ELECTRONICS CO., LTD.) for three minutes. The toner shape and the particle distribution of the dispersion liquid are measured using the FPIA-2100 until a concentration of 5,000/μL to 15,000/μL can be obtained. In this measurement, from the perspective of measurement reproducibility of the average circularity, it is important that the concentration of the dispersion liquid is adjusted to 5,000/μL to 15,000/μL. To obtain the concentration of the dispersion liquid, it is necessary to change conditions of the dispersion liquid, i.e., the amount of the surfactant to be added and the toner amount. The necessary amount of the surfactant differs depending on the hydrophobization of the toner, just as in the measurement of the toner particle diameter described above. When an excessively large amount of the surfactant is added, noise occurs due to bubble, and when an excessively small amount of the surfactant is added, the toner cannot be sufficiently wet, and thus the dispersion is insufficient. Further, the amount added of the toner differs depending on the toner particle diameter. When the toner has a small diameter, it is necessary to reduce the amount added, and when the toner has a large diameter, it is necessary to increase the amount added. When the toner particle diameter is 3 μm to 10 μm, the concentration of the dispersion liquid can be adjusted to 5,000/μL to 15,000/μL by adding 0.1 g to 0.5 g of the toner.

The volume average particle diameter of the toner is not particularly limited and may be appropriately adjusted depending on the intended purpose. For example, it is preferably 3 μm to 10 μm and more preferably 3 μm to 8 μm. When the volume average particle diameter is less than 3 μm, in the case of a two-component developer, the toner fused and adhered on the surface of a carrier in a long time agitation in a developing device, which may degrade the chargeability of the carrier, and when it is more than 10 μm, it is difficult to obtain a high-quality image with high-resolution, and when the toner inflow/outflow is performed in the developer, the toner particle diameter may fluctuate largely.

The ratio of a volume average particle diameter to a number average particle diameter of the toner (volume average particle diameter/number average particle diameter) is preferably 1.00 to 1.25 and more preferably 1.10 to 1.25.

The volume average particle diameter and the ratio of the volume average particle diameter to the number average particle diameter (volume average particle diameter/number average particle diameter) are measured by using a particle size measurement device ("MULTISIZER III" manufactured by Beckman Coulter Co.) with an aperture diameter of 100 μm and then analyzed by using analysis software (Beckman Coulter MULTISIZER 3 VERSION 3.51). Specifically, in a 100 mL glass beaker, 0.5 mL of 10% by mass of a surfactant (alkylbenzene sulfonate, NEOGEN SC-A, manufactured by Dai-ichi Kogyo Seiyaku Co., Ltd.) is added, 0.5 g of each toner is added thereto, and the toner is mixed with the surfactant using a micro-spatula. Next, 80 mL of ion exchange water is added thereto. The obtained dispersion liquid is subjected to a dispersion treatment in an ultrasonic dispersing device (W-113MK-II, manufactured by HONDA ELECTRONICS CO., LTD.) for ten minutes. The volume average particle diameter and the ratio of the volume average particle diameter to the number average particle diameter are measured using the MULTISIZER III with the use of ISOTON III as a solution for measurement. The toner sample dispersion liquid is added dropwise in the device such that the concentration indicated by the device becomes 8%±2%. In this measurement, from the perspective of measurement reproducibility of particle diameter, it is important that the concentration of the toner sample dispersion liquid is adjusted to 8%±2%. Within this concentration range, no error occurs.

(Developer)

The developer of the present invention contains the toner of the present invention, and may further contain other components such as a carrier. The developer may be, for example, a one-component developer containing only a toner, or a two-component developer containing a toner and a carrier. When used in, for example, high-speed printers which respond to increase in the recent information processing speed, it is preferably used as a two-component developer from the viewpoint of elongating its service life.

When the developer is as a one-component developer using the toner described above, the developer of the present invention involves less change in diameter of each toner particle even after repetitive cycles of consumption and addition thereof, which prevents toner filming on a developing roller and toner adhesion on a layer thickness regulating member such as a blade for forming a thin toner layer. Thus, even when used (stirred) in a developing device for a long period of time, the developer maintains stable, excellent developability. Also, when the developer is a two-component developer using the toner described above, the developer of the present invention involves less change in diameter of each toner particle in the developer even after long-term repetitive cycles of consumption and addition thereof. Thus, even when stirred in a developing device for a long period of time, the developer maintains stable, excellent developability.

—Carrier—

The carrier is not particularly limited and may be appropriately selected depending on the intended purpose. It preferably has a core and a resin layer covering the core (coating layer).

—Core Material—

The core material is not particularly limited and may be appropriately selected depending on the intended purpose, as long as the particle has magnetism. Examples thereof include ferrite, magnetite, iron, and nickel. In consideration of environmental aspects that have become remarkably advanced, for example, Mn ferrite, Mn—Mg ferrite, Mn—Sr ferrite, Mn—Mg—Sr ferrite, Li-ferrite and the like are preferably used, not using conventional copper-zinc ferrite.

Also, for the purposes of, for example, controlling resistivity of the core material and improving production stability, one or more other elements (e.g., Li, Na, K, Ca, Ba, Y, Ti, Zr, V, Ag, Ni, Cu, Zn, Al, Sn, Sb and Bi) may be incorporated into the core material. The amount thereof is preferably 5 at. % or lower, 3 at. % or lower, with respect to the total amount of metallic elements.

—Coating Layer—

The coating layer contains at least a binder resin, and may further contains other components aminosilane coupling agent, fine particles and the like, as necessary.

The binder resin for forming a coating layer of a carrier is not particularly limited and can be appropriately selected from known resin depending on the intended purpose. Examples thereof include crosslinkable copolymers including polyolefine (for example, polyethylene, polypropylene), modification thereof, styrene, acrylic resin, acrylonitrile, vinyl acetate, vinyl alcohol, vinyl chloride, vinyl carbazole, vinyl ether; silicone resins or modified product thereof having organosiloxane binding (for example, modified products of alkyd resins, polyester resins, epoxy resins, polyurethanes, polyimides); polyamide; polyester; polyurethane, polycarbonate, urea resins, melamine resins, benzoguanamine resins, epoxy resins, ionomer resins; polyimide resin, and the derivatives thereof. These may be used alone or in combination. Among these, acrylic resins and silicone resins are particularly preferable.

The acrylic resin has low brittleness and firmly adheres to both a core material and fine particles contained in the coating layer. Thus, the acrylic resin can successfully prevent detachment of the coating layer, and can keep the coating layer stable. In addition, it allows particles contained in the coating layer (e.g., conductive particles) to be firmly retained therein. Particularly, the acrylic resin strongly exhibits effect on retaining particles having larger size than the thickness of the coating layer.

The acrylic resin preferably has a glass transition temperature (Tg) of 20° C. to 100° C., more preferably 25° C. to 80° C. The acrylic resin having a glass transition temperature (Tg) falling within this range has an appropriate elasticity. Thus, supposedly, impact applied on the carrier is reduced during frictionally charging of a developer, preventing detachment and abrasion of the coating layer.

As the binder resin for forming the coating layer is more preferably a crosslinked product formed between the acrylic resin and the amino resin has an appropriate elasticity and can be prevented from fusion (so-called blocking), which is often caused between resin particles when an acrylic resin is used alone.

As the amino resin, known amino resins may be used. In particular, guanamine and melamine are preferably used, from the viewpoint of improvement of charge application ability of a carrier.

When the charge application ability of the carrier is required to be more appropriately controlled, at least one of guanamine and melamine may be used in combination with another amino resin. The acrylic resin crosslinkable with the amino resin may be those having a hydroxyl group and/or carboxyl group. More preferred are those having a hydroxyl group. By having a hydroxyl group, adhesiveness between the core material and fine particles can be improved, and dispersion stability of fine particles can be improved. The hydroxyl value thereof is preferably 10 mgKOH/g or more, more preferably 20 mgKOH/g or more.

Moreover, the binder resin contains silicone portion as a structural unit, so that surface energy itself of a carrier surface can be decreased, thereby preventing occurrence of toner spent. Thus, carrier properties can be maintained for much longer period of time.

As the structural unit of the silicone portion, at least one of a methyltrisiloxane unit, a dimethyldisiloxane unit, and a trimethylsiloxane unit is preferably contained. The silicone portion may be chemically bound or mixed with resins in the other coat layer, or formed in a multiple layer.

When the silicone portion has the mixed or multilayer structure, the binder resin preferably contains a silicone resin and/or a modified silicone resin. From the viewpoint of preventing wear, abrasion, and desorption specific to the silicone resin or other resins, it is particularly preferred that the binder resin contain a silicone resin composition having the structural unit represented by Formula (5).

Formula (5)

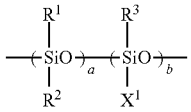

where $R^1$ to $R^3$ may be the same to or different from each other, a hydrocarbon group and/or a derivative thereof; $X^1$ denotes a condensation reaction group; and "a" and "b" each denotes an integer.

The condensation reaction group is a group that can initiate a condensation reaction with assistance of moisture in the atmosphere or heat to thereby form a three-dimensional mesh structure. Examples of the condensation reaction group $X^1$ include a hydroxyl group, an alkoxy group, and a methyl ethyl ketoxime group. Examples of the silicone resin include straight silicone resins formed of only organosiloxane bond having the structural unit represented by Formula (5); and silicone resins modified with alkyd, polyester, epoxy, acrylic, urethane or the like.

Examples of the straight silicone resins include KR271, KR272, KR282, KR252, KR255, and KR152 manufactured by Shin-Etsu Chemical Co., Ltd.; and SR2400, SR2405, SR2406 manufactured by TORAY Dow Corning Silicone Co., Ltd. Examples of the modified silicone resins include ES1001N (epoxy-modified), KR5208 (acryl-modified), KR-5203 (polyester-modified), KR206 (alkyd-modified), and KR305 (urethane-modified) produced by Shin-Etsu Chemical Co., Ltd.; and SR2115 (epoxy-modified); and SR2110 (alkyd-modified) produced by TORAY Dow Corning Silicone Co., Ltd.

The silicone resin can also be used as a monomer and can also be used together with the crosslinkable components or charge amount controlling components and the like. Examples of the crosslinkable components include silane coupling agents. Examples of the silane coupling agents include methyl trimethoxy silane coupling agents, methyl triethoxy silane coupling agents, octyl trimethoxy silane coupling agents and aminosilane coupling agents.

—Aminosilane Coupling Agent—

The coating layer may further contain an aminosilane coupling agent, as necessary. The aminosilane coupling agent is contained in the coating layer, so that the charging amount of a carrier can be suitably controlled with respect to a toner. As the aminosilane coupling agents, compounds represented by the following formula (6) are preferable.

$H_2N(CH_2)_3Si(OCH_3)_3$ MW 179.3

$H_2N(CH_2)_3Si(OC_2H_5)_3$ MW 221.4

$H_2NCH_2CH_2CH_2Si(CH_3)_2(OC_2H_5)$ MW 161.3

$H_2NCH_2CH_2CH_2Si(CH_3)(OC_2H_5)_2$ MW 191.3

$H_2NCH_2CH_2NHCH_2Si(OCH_3)_3$ MW 194.3

$H_2NCH_2CH_2NHCH_2CH_2CH_2Si(CH_3)(OCH_3)_2$ MW 206.4

$H_2NCH_2CH_2NHCH_2CH_2CH_2Si(OCH_3)_3$ MW 224.4

$(CH_3)_2NCH_2CH_2CH_2Si(CH_3)(OC_2H_5)_2$ MW 219.4

$(C_4H_9)_2NC_3H_6Si(OCH_3)_3$ MW 291.6 Formula (6)

The content of the aminosilane coupling agent is preferably 0.001% by mass to 30% by mass and more preferably 0.001% by mass to 10% by mass in the total coating layer. When the content is less than 0.001% by mass, the chargeability of the formed coating layer tends to be affected by environmental factors. In addition, production yield is likely to decrease. When the content is more than 30% by mass, the formed coating layer easily becomes brittle, potentially degrading abrasion resistance of the coating layer.

—Fine Particle—

A fine particle may be added to the coating layer as necessary. The fine particle is not particularly limited and may be appropriately selected from known materials. Examples thereof include the inorganic fine particle, such as metal powder, tin oxide, zinc oxide, silica, titania, alumina, potassium titanate, barium titanate, and aluminum borate; conductive polymers such as polyaniline, polyacetylene, polyparaphenylene, poly(paraphenylene sulfide), polypyrrole, parylene, organic fine particle such as carbon black. These may be used alone or in combination.

Further, the surface of the fine particles may be treated so as to have conductivity. As a method of conductivity treatment, for example, a fine particle surface is coated with aluminum, zinc, copper, nickel, silver, or alloys thereof, zinc oxide, titanium oxide, tin oxide, antimony oxide, indium oxide, bismuth oxide, indium oxide doped with tin, tin oxide doped with antimony, zirconium oxide, or the like, in a form of a solid solution or fused form. Among these, tin oxide, indium oxide, indium oxide doped with tin are preferably used for the method of conductivity treatment.

The volume average particle diameter of the fine particles is preferably 1 μm or less. When the volume average particle diameter is larger than 1 μm, it may be difficult to maintain the fine particles in the coating layer, and the strength of the coating layer may be decreased due to the desorption of the fine particles.

The volume average particle diameter of the fine particles may be measured, for example, using a laser doppler device/dynamic light scattering type particle size distribution device.

The amount of the coating layer in the carrier is preferably 5% by mass or more, more preferably 5% by mass to 10% by mass.

The thickness of the coating layer is preferably 0.1 μm to 5 μm, more preferably 0.3 μm to 2 μm.

The thickness of the coating layer can be determined as follows: a carrier is cut with a focused ion beam (FIB), and the thus-formed cross-section surface of the carrier is measured for layer thicknesses at 50 sites or more through transmission electron microscopy (TEM) and scanning transmission electron microscopy (STEM); and the thus-obtained values are averaged.

—Method for Forming Coating Layer of Carrier—

The method for forming a coating layer of carrier is not particularly limited and may be appropriately selected from known layer forming method. For example, a coating layer-forming liquid (coating liquid) in which the raw materials for the coating layer, such as the binder resin or binder resin precursor, is applied onto a surface of a core material by a spraying method, a dipping method, etc. It is preferred that the coating layer-forming liquid is applied onto a surface of a core material, followed by heating a carrier on which a coating layer is formed to allow polymerization reaction of the binder resin or binder resin precursor to proceed in the coating layer. This heating treatment may be carried out in the same coating apparatus as has been used for forming the coating layer; or may be carried out subsequent to coating layer formation using a separately provided heating unit (e.g., a commonly-used electric furnace and a firing kiln).

The heating temperature varies with the type of components for forming the coating layer and is preferably about 120° C. to about 350° C. In particular, the heating temperature is preferably lower than a temperature at which the coating layer component is decomposed. The decomposition temperature of the coating layer component is about 220° C. as the upper limit temperature. The heating time is preferably about 5 min to about 120 min.

—Physical Properties of Carrier—

The volume average particle diameter of the carrier is preferably 10 μm to 100 μm, and more preferably 20 μm to 65 μm.

When the volume average particle diameter of the carrier is smaller than 10 μm, uniformity of the core particles is decreased, possibly causing carrier adhesion; whereas when the volume average particle diameter is larger than 100 μm, reproducibility in fine image portions is poor, possibly failing to obtain a high-definition image.

The measuring method of the volume average particle diameter of the carrier is not particularly limited, and can be appropriately selected depending on the intended purpose, as long as the particle size distribution thereof can be measured. For example, the volume average particle diameter can be measured with the Microtrack particle size analyzer (model HRA9320-X100, manufactured by NIKKISO CO., LTD.).

The volume resistivity of the carrier is preferably 9 Log (Ω·cm) to 16 Log (Ω·cm), more preferably 10 Log (Ω·cm) to 14 Log (Ω·cm).

When the volume resistivity is lower than 9 Log (Ω·cm), carrier adhesion occurs on a non-image portion; whereas when the volume resistivity is higher than 16 Log (Ω·cm), the image density of an image obtained after development becomes high at the edge portions: so-called edge effect is considerably observed. If necessary, the volume resistivity can be controlled within the above range by adjusting the thickness of the coating layer and/or the conductive fine particles content thereof.

Here, the volume resistivity can be determined as follows. Specifically, carrier particles are charged into a fluorine-resin cell having 2.5 cm×4 cm two electrodes which are disposed 0.2 cm apart; the cell is tapped under the following conditions: fall height: 1 cm, tapping speed: 30 times/min, and the number of tappings: 10; a DC voltage of 1,000V is applied between the electrodes; a resistivity obtained after 30 sec from application of the DC voltage is measured with the high resistance meter 4329A (product of Yokokawa-HEWLETT-PACKARD); and a volume resistivity R Log(Ω·cm) is calculated from the obtained resistivity (r) using the following Equation (7).

$$R=\text{Log}\,[r\times(2.5\text{ cm}\times4\text{ cm})/0.2\text{ cm}] \qquad \text{Equation (7)}$$

In the case where the developer is a two-component developer, an amount of the toner in the two-component developer is preferably 2.0% by mass to 12.0% by mass, more preferably 2.5% by mass to 10.0% by mass, with respect to the developer.

(Developer Container)

The developer of the present invention may be housed in a container for use.

The container is not particularly limited and may be appropriately selected from known developer containers. For example, a developer container having a developer container main body and a cap is preferably exemplified.

The developer container is not particularly limited as to the size, shape, structure, material and the like and may be appropriately selected depending on the intended purpose. For example, as to the shape, a cylindrical shape is preferable. As to the structure, a container is particularly preferable in which a continuous spiral convexoconcave is formed on the inner surface, a developer contained in the container can be moved toward the outlet by rotating the developer container and a part of the spiral portion or the whole thereof has an accordion function.

Material of the developer container main body is not particularly limited and may be appropriately selected depending on the intended purpose. A material that is formable with excellent dimensional precision is preferable. Preferred examples thereof include resins. Among resins, for example, polyester resins, polyethylene resins, polypropylene resins, polystyrene resins, polyvinyl chloride resins, polyacrylic resins, polycarbonate resins, ABS resins, polyacetal resins and the like are preferably exemplified.

The developer container has excellent handleability; i.e., is suitable for storage, transportation, etc. and is suitably used for supply of a developer with being detachably mounted to the image forming apparatus described below, etc.

(Image Forming Method and Image Forming Apparatus)

An image forming method of the present invention includes a latent electrostatic image forming step, a developing step, a transferring step, a fixing step and other steps such as discharging, cleaning, recycling, controlling, as necessary.

An image forming apparatus of the present invention includes a latent electrostatic image bearing member, a latent electrostatic image forming unit, a developing unit, a transferring unit, a fixing unit and other units such as a charge eliminating unit, a cleaning unit, a recycling unit and a controlling unit as necessary.

—Latent Electrostatic Image Forming Step and Latent Electrostatic Image Forming Unit—

The step of forming a latent electrostatic image is one that forms a latent electrostatic image on the latent electrostatic image bearing member. Materials, shapes, structures or sizes, etc. of the latent electrostatic image bearing member (sometimes referred to as "electrophotographic photoconductor", or "photoconductor") may be selected appropriately from known ones and the latent electrostatic image bearing member is preferably of a drum shape. The materials for the latent electrostatic image bearing member are inorganic materials for inorganic photoconductor such as amorphous silicon and selenium, and organic materials for organic photoconductor (OPC) such as polysilane and phthalopolymethine, for example. Among these materials, amorphous silicon is preferred by virtue of longer operating life.

A latent electrostatic image may be formed, for example, by uniformly charging a surface of the latent electrostatic image bearing member, and irradiating imagewisely, which may be performed in the latent electrostatic image forming unit.

The latent electrostatic image forming unit includes at least a charger which uniformly charges the surface of the latent electrostatic image bearing member, and an exposure unit which exposes the surface of the latent electrostatic image bearing member imagewise.

The charging may be performed, for example, by applying a voltage to the surface of the latent electrostatic image bearing member using the charger.

The charger is not particularly limited and may be appropriately selected depending on the intended purpose; examples thereof include known contact chargers equipped with conductive or semi-conductive roller, brush, film or rubber blade and non-contact chargers using corona discharges such as corotron and scorotron.

It is preferable that the chargers be placed in contact with or not in contact with the latent electrostatic image bearing member and that a direct and alternating voltages are superimposed and applied to charge the surface of the latent electrostatic image bearing member.

Further, it is preferable that the chargers be a charge roller which is allocated near but without contacting the latent electrostatic image bearing member through a gap tape and that the direct and alternating voltages are superimposed and applied to charge the surface of the latent electrostatic image bearing member.

Exposures may be performed by exposing the surface of the latent electrostatic image bearing member imagewise using the exposure unit, for example.

The exposure unit is not particularly limited and may be appropriately selected depending on the intended purpose as long as capable of exposing imagewise on the surface of the latent electrostatic image bearing member charged by the charger. Examples of the exposure unit include copying optical systems, rod lens array systems, laser optical systems and liquid crystal shutter optical systems.

In the present invention, the back-exposure method may be adopted in which the latent electrostatic image bearing member is exposed imagewise from the back side.

—Developing Step and Developing Unit—

The developing step is one where a latent electrostatic image is developed using the toner or developer of the present invention to form a visible image.

The visible image may be formed, for example, by developing a latent electrostatic image using the toner or developer, which may be performed by the developing unit.

The developing unit is not particularly limited and may be appropriately selected from known developing units as long as it can develop an image by using the toner or developer. For example, a preferable developing unit contains the developer of the present invention and includes a developing device which can impart the developer in a contact or non-contact manner to a latent electrostatic image.

The developing device may also be of monochrome or multi-color. As a preferable example, the developing device has an agitator that frictions and agitates the developer for charging and a rotatable magnet roller.

In the developing device, the toner and the carrier may, for example, be mixed and stirred together. The toner is charged by friction, and forms a magnetic brush on the surface of the rotating magnet roller. Since the magnet roller is arranged near the latent electrostatic image bearing member (photoconductor), a part of the toner constructing the magnetic brush formed on the surface of the magnet roller is moved toward the surface of the latent electrostatic image bearing member (photoconductor) due to the force of electrical attraction. As a result, the latent electrostatic image is developed by the use of toner, and a visible toner image is formed on the surface of the latent electrostatic image bearing member (photoconductor).

The developer contained in the developing device is the developer of the present invention.

—Transferring Step and Transferring Unit—

The transferring step is one transferring the visible image to a recording medium. It is preferred that the transferring step is carried out in such a way that the visible image is primary-transferred on an intermediate transfer medium, then the visible image is secondary-transferred from the intermediate transfer medium to the recording medium; it is more preferred that toners of two or more colors, preferably full-color toners are employed, and the transferring step is carried out by way of the first transfer step in which visual image is transferred on the intermediate transfer medium to form a composite transferred image and the second transfer step in which the composite transferred image is transferred to the recording medium.

The transfer of the visible image may be performed by charging the latent electrostatic image bearing member (photoconductor) using a transfer-charging device, which may be performed by the transferring unit. The transferring unit preferably includes a primary transferring unit that transfers the visible image to an intermediate transfer medium to form a composite transferred image and a secondary transferring unit that transfers the composite transferred image to the recording medium.

The intermediate transfer medium is not particularly limited and may be appropriately selected depending on the intended purpose from known transfer members; preferable examples include a transfer belt.

The transferring unit (primary transferring unit and secondary transferring unit) preferably includes at least a transferring device that strips and charges the visible image formed on the latent electrostatic image bearing member (photoconductor) to the side of the recording medium. One or two or more of the transferring unit(s) may be provided.

Examples of the transferring device include corona transferring devices on the basis of corona discharge, transfer belts, transfer rollers, pressure transfer rollers and adhesive transferring devices.

Also, the recording medium is not particularly limited and may be selected appropriately from known recording media (recording paper).

—Fixing Step and Fixing Unit—

The fixing step is one that fixes the visible image transferred to the recording medium using a fixing unit. The fixing may be carried out for each color upon transferred onto the recording medium, or simultaneously after all colors are laminated.

The fixing unit is not particularly limited and may be appropriately selected from known heating and pressing units depending on the intended purpose; examples thereof include combinations of heating rollers and pressing rollers, and combinations of heating rollers, pressing rollers, and endless belts.

The fixing unit is preferably a heat fixing unit which includes a heat application member having a heater, a film contacting the heart application member, and a pressure application member for pressure contacting the heat application member through the film and fixes an unfixed image on a recording medium while the recording medium is passed between the film and pressure application member. The heating temperature in the heating and pressing units is preferably 80° C. to 200° C.

In addition, in the present invention, known optical fixing units may be used along with or in place of the fixing step and fixing unit, depending on the intended purpose.

—Charge Eliminating Step and Charge Eliminating Unit—

The charge eliminating step is one that applies a discharge bias to the latent electrostatic image bearing member, which may be performed by a charge-eliminating unit.

The charge-eliminating unit is not particularly limited and may be appropriately selected from known ones as long as it can apply a discharge bias to the latent electrostatic image bearing member; examples thereof include charge eliminating lamps.

—Cleaning Step and Cleaning Unit—

The cleaning step is one in which residual toner on the latent electrostatic image bearing member is removed, which may be performed by a cleaning unit.

The cleaning unit is not particularly limited and may be appropriately selected from known ones as long as capable of removing residual toners on the latent electrostatic image bearing member; examples thereof include magnetic brush cleaners, electrostatic brush cleaners, magnetic roller cleaners, blade cleaners, brush cleaners, and web cleaners.

—Recycling Step and Recycling Unit—

The recycling step is one in which the toner, which has been removed in the cleaning step, is recycled for use in the developing unit, which may be performed by a recycling unit.

The recycling unit is not particularly limited and may be suitably constructed from known transport units.

The controlling step is one in which the respective steps are controlled, which may be carried out by the controlling unit.

The controlling unit is not particularly limited and may be appropriately selected depending on the intended purpose as long as capable of controlling the performance of each unit. Examples thereof include instruments such as sequencers and computers.

An embodiment of the image forming apparatus used in the present invention will be described with reference to FIG. 1. An image forming apparatus 100A is equipped with a photoconductor drum 10 (hereafter referred to as "photoconductor 10") as the latent electrostatic latent electrostatic image bearing member, a charge roller 20 as the charging unit, an exposure device (not shown) as the exposure unit, a developing device 40 as the developing unit, an intermediate transfer belt 50 as the intermediate transfer medium, a cleaning device 60 as the cleaning unit having a cleaning blade, and a charge eliminating lamp 70 as a charge-eliminating unit.

The intermediate transfer belt 50 is an endless belt being stretched around three rollers 51 placed inside the belt and designed to be movable in arrow direction. A part of the three rollers 51 function as a transfer bias roller capable of applying a transfer bias (primary transfer bias), to the intermediate transfer belt 50. A cleaning blade 90 is placed near the intermediate transfer belt 50. A transfer roller 80, as a transferring unit capable of applying a transfer bias (secondary transfer bias) for transferring a visible image (toner image) onto a transfer paper 95, is placed face to face with the intermediate transfer belt 50. In the surrounding area of the intermediate transfer belt 50, a corona charger 58 for supplying an electrical charge to the visible image on the intermediate transfer belt 50 is placed between contact area of the photoconductor 10 and the intermediate transfer belt 50, and contact area of the intermediate transfer belt 50 and transfer paper 95 in the rotational direction of the intermediate transfer belt 50.

The developing device 40 is constituted with a developing belt 41, a black developing unit 45K, yellow developing unit 45Y, magenta developing unit 45M and cyan developing unit 45C disposed, together in the surrounding area of developing belt 41. The developing unit 45K of each color is equipped with a developer container 42, a developer feeding roller 43, and a developing roller 44. The developing belt 41 is an endless belt and is extended around several belt rollers and rotatable in an arrow direction in FIG. 1, and the part of developing belt 41 is in contact with the photoconductor 10.

Next, a method for forming an image using the image forming apparatus 100A will be explained. Firstly, a surface of the photoconductor 10 is uniformly charged using the charging roller 20, and exposure light L is exposed to the photoconductor 10 using the exposure device (not shown) to form a latent electrostatic image. Next, a latent electrostatic image formed on the photoconductor 10 is then developed with the toner fed from the developing device 40 to form a visible image (toner image). The visible image (toner image) formed on the photoconductor 10 is primarily transferred onto the intermediate transfer belt 50 by a voltage applied from the roller 51, and then secondarily transferred onto the transfer paper 95 (secondary transfer) by a transfer bias applied from the transfer roller 80. After the toner image is transferred from the photoconductor 10 to the intermediate transfer belt 50, the residual toner on the photoconductor 10 is removed by the cleaning unit 60 and the charge built up over the photoconductor 10 is temporarily removed by the charge eliminating lamp 70.

Figure 2:
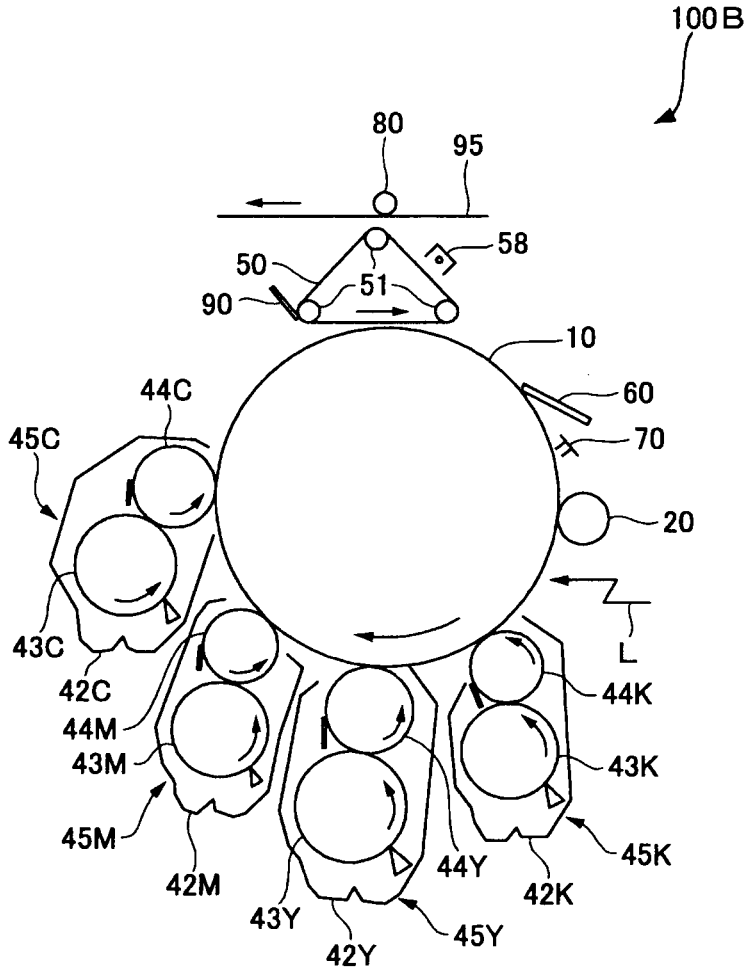
FIG. 2 is a schematic explanatory view showing another example of performing the image forming method of the present invention using an image forming apparatus.

Another embodiment of the image forming apparatus used in the present invention will be described with reference to FIG. 2. An image forming apparatus 100B has the same construction as the image forming apparatus 100A shown in FIG. 1, except that the developing belt 41 is not equipped and the black developing unit 45K, the yellow developing unit 45Y, the magenta developing unit 45M and the cyan developing unit 45C are placed in the surrounding area of the photoconductor 10 with directly facing the photoconductor 10.

Figure 3:
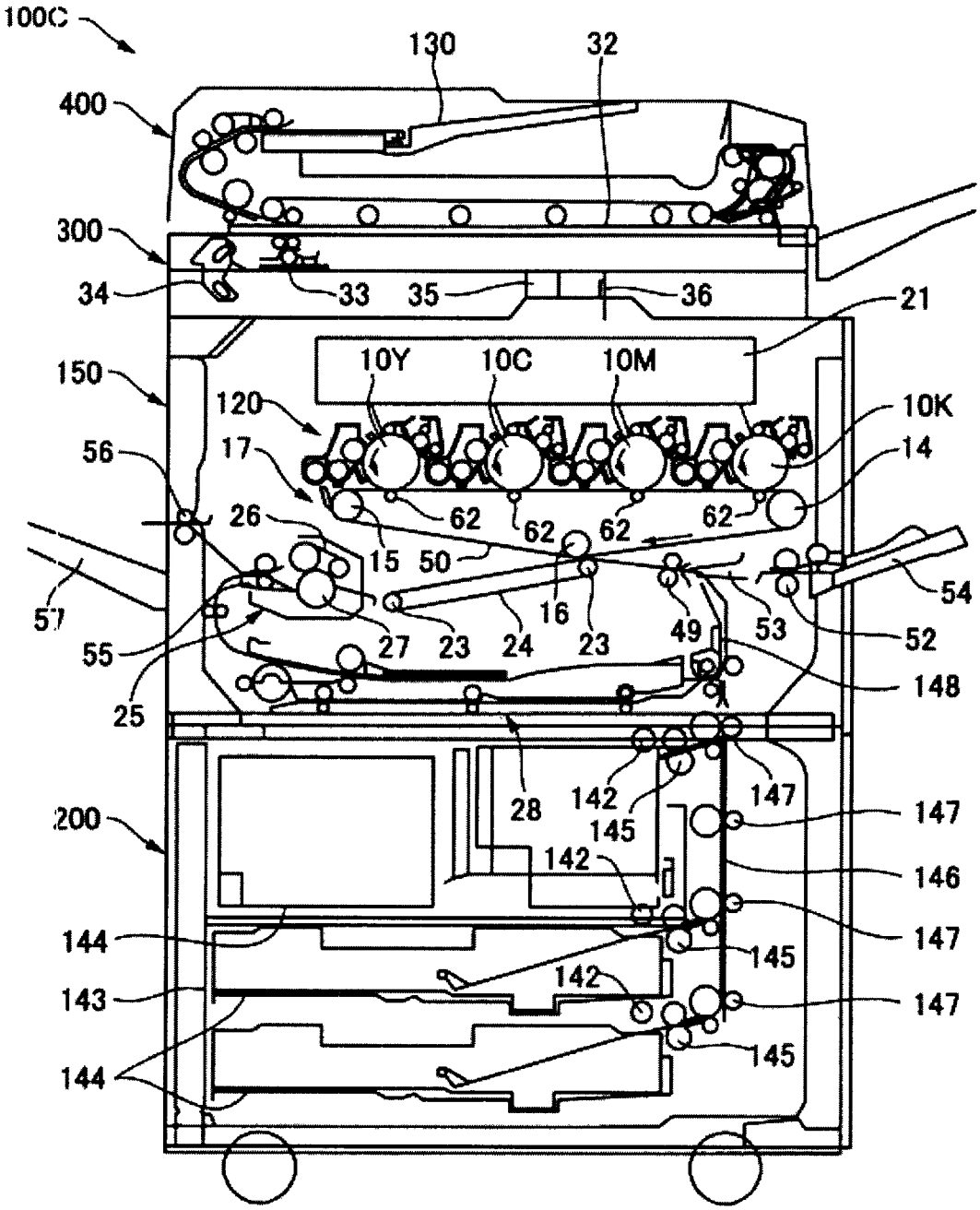
FIG. 3 is a schematic explanatory view showing an example of performing an image forming method of the present invention using an image forming apparatus (tandem color image forming apparatus).

Still another embodiment of the image forming apparatuses will be described with reference to FIG. 3. An image forming apparatus 100C is a tandem color-image forming apparatus, and includes a copying machine main body 150, a paper feeder table 200, a scanner 300, and an automatic document feeder (ADF) 400.

The copying machine main body 150 includes an endless intermediate transfer belt 50. The intermediate transfer belt 50 is stretched around three rollers 14, 15, and 16 and is configured to rotate in a clockwise direction in FIG. 3. Adjacent to the roller 15, there is disposed a cleaning unit 17 having a cleaning blade for removing a residual toner on the intermediate transfer belt 50, after a toner image is transferred onto a recording paper. Four image forming units 120Y (yellow), 120C (cyan), 120M (magenta) and 120K (black) are arrayed in parallel in a conveyance direction of the intermediate transfer belt 50, while four image forming units face the intermediate transfer belt 50 stretched around the rollers 14 and 15. There is also disposed an exposing device 21 adjacent to the image forming units 120Y, 120C, 120M and 120K. A secondary transferring belt 24 is disposed on the opposite side of the intermediate transfer member 50 to where the image forming units 120Y, 120C, 120M and 120K are disposed. The secondary transferring belt 24 is of an endless belt, which is stretched around a pair of rollers 23. The secondary transferring belt 24 is configured so that the recording paper (transfer sheet), which is conveyed on the secondary transferring belt 24, comes into contact with the intermediate transfer belt 50 between the roller 16 and the roller 23. Near the secondary transferring belt 24, the fixing device 25 is provided and includes a fixing belt 26 which is an endless belt and stretched around a pair of rollers, and a pressurizing roller 27 which is disposed so as to contact against the fixing belt 26. Near the secondary transferring belt 24 and the fixing device 25, a sheet reverser 28 reversing the recording paper for forming images on both sides of the paper is located.

A method of forming a full-color image will be described using the image forming apparatus 100C. Initially, a color document is placed on a document platen 130 of the automatic document feeder (ADF) 400. Alternatively, the automatic document feeder 400 is opened, a color document is placed on a contact glass 32 of the scanner 300, and the automatic document feeder 400 is closed to press the document. At the time of pushing a start switch (not shown), the document placed on the automatic document feeder 400 is transported onto the contact glass 32. In the case where the document is initially placed on the contact glass 32, the scanner 300 is immediately driven to operate a first carriage 33 equipped with a light source and a second carriage 34 equipped with a mirror. Light is applied from a light source of the first carriage 33 to the document, and reflected light from the document is further reflected at the second carriage 34. The reflected light is further reflected by a mirror of the second carriage 34 and passes through an image forming lens 35 into a read sensor 36 to thereby read the color document. The read color image is interpreted to image information of black, yellow, magenta and cyan.

Figure 4:
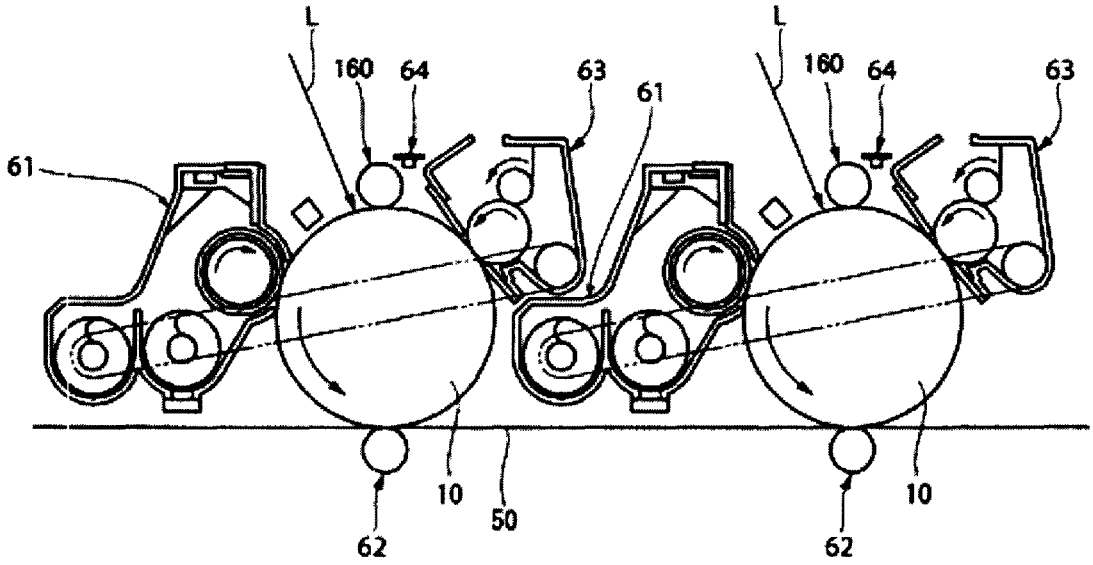
FIG. 4 is a schematic enlarged view of a part of the image forming apparatus shown in FIG. 3.

Image information of each color is transmitted to each of image forming units 120 for respective colors, and toner images of respective colors are formed. With respect to each of the image forming units 120 as shown in FIG. 4, there are disposed a photoconductor 10 (a photoconductor for black 10K, a photoconductor for yellow 10Y, a photoconductor for magenta 10M, or a photoconductor for cyan 10C in FIG. 3), a charging roller 160 which uniformly charges the photoconductor 10, an exposing device which irradiate the photoconductor 10 with exposure light L based on each color image information to thereby form a latent electrostatic image corresponding to each color image on the photoconductor 10, an developing device 61 which develops the latent electrostatic image using a developer corresponding to each color to form a toner image of each color, a transfer roller 62 for transferring the toner image onto the intermediate transfer belt 50, a cleaning device 63 having a cleaning blade, and a charge eliminating lamp 64.

Accordingly, each mono-color images (a black image, a yellow image, a magenta image, and a cyan image) formed by each image forming unit 120 are sequentially transferred (primary transfer) onto the intermediate transfer belt 50 which is stretched around the rollers 14, 15 and 16 and rotated by means of the rollers 14, 15 and 16, and then superimposed thereon to form a composite color image.

One of feeding rollers 142 of the feeder table 200 is selectively rotated, recording paper is ejected from one of multiple feeder cassettes 144 in a paper bank 143 and are separated by a separation roller 145 one by one into a feeder path 146, are transported by a transport roller 147 into a feeder path 148 in the copying machine main body 150 and are bumped against a registration roller 49. Alternatively, one of the feeding rollers 142 is rotated to eject recording paper from a manual-feeding tray 54, and the recording paper is separated by a separation roller 52 one by one into a feeder path 53, transported one by one and then bumped against the registration roller 49. Note that, the resist roller 49 is generally earthed, but it may be biased for removing paper dust of the recording paper. The registration roller 49 is rotated synchronously with the movement of the composite color image on the intermediate transfer belt 50 to transport the recording paper into between the intermediate transfer belt 50 and the secondary transferring belt 24, and the composite toner image is transferred (secondary transferred) onto the recording paper. After transferring the composite toner image, the residual toner or the intermediate transfer belt 50 is cleaned by means of the cleaning unit 17.

The recording paper onto which the composite toner image has been transferred is transported by the secondary transferring belt 24, and then the composite toner image is fixed onto the recording paper by the fixing device 25. Thereafter, the recording paper changes its direction by action of a switch blade 55, is ejected by an ejecting roller 56 and is stacked on an output tray 57. Alternatively, the recording paper is changed its direction by action of the switch blade 55, and reversed by the sheet reverser 28, and subjected to an image formation on the back surface thereof. The recording paper bearing images on both sides thereof is then ejected with assistance of the ejecting roller 56, and is stacked on the output tray 57.

The image forming method of the present invention uses the toner of the present invention, so that high quality images having stability against variations in use conditions such as temperature, humidity, etc. can be provided for a long period.

EXAMPLES

Hereinafter, the present invention will be described with reference to Examples, which shall not be construed as limiting the scope of the present invention. In the descriptions in the following examples, "part(s)" and "%" respectively mean "part(s) by mass" and "% by mass".

Production Example 1

<Production of Amorphous Polyester Resin (a-1)>

| | |
|---|---|
| L-lactide | 70 parts |
| D-lactide | 30 parts |
| ϵ-caprolactone | 5 parts |
| Tin 2-ethylhexylate | 0.03 parts |

In an autoclave reaction vessel equipped with a thermometer, a stirrer and a nitrogen inlet tube, the above-listed raw materials were charged, and subjected to a ring-opening polymerization reaction at 190° C. in a nitrogen atmosphere for 1 hour. Thereafter, residual lactides were removed from the reaction product at a reduced pressure, to thereby obtain an amorphous polyester resin (a-1) having a polyhydroxycarboxylic acid skeleton. The amorphous polyester resin (a-1) had a number average molecular weight of 9,200, a weight average molecular weight of 37 000, and an optical purity of 40%.

Production Example 2

<Production of Amorphous Polyester Resin (a-2)>

| | |
|---|---|
| L-lactide | 70 parts |
| Meso-DL-lactide | 60 parts |
| Tin 2-ethylhexylate | 0.05 parts |

In an autoclave reaction vessel equipped with a thermometer, a stirrer and a nitrogen inlet tube, the above-described raw materials were charged, and subjected to a ring-opening polymerization reaction at 180° C. in a nitrogen atmosphere for 2 hours. Thereafter, residual lactides were removed from the reaction product at a reduced pressure, to thereby obtain an amorphous polyester resin (a-2) having a polyhydroxycarboxylic acid skeleton. The amorphous polyester resin (a-2) had a number average molecular weight of 7,500, a weight average molecular weight of 29,000, and an optical purity of 54%.

Production Example 3

<Production of Amorphous Polyester Resin (a-3)>

| | |
|---|---|
| L-lactide | 85 parts |
| Meso-DL-lactide | 25 parts |
| Tin 2-ethylhexylate | 0.04 parts |

In an autoclave reaction vessel equipped with a thermometer, a stirrer and a nitrogen inlet tube, the above-described raw materials were charged, and subjected to a ring-opening polymerization reaction at 180° C. in a nitrogen atmosphere for 2 hours. Thereafter, residual lactides were removed from the reaction product at a reduced pressure, to thereby obtain an amorphous polyester resin (a-3) having a polyhydroxycarboxylic acid skeleton. The amorphous polyester resin (a-3) had a number average molecular weight of 8,800, a weight average molecular weight of 36,000, and an optical purity of 77%.

Production Example 4

<Production of Amorphous Polyester Resin (a-4)>

| | |
|---|---|
| L-lactide | 80 parts |
| Meso-DL-lactide | 20 parts |
| ϵ-caprolactone | 10 parts |
| Tin octylate | 1 part |

In an autoclave reaction vessel equipped with a thermometer, a stirrer and a nitrogen inlet tube, the above-described raw materials other than tin octylate were charged, and heated and melted at a temperature of 120° C. for 20 minutes in a nitrogen atmosphere, and then, 1 part of tin octylate was added thereto, and subjected to a ring-opening polymerization reaction at 190° C. for 3 hours. Thereafter, residual lactides and ϵ-caprolactone were removed from the reaction product at a reduced pressure, to thereby obtain an amorphous polyester resin (a-4) having a polyhydroxycarboxylic acid skeleton. The amorphous polyester resin (a-4) had a number average molecular weight of 7,600, a weight average molecular weight of 26,000, and an optical purity of 60%.

Production Example 5

<Production of Amorphous Polyester Resin (a-5)>

| | |
|---|---|
| L-lactide | 70 parts |
| Meso-DL-lactide | 30 parts |
| ϵ-caprolactone | 5 parts |
| Tin octylate | 1 part |

In an autoclave reaction vessel equipped with a thermometer, a stirrer and a nitrogen inlet tube, the above-described raw materials other than tin octylate were charged, and heated and melted at a temperature of 120° C. for 20 minutes in a nitrogen atmosphere, and then, 1 part of tin octylate was added thereto, and subjected to a ring-opening polymerization reaction at 190° C. for 3 hours. Thereafter, residual lactides and ϵ-caprolactone were removed from the reaction product at a reduced pressure, to thereby obtain an amorphous polyester resin (a-5) having a polyhydroxycarboxylic acid skeleton. The amorphous polyester resin (a-5) had a number average molecular weight of 9,200, a weight average molecular weight of 37,000, and an optical purity of 40%.

Production Example 6

<Production of Amorphous Polyester Resin (a-6)>

| | |
|---|---|
| L-lactide | 92 parts |
| Meso-DL-lactide | 8 parts |
| ϵ-caprolactone | 10 parts |
| Tin octylate | 1 part |

In an autoclave reaction vessel equipped with a thermometer, a stirrer and a nitrogen inlet tube, the above-described raw materials other than tin octylate were charged, and heated and melted at a temperature of 120° C. for 20 minutes under a nitrogen atmosphere, and then, 1 part of tin octylate was added thereto, and subjected to a ring-opening polymerization reaction at 190° C. for 3 hours. Thereafter, residual lactides and ϵ-caprolactone were removed from the reaction product at a reduced pressure, to thereby obtain an amorphous polyester resin (a-6) having a polyhydroxycarboxylic acid skeleton. The amorphous polyester resin (a-6) had a number average molecular weight of 8,200, a weight average molecular weight of 31,000, and an optical purity of 84%.

The components and compositions used for production of the amorphous polyester resins (a-1) to (a-6) are shown in Table 1. Note that the above-described lactides are lactides of lactic acids.

TABLE 1

| Amorphous polyester resin | (a-1) | (a-2) | (a-3) | (a-4) | (a-5) | (a-6) |
|---|---|---|---|---|---|---|
| L-lactide (parts) | 70 | 70 | 85 | 80 | 70 | 92 |
| D-lactide (parts) | 30 | — | — | 20 | 30 | 8 |
| Meso-DL-lactide (parts) | — | 60 | 25 | — | — | — |
| ϵ-caprolactone (parts) | 5 | — | — | 10 | 5 | 10 |
| Tin 2-ethylhexylate (parts) | 0.03 | 0.05 | 0.04 | — | — | — |
| Tin octylate (parts) | — | — | — | 1 | 1 | 1 |

Production Example 7

<Production of Polyester Diol (a11-1)>

| | |
|---|---|
| 1,3-propane diol | 2 parts |
| L-lactide | 50 parts |
| Meso-DL-lactide | 48 parts |
| Tin 2-ethylhexylate | 0.06 parts |

In an autoclave reaction vessel equipped with a thermometer, a stirrer and a nitrogen inlet tube, the above-described raw materials were charged, and subjected to a ring-opening polymerization reaction at 160° C. in a nitrogen atmosphere for 15 hours. Thereafter, residual lactides were removed from the reaction product at a reduced pressure, to thereby obtain a polyester diol (a11-1) having a polyhydroxycarboxylic acid skeleton. The polyester diol (a11-1) had a number average molecular weight of 8,200, a weight average molecular weight of 34,000, and an optical purity of 51%.

Production Example 8

<Production of Linear Polyester Resin (A-1)>

| | |
|---|---|
| 1,3-propane diol | 2 parts |
| L-lactide | 54 parts |
| D-lactide | 14 parts |
| Tin 2-ethylhexylate | 0.015 parts |

In an autoclave reaction vessel equipped with a thermometer, a stirrer and a nitrogen inlet tube, the above-described raw materials were charged, and subjected to a ring-opening polymerization reaction at 160° C. in a nitrogen atmosphere for 3 hours. Thereafter, residual lactides were removed from the reaction product at a reduced pressure, to thereby obtain a polyester diol (a11-2) having a polyhydroxycarboxylic acid skeleton.

| | |
|---|---|
| EO (2 mol) adduct of bisphenol A | 15 parts |
| Terephthalic acid | 15 parts |
| Tin 2-ethylhexylate | 0.01 parts |

Subsequently, in an autoclave reaction vessel equipped with a thermometer, a stirrer and a nitrogen inlet tube, a toluene solution containing the above-described raw materials was charged, and subjected to a reaction at 200° C. and 8 kPa for 15 hours. Thereafter, the reacted solution was returned to normal temperature and normal pressure to thereby obtain a polyester diol (a12-1).

In methyl ethyl ketone, 70 parts of the polyester diol (a11-2) and 30 parts of the polyester diol (a12-1) were dissolved, and then 8 parts of isophorone diisocyanate (IPDI) provided as a chain-extending agent was added in the methyl ethyl ketone. The resultant solution was subjected to an extension reaction at 50° C. for 6 hours, followed by distillation of the solvent, to thereby obtain a linear polyester resin (A-1). The linear polyester resin (A-1) had a number average molecular weight of 3,600, a weight average molecular weight of 15,000, and an optical purity of 59%.

Production Example 9

<Production of Linear Polyester Resin (A-2)>

| | |
|---|---|
| 1,4-butane diol | 2 parts |
| L-lactide | 50 parts |
| D-lactide | 13 parts |
| Tin 2-ethylhexylate | 2 parts |

In an autoclave reaction vessel equipped with a thermometer, a stirrer and a nitrogen inlet tube, the above-described raw materials were charged, and subjected to a ring-opening polymerization reaction at 160° C. in a nitrogen atmosphere for 3 hours, and the reaction product was further reacted at 130° C. at normal pressure for 1 hour. Thereafter, residual lactides were removed from the reaction product, to thereby obtain a polyester diol (a11-3) having a polyhydroxycarboxylic acid skeleton.

| | |
|---|---|
| EO (2 mol) adduct of bisphenol A | 17.5 parts |
| Terephthalic acid | 17.5 parts |
| Tin 2-ethylhexylate | 0.02 parts |

Subsequently, in an autoclave reaction vessel equipped with a thermometer, a stirrer and a nitrogen inlet tube, a toluene solution containing the above-described raw materials was charged, and subjected to a reaction at 200° C. and 8 kPa for 15 hours. Thereafter, the reacted solution was returned to normal temperature and normal pressure to thereby obtain a polyester diol (a12-2).

In methyl ethyl ketone, 70 parts of the polyester diol (a11-3) and 30 parts of the polyester diol (a12-2) were dissolved, and then 8 parts of isophorone diisocyanate (IPDI) provided as a chain-extending agent was added in the methyl ethyl ketone. The resultant solution was subjected to an extension reaction at 50° C. for 6 hours, followed by distillation of the solvent, to thereby obtain a linear polyester resin (A-2). The linear polyester resin (A-2) had a number average molecular weight of 5,300, a weight average molecular weight of 21,000, and an optical purity of 59%.

Production Example 10

<Production of Linear Polyester Resin (A-3)>

| | |
|---|---|
| 1,3-propane diol | 2 parts |
| L-lactide | 34 parts |
| D-lactide | 34 parts |
| Tin 2-ethylhexylate | 2 parts |

In an autoclave reaction vessel equipped with a thermometer, a stirrer and a nitrogen inlet tube, the above-described raw materials were charged, and subjected to a ring-opening polymerization reaction at 160° C. in a nitrogen atmosphere for 3 hours, and the reaction product was further reacted at 130° C. at normal pressure for 1 hour. Thereafter, residual lactides were removed from the reaction product, to thereby obtain a polyester diol (a11-4) having a polyhydroxycarboxylic acid skeleton.

| | |
|---|---|
| EO (2 mol) adduct of bisphenol A | 15 parts |
| Terephthalic acid | 15 parts |
| Tin 2-ethylhexylate | 0.02 parts |

Subsequently, in an autoclave reaction vessel equipped with a thermometer, a stirrer and a nitrogen inlet tube, a toluene solution containing the above-described raw materials was charged, and subjected to a reaction at 200° C. and 8 kPa for 15 hours. Thereafter, the reacted solution was returned to normal temperature and normal pressure to thereby obtain a polyester diol (a12-3).

In methyl ethyl ketone, 70 parts of the polyester diol (a11-4) and 30 parts of the polyester diol (a12-3) were dissolved, and then 8 parts of isophorone diisocyanate (IPDI) provided as a chain-extending agent was added in the methyl ethyl ketone. The resultant solution was subjected to an extension reaction at 50° C. for 6 hours, followed by distillation of the solvent, to thereby obtain a linear polyester resin (A-3). The linear polyester resin (A-3) had a number average molecular weight of 4,900, a weight average molecular weight of 18,000, and an optical purity of 0%.

The components and compositions used for production of the linear polyester resins (A-1) to (A-3) are shown in Table 2.

TABLE 2

| | Linear polyester resin | | | | | |
|---|---|---|---|---|---|---|
| | Polyester diol (a11) | | | | Polyester diol (a12) | |
| | 1,3-propane diol (parts) | 1,4-butane diol (parts) | L-lactide (parts) | D-lactide (parts) | EO (2 mol) adduct of bisphenol A (parts) | Terephthalic acid (parts) |
| (A-1) | 2 | — | 54 | 14 | 15 | 15 |
| (A-2) | — | 2 | 50 | 13 | 17.5 | 17.5 |
| (A-3) | 2 | — | 34 | 34 | 15 | 15 |

The properties of the amorphous polyester resins (a-1) to (a-6), polyester diol (a11-1), and linear polyester resins (A-1) to (A-3), all of which are the amorphous polyester resins, are shown in Table 3.

TABLE 3

| Amorphous polyester resin | Optical purity (%) | Weight average molecular weight Mw | Number average molecular weight Mn |
|---|---|---|---|
| (a-1) | 40 | 37,000 | 9,200 |
| (a-2) | 54 | 29,000 | 7,500 |
| (a-3) | 77 | 36,000 | 8,800 |
| (a-4) | 60 | 26,000 | 7,600 |
| (a-5) | 40 | 37,000 | 9,200 |
| (a-6) | 84 | 31,000 | 8,200 |
| (a11-1) | 51 | 34,000 | 8,200 |
| (A-1) | 59 | 15,000 | 3,600 |
| (A-2) | 59 | 21,000 | 5,300 |
| (A-3) | 0 | 18,000 | 4,900 |

Production Example 11

<Production of Amorphous Polyester Resin Having No Polyhydroxycarboxylic Acid Skeleton (d)>

| | |
|---|---|
| EO (2 mol) adduct of bisphenol A | 10 parts |
| Terephthalic acid | 8 parts |
| Adipic acid | 2 parts |
| Tin 2-ethylhexylate | 0.006 parts |

In an autoclave reaction vessel equipped with a thermometer, a stirrer and a nitrogen inlet tube, a toluene solution containing the above-described raw materials was charged, and subjected to a reaction at 200° C. and 8 kPa for 15 hours, to thereby obtain an amorphous polyester resin (d).

Production Example 12

<Production of Crystalline Polyester Resin (b-1)>

| | |
|---|---|
| 1,4-butane diol | 38.9 parts |
| 1,6-hexane diol | 5.5 parts |
| Fumaric acid | 55.6 parts |
| Hydroquinone | 0.08 parts |

In a 5 L four-neck flask equipped with a nitrogen inlet tube, a dehydration tube, a stirrer and a thermocouple, the above-described raw materials were charged, and subjected to a reaction at 160° C. for 5 hours, and the reaction product was further reacted at 200° C. for 1 hour. Furthermore, the resultant product was reacted at 8.3 kPa for 1 hour, to thereby produce a crystalline polyester resin (b-1). The crystalline polyester resin (b-1) had a number average molecular weight of 900, a weight average molecular weight of 3,500, Mw/Mn of 3.9, and a melting point of 125° C. When the absorption based on the out-of-plane bending vibration (δCH) of an olefin was measured in an infrared absorption spectrum, absorption could be observed at 970 $cm^{-1}$.

Production Example 13

<Production of Crystalline Polyester Resin (b-2)>

| | |
|---|---|
| 1,4-butane diol | 37.1 parts |
| 1,6-hexane diol | 5.2 parts |
| Fumaric acid | 42.4 parts |
| Terephthalic acid | 15.2 parts |
| Hydroquinone | 0.07 parts |

In a 5 L four-neck flask equipped with a nitrogen inlet tube, a dehydration tube, a stirrer and a thermocouple, the above-described raw materials were charged, and subjected to a reaction at 160° C. for 5 hours, and the reaction product was further reacted at 200° C. for 1 hour. Furthermore, the resultant product was reacted at 8.3 kPa for 1 hour, to thereby produce a crystalline polyester resin (b-2). The crystalline polyester resin (b-2) had a number average molecular weight of 800, a weight average molecular weight of 1,500, Mw/Mn of 1.9, and a melting point of 98° C. When the absorption based on the out-of-plane bending vibration (δCH) of an olefin was measured in an infrared absorption spectrum, absorption could be observed at 968 $cm^{-1}$.

Production Example 14

<Production of Crystalline Polyester Resin (b-3)>

| | |
|---|---|
| 1,4-butane diol | 35.9 parts |
| 1,6-hexane diol | 5.1 parts |
| Fumaric acid | 41.1 parts |
| Terephthalic acid | 14.8 parts |
| Hydroquinone | 0.07 parts |

In a 5 L four-neck flask equipped with a nitrogen inlet tube, a dehydration tube, a stirrer and a thermocouple, the above-described raw materials were charged, and subjected to a reaction at 160° C. for 5 hours, and the reaction product was further reacted at 200° C. for 1 hour. Furthermore, the resultant product was reacted at 8.3 kPa for 1 hour, to thereby produce a crystalline polyester resin (b-3). The crystalline polyester resin (b-3) had a number average molecular weight of 2,500, a weight average molecular weight of 6,700, Mw/Mn of 2.7, and a melting point of 51° C. When the absorption based on the out-of-plane bending vibration (δCH) of olefin was measured in an infrared absorption spectrum, absorption could not be observed.

Production Example 15

<Production of Crystalline Polyester Resin (b-4)>

| | |
|---|---|
| 1,4-butane diol | 27.0 parts |
| Terephthalic acid | 24.9 parts |
| Isophthalic acid | 16.6 parts |
| Hydroquinone | 0.08 parts |

In a 5 L four-neck flask equipped with a nitrogen inlet tube, a dehydration tube, a stirrer and a thermocouple, the above-described raw materials were charged, and subjected to a reaction at 160° C. for 5 hours, and the reaction product was further reacted at 200° C. for 1 hour. Furthermore, the resultant product was reacted at 8.3 kPa for 1 hour, to thereby produce a crystalline polyester resin (b-4). The crystalline polyester resin (b-4) had a number average molecular weight of 2,800, a weight average molecular weight of 9,200, Mw/Mn of 3.3, and a melting point of 155° C. When the absorption based on the out-of-plane bending vibration (δCH) of olefin was measured in an infrared absorption spectrum, absorption could not be observed.

Production Example 16

<Production of Crystalline Polyester Resin (b-5)>

| | |
|---|---|
| 1,6-hexane diol | 50.9 parts |
| Fumaric acid | 50.0 parts |
| Hydroquinone | 0.08 parts |

In a 5 L four-neck flask equipped with a nitrogen inlet tube, a dehydration tube, a stirrer and a thermocouple, the above-described raw materials were charged, and subjected to a reaction at 160° C. for 5 hours, and the reaction product was further reacted at 200° C. for 1 hour. Furthermore, the resultant product was reacted at 8.3 kPa for 1 hour, to thereby produce a crystalline polyester resin (b-5). The crystalline polyester resin (b-5) had a number average molecular weight of 1,200, a weight average molecular weight of 4,400, Mw/Mn of 3.7, and a melting point of 105° C. When the absorption based on the out-of-plane bending vibration (δCH) of olefin was measured in an infrared absorption spectrum, absorption could be observed at 970 $cm^{-1}$. The crystalline polyester resin (b-5) is the crystalline polyester resin represented by General Formula (1) wherein $R^1$ and $R^2$ are hydrogen:

General Formula (1)

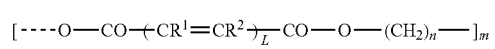

In General Formula (1), "n" and "m" each denote a repeating unit, L denotes an integer of 1 to 3.

The components and compositions used for production of the crystalline polyester resins (b-1) to (b-5) are shown in Table 4.

TABLE 4

| Crystalline polyester resin | 1,4-butane diol (parts) | 1,6-hexane diol (parts) | Fumaric acid (parts) | Terephthalic acid (parts) | Isophthalic acid (parts) | Hydroquinone (parts) |
|---|---|---|---|---|---|---|
| (b-1) | 38.9 | 5.5 | 55.6 | — | — | 0.08 |
| (b-2) | 37.1 | 5.2 | 42.4 | 15.2 | — | 0.07 |
| (b-3) | 35.9 | 5.1 | 41.1 | 14.8 | — | 0.07 |
| (b-4) | 27 | — | — | 24.9 | 16.6 | 0.08 |
| (b-5) | — | 50.9 | 50 | — | — | 0.08 |

With respect to the produced crystalline polyester resins (b-1)-(b-5), a DSC endothermic peak temperature when a temperature was increased from −20° C. to 150° C. at a temperature increasing rate of 10° C./min, the average molecular weight (Mw), number average molecular weight (Mn), and Mw/Mn in terms of molecular weight distribution by gel permeation chromatography (GPC) of orthodichlorobenzene soluble content, and the absorption based on the out-of-plane bending vibration (δCH) of an olefin in an infrared absorption spectrum were measured. The results are shown in Table 5.

TABLE 5

| Crystalline polyester resin | DSC endothermic peak temperature (° C.) | Weight average molecular weight Mw | Number average molecular weight Mn | Mw/Mn | δCH ($cm^{-1}$) |
|---|---|---|---|---|---|
| (b-1) | 125 | 3,500 | 900 | 3.9 | 970 |
| (b-2) | 98 | 1,500 | 800 | 1.8 | 968 |
| (b-3) | 51 | 6,700 | 2,500 | 2.7 | — |
| (b-4) | 155 | 9,200 | 2,800 | 3.3 | — |
| (b-5) | 105 | 4,400 | 1,200 | 3.7 | 970 |

Production Example 17

<Production of Aqueous Dispersion Liquid of the Polyester Resin Fine Particles (c-1)>

A mixture containing terephthalic acid (79 parts), isophthalic acid (7 parts), ethylene glycol (14 parts) and neopentyl glycol (29 parts) was heated in an autoclave reaction vessel at 260° C. for 4 hours to perform an esterification reaction. Next, 0.06 parts of tetrabutyl titanate was added as a catalyst into the mixture. The temperature of the system was raised to 280° C., and then the pressure of the system was gradually reduced so that it reached 13 Pa after 1.5 hours. The polycondensation reaction was further continued under this condition. After 2 hours, the system was returned to normal pressure using a nitrogen gas, and the temperature thereof was reduced until it reached 270° C. Immediately after the reduction of the temperature of the system, 2 parts of trimellitic acid was added thereto, and the system was stirred at 250° C. for 1 hour, and depolymerized. Thereafter, the resin was delivered in a sheet-shape under pressure of nitrogen gas. The sheet-shaped product was sufficiently cooled to room temperature and then crushed with a crusher, followed by screening with a sieve having a pore size of 1 mm to 6 mm, and a sieved fraction was picked up, to thereby obtain a granular polyester resin (c-1).

In a stirrer (T.K. ROBOMIX, manufactured by Tokushu Kikai Kogyo Co., Ltd.) having a 1 L-glass container equipped with a jacket, 100 parts of the polyester resin (c-1), 60 parts of isopropyl alcohol, 1.6 parts of a 28% ammonia water, and 170 parts of distilled water were charged, and stirred at 7,000 rpm. Hot water was passed through the jacket to heat the mixture. The mixture was further stirred for 60 minutes while the temperature of the system was maintained at 73° C. to 75° C. The mixture was cooled to the room temperature by passing cold water through the jacket, while being stirred at 5,000 rpm, to thereby obtain a uniform, opaque white aqueous dispersion of the polyester resin (c-1).

In a 1 L two-necked round-bottom flask, 300 parts of the aqueous dispersion of the polyester resin (c-1) and 80 parts of distilled water were charged, and the flask was equipped with a mechanical stirrer and a Liebig condenser. The flask was continuously heated in an oil bath and the aqueous medium was distilled off. When about 160 parts of the aqueous medium was distilled off, the heating was terminated, and the flask was cooled down to room temperature. After cooling, the liquid component in the flask was filtered with a 600-mesh filter (twilled dutch weave). The concentration of the solid content of the filtrate was measured and fount to be 40%. Distilled water was added to the filtrate while stirring, so that the concentration of the solid content was adjusted to 30%. Thus, an aqueous dispersion liquid of the polyester resin fine particles (c-1) was obtained. The particles of the aqueous dispersion liquid of the polyester resin fine particles (c-1) had a volume average particle diameter of 68 nm. The resin content of the aqueous dispersion liquid of the polyester resin fine particles (c-1) had a weight average molecular weight of 9,800, a glass transition temperature (Tg) of 68° C., and an acid value of 30.3 mgKOH/g.

Production Example 18

<Production of Aqueous Dispersion Liquid of the Polyester Resin Fine Particles (c-2)>

A mixture containing terephthalic acid (56 parts), isophthalic acid (27 parts), ethylene glycol (12 parts) and neopentyl glycol (31 parts) was heated in an autoclave reaction vessel at 260° C. for 4 hours to perform an esterification reaction. Next, 0.05 parts of tetrabutyl titanate was added as a catalyst into the mixture. The temperature of the system was raised to 280° C., and then the pressure of the system was gradually reduced so that it reached 13 Pa after 1.5 hours. The polycondensation reaction was further continued under this condition. After 2 hours, the system was returned to normal pressure using a nitrogen gas, and the temperature thereof was reduced until it reached 270° C. Immediately after the reduction of the temperature of the system, 22 parts of trimellitic acid was added thereto, and the system was stirred at 250° C. for 1 hour, and depolymerized. Thereafter, the resin was delivered in a sheet-shape under pressure of nitrogen gas. The sheet-shaped product was sufficiently cooled to room temperature and then crushed with a crusher, followed by screening with a sieve having a pore size of 1 mm to 6 mm, and a sieved fraction was picked up, to thereby obtain a granular polyester resin (c-2).

In a stirrer (T.K. ROBOMIX, manufactured by Tokushu Kikai Kogyo Co., Ltd.) having a 1 L-glass container equipped with a jacket, 100 parts of the polyester resin (c-2), 60 parts of isopropyl alcohol, 1.6 parts of a 28% ammonia water, and 170 parts of distilled water were charged, and stirred at 7,000 rpm. Next, hot water was passed through the jacket to heat the mixture, and the mixture was further stirred for 60 minutes while the temperature of the system was maintained at 73° C. to 75° C. The mixture was cooled to room temperature by passing cold water through the jacket, while being stirred at 5,000 rpm, to thereby obtain a uniform, opaque white aqueous dispersion of the polyester resin (c-2).

In a 1 L two-necked round-bottom flask, 300 parts of the aqueous dispersion of the polyester resin (c-2) and 80 parts of distilled water were charged, and the flask was equipped with a mechanical stirrer and a Liebig condenser. The flask was continuously heated in an oil bath and the aqueous medium was distilled off. When about 160 parts of the aqueous medium was distilled off, the heating was terminated, and the flask was cooled down to room temperature. After cooling, the liquid component in the flask was filtered with a 600-mesh filter (twilled dutch weave). The concentration of the solid content of the filtrate was measured and fount to be 40% by mass. Distilled water was added to the filtrate while stirring, so that the concentration of the solid content was adjusted to 30% by mass. Thus, an aqueous dispersion liquid of the polyester resin fine particles (c-2) was obtained. The particles of the aqueous dispersion liquid of the polyester resin particles (c-2) had a volume average particle diameter of 107 nm. The resin content of the aqueous dispersion liquid of the polyester resin fine particles (c-2) had a weight average molecular weight of 13,500, a glass transition temperature (Tg) of 63° C., and an acid value of 22.3 mgKOH/g.

Production Example 19

<Production of Aqueous Dispersion Liquid of the Polyester Resin Fine Particles (c-3)>

A mixture containing terephthalic acid (83 parts), 1,2-propane diol (10 parts), and ethylene glycol (23 parts) was heated in an autoclave reaction vessel at 240° C. for 3 hours to perform an esterification reaction. Next, the temperature of the system was decreased to 230° C., and 0.06 parts of tetrabutyl titanate was added as a catalyst into the mixture, and then the pressure of the system was gradually reduced so that it reached 13 Pa after 1.5 hours. The polycondensation reaction was further continued under this condition. After 2 hours, 3 parts of trimellitic acid was added to the system, and the system was stirred for 1 hour, and depolymerized. Thereafter, the resin was delivered in a sheet-shape under pressure of nitrogen gas. The sheet-shaped product was sufficiently cooled to the room temperature and then crushed with a crusher, followed by screening with a sieve having a pore size of 1 mm to 6 mm, and a sieved fraction was picked up, to thereby obtain a granular polyester resin (c-3).

In a stirrer (T.K. ROBOMIX, manufactured by Tokushu Kikai Kogyo Co., Ltd.) having a 1 L-glass container equipped with a jacket, 100 parts of the polyester resin (c-3), 60 parts of isopropyl alcohol, 1.6 parts of a 28% ammonia water, and 170 parts of distilled water were charged, and stirred at 7,000 rpm. Next, hot water was passed through the jacket to heat the mixture, and then the mixture was further stirred for 60 minutes while the temperature of the system was maintained at 73° C. to 75° C. The mixture was cooled to the room temperature by passing cold water through the jacket, while being stirred at 5,000 rpm, to thereby obtain a uniform, opaque white aqueous dispersion of the polyester resin (c-3).

In a 1 L two-necked round-bottom flask, 300 parts of the aqueous dispersion of the polyester resin fine particles (c-3) and 80 parts of distilled water were charged, and the flask was equipped with a mechanical stirrer and a Liebig condenser. The flask was continuously heated in an oil bath and the aqueous medium was distilled off. When about 160 parts of the aqueous medium was distilled off, the heating was terminated, and the flask was cooled down to room temperature. After cooling, the liquid component in the flask was filtered with a 600-mesh filter (twilled dutch weave). The concentration of the solid content of the filtrate was measured and fount to be 40% by mass. Distilled water was added to the filtrate while stirring, so that the concentration of the solid content was adjusted to 30% by mass. Thus, an aqueous dispersion liquid of the polyester resin fine particles (c-3) was obtained. The particles of the aqueous dispersion liquid of the polyester resin fine particles (c-3) had a volume average particle diameter of 83 nm. The resin content of the aqueous dispersion liquid of the polyester resin fine particles (c-3) had a weight average molecular weight of 17,200, a glass transition temperature (Tg) of 75° C., and an acid value of 20.0 mgKOH/g.

Production Example 20

<Production of Aqueous Dispersion Liquid of the Polyester Resin Fine Particles (c-4)>

A mixture containing terephthalic acid (47 parts), isophthalic acid (36 parts), neopentyl glycol (32 parts), and ethylene glycol (9 parts) was heated in an autoclave reaction vessel at 240° C. for 3 hours to perform an esterification reaction. Next, the temperature of the system was decreased to 230° C., and 0.06 parts of tetrabutyl titanate was added as a catalyst into the mixture, and then the pressure of the system was gradually reduced so that it reached 13 Pa after 1.5 hours. The polycondensation reaction was further continued under this condition. After 2 hours, 17 parts of trimellitic acid was added to the system, and the system was stirred for 1 hour, and depolymerized. Thereafter, the resin was delivered in a sheet-shape under pressure of nitrogen gas. The sheet-shaped product was sufficiently cooled to the room temperature and then crushed with a crusher, followed by screening with a sieve having a pore size of 1 mm to 6 mm, and a sieved fraction was picked up, to thereby obtain a granular polyester resin (c-4).

In a stirrer (T.K. ROBOMIX, manufactured by Tokushu Kika Kogyo Co., Ltd.) having a 1 L-glass container equipped with a jacket, 100 parts of the polyester resin (c-4), 60 parts of isopropyl alcohol, 1.6 parts of a 28% ammonia water, and 170 parts of distilled water were charged, and stirred at 7,000 rpm. Next, hot water was passed through the jacket to heat the mixture, and then the mixture was further stirred for 60 minutes while the temperature of the system was maintained at 73° C. to 75° C. The mixture was cooled to the room temperature by passing cold water through the jacket, while being stirred at 5,000 rpm, to thereby obtain a uniform, opaque white aqueous dispersion of the polyester resin (c-4).

In a 1 L two-necked round-bottom flask, 300 parts of the aqueous dispersion of the polyester resin fine particles (c-4) and 80 parts of distilled water were charged, and the flask was equipped with a mechanical stirrer and a Liebig condenser. The flask was continuously heated in an oil bath and the aqueous medium was distilled off. When about 160 parts of the aqueous medium was distilled off, the heating was terminated, and the flask was cooled down to room temperature. After cooling, the liquid component in the flask was filtered with a 600-mesh filter (twilled dutch weave). The concentration of the solid content of the filtrate was measured and fount to be 40% by mass. Distilled water was added to the filtrate while stirring, so that the concentration of the solid content was adjusted to 30% by mass. Thus, an aqueous dispersion liquid of the polyester resin fine particles (c-4) was obtained. The particles of the aqueous dispersion liquid of the polyester resin fine particles (c-4) had a volume average particle diameter of 72 nm. The resin content of the aqueous dispersion liquid of the polyester resin fine particles (c-4) had a weight average molecular weight of 15,000, a glass transition temperature (Tg) of 46° C., and an acid value of 23.0 mgKOH/g.

Production Example 21

<Production of Aqueous Dispersion Liquid of Resin Fine Particle (e-1)>

Into a reaction container equipped with a condenser tube, a stirrer and a nitrogen introducing pipe, 1.6 parts of sodium dodecyl sulfate and 486 parts of ion exchange water were charged. The mixture was heated at 80° C. while stirring, so as to dissolve the sodium dodecyl sulfate in the ion exchange water. Thereafter, a solution prepared by dissolving 2.8 parts of potassium persulfate in 109 parts of ion exchange water was poured into this reaction container. Fifteen minutes after that, a mixed solution composed of 180 parts of styrene and 20 parts of butyl acrylate was applied dropwise in 90 minutes. Then the temperature was maintained at 80° C. for a further 60 minutes so as to perform polymerization reaction. Thereafter, cooling was performed, and an aqueous dispersion liquid of resin fine particle (e-1) was thus obtained.

The aqueous dispersion liquid of resin fine particle (e-1) was measured using a particle size distribution measurement device, a dynamic light scattering spectrophotometer DLS-800 (manufactured by Otsuka Electronics Co., Ltd.): the particles of the aqueous dispersion liquid of resin fine particle (e-1) had a volume average particle diameter of 78 nm; and the resin content of the aqueous dispersion liquid of resin fine particle (e-1) had a weight average molecular weight of 220,000 and a glass transition temperature (Tg) of 85° C.

Production Example 22

<Production of Aqueous Dispersion Liquid of Resin Fine Particle (e-2)>

Into a reaction container equipped with a stirrer and a thermometer, a nitrogen introducing pipe, 600 parts of water, 120 parts of styrene, 100 parts of methacrylic acid, 45 parts of butyl acrylate, 10 parts of sodium alkyl allyl sulfosuccinate (ELEMINOL JS-2, by Sanyo Chemical Industries, Ltd.), 1 part by mss of ammonium persulfate were charged, and then stirred at a rotational speed of 400 rpm for 20 minutes. Thus, a white emulsion was obtained. This emulsion was heated until the temperature of the system reached 75° C., and subjected to reaction for 6 hours. Further, 30 parts of 1% ammonium persulfate aqueous solution was added, then the mixture was aged at 75° C. for 6 hours, and an aqueous dispersion liquid of resin fine particle (e-2) was thus obtained.

The aqueous dispersion liquid of resin fine particle (e-2) was measured using a particle size distribution measurement device, a dynamic light scattering spectrophotometer DLS-800 (manufactured by Otsuka Electronics Co., Ltd.): the particles of the aqueous dispersion liquid of resin fine particle (e-2) had a volume average particle diameter of 80 nm; and the resin content of the aqueous dispersion liquid of resin fine particle (e-2) had a glass transition temperature (Tg) of 74° C.

<Production of Toner>

—Preparation of Aqueous Phases (1) to (19)—

Water (990 parts), 83 parts of aqueous dispersion liquid of fine particles produced in Production Examples 17 to 21 (respectively selected according to Table 6), 37 parts of 48.5% of aqueous solution of sodium dodecyl diphenylether disulfonic acid, ELEMINOL MON-7, manufactured by Sanyo Chemical Industries, Ltd., and 90 parts of ethyl acetate were mixed and stirred, to thereby respectively obtain aqueous phases (1) to (19).

TABLE 6

| | Second binder resin |
|---|---|
| Aqueous phase 1 | (c-1) |
| Aqueous phase 2 | (c-2) |
| Aqueous phase 3 | (c-3) |
| Aqueous phase 4 | (c-1) |
| Aqueous phase 5 | (c-2) |
| Aqueous phase 6 | (e-1) |
| Aqueous phase 7 | (c-1) |
| Aqueous phase 8 | (c-3) |
| Aqueous phase 9 | (c-1) |
| Aqueous phase 10 | (c-2) |
| Aqueous phase 11 | (e-1) |
| Aqueous phase 12 | (c-1) |
| Aqueous phase 13 | — |

TABLE 6-continued

| | Second binder resin |
|---|---|
| Aqueous phase 14 | (c-4) |
| Aqueous phase 15 | — |
| Aqueous phase 16 | (e-1) |
| Aqueous phase 17 | — |
| Aqueous phase 18 | (c-1) |
| Aqueous phase 19 | (e-1) |

—Preparation of Aqueous Phase (20)—

Ion exchange water (300 parts), 300 parts of the aqueous dispersion liquid of resin fine particle (e-2), and 0.2 parts of sodium dodecylbenzene sulphonate were mixed and stirred to form a uniform solution, to thereby obtain aqueous phase (20).

—Synthesis of Polyester Prepolymer—

| | |
|---|---|
| Ethylene oxide (2 mole) adduct of bisphenol A | 720 parts |
| Propylene oxide (2 mole) adduct of bisphenol A | 90 parts |
| Terephthalic acid | 290 parts |
| Trimellitic anhydride | 25 parts |
| Dibutyltin oxide | 2 parts |

In a reaction vessel equipped with a condenser, a stirrer and a nitrogen inlet tube, the above-described raw materials were charged and reacted at normal pressure at 230° C. for 8 hours. Then, the reaction product was further reacted at reduced pressure of 10 mmHg to 15 mmHg for 7 hours to synthesize an intermediate polyester resin. The resulting intermediate polyester resin was found to have a number average molecular weight (Mn) of 2,500, a weight average molecular weight (Mw) of 10,700, a peak molecular weight of 3,400, a glass transition temperature (Tg) of 57° C., an acid value of 0.4 mgKOH/g, and a hydroxyl value of 49 mgKOH/g.

| | |
|---|---|
| Intermediate polyester resin | 400 parts |
| Isophorone diisocyanate | 95 parts |
| Ethyl acetate | 580 parts |

Next, in a reaction vessel equipped with a condenser, a stirrer and a nitrogen inlet tube, the above-described raw materials were charged and reacted at 100° C. for 8 hours to synthesize polyester prepolymer. The resulting polyester prepolymer had a free isocyanate content of 1.42% by mass.

—Synthesis of Ketimine Compound—

| | |
|---|---|
| Isophorone diamine | 30 parts |
| Methyl ethyl ketone | 70 parts |

In a reaction vessel equipped with a stirrer and a thermometer, the above-described raw materials were charged and then reacted at 50° C. for 5 hours to synthesize a ketimine compound. The resulting ketimine compound had an amine value of 423 mgKOH/g.

—Production of Masterbatch (1)—

| | |
|---|---|
| Amorphous polyester resin (a-1) | 100 parts |
| Carbon black (PRINTEX 35, produced by Degussa HÜLS AG) | 100 parts |

-continued

| | |
|---|---|
| DBP oil absorption: 42 mL/100 g, a pH: 9.5 | |
| Water | 50 parts |

The above-described raw materials were mixed with a HENSCHEL MIXER (manufactured by Mitsui Mining Co., Ltd.). The resulting mixture was kneaded with a two-roll at 80° C. for 30 minutes, then rolled and cooled, and pulverized with a pulverizer (manufactured by Hosokawa Micron Co., Ltd.), to thereby produce a masterbatch (1).

—Production of Masterbatch (2)—

| | |
|---|---|
| Linear polyester resin (A-1) | 120 parts |
| Carbon black (PRINTEX 35, produced by Degussa HÜLS AG) | 53 parts |
| DBP oil absorption: 42 mL/100 g, a pH: 9.5 | |
| Water | 100 parts |

The above-described raw materials were mixed with a HENSCHEL MIXER (manufactured by Mitsui Mining Co., Ltd.). The resulting mixture was kneaded with a two-roll at 150° C. for 30 minutes, then rolled and cooled, and pulverized with a pulverizer (manufactured by Hosokawa Micron Co., Ltd.), to thereby produce a masterbatch (2).

—Production of Masterbatch (3)—

| | |
|---|---|
| Amorphous polyester resin (d) | 100 parts |
| Carbon black (PRINTEX 35, produced by Degussa HÜLS AG) | 100 parts |
| DBP oil absorption: 42 mL/100 g, a pH: 9.5 | |
| Water | 50 parts |

The above-described raw materials were mixed with a HENSCHEL MIXER (manufactured by Mitsui Mining Co., Ltd.). The resulting mixture was kneaded with a two-roll at 80° C. for 30 minutes, then rolled and cooled, and pulverized with a pulverizer (manufactured by Hosokawa Micron Co., Ltd.), to thereby produce a masterbatch (3).

—Preparation of Wax Dispersion Liquid (1)—

| | |
|---|---|
| Amorphous polyester resin (a-1) | 300 parts |
| Carnauba wax (molecular weight: 1,800, acid value: 2.7 mgKOH/g, penetration: 1.7 mm (40° C.)) | 90 parts |
| Ethyl acetate | 1,000 parts |

These raw materials were charged, and dissolved at 79° C. while stirring, followed by rapidly quenching to 4° C. The mixture was dispersed with a bead mill, ULTRA VISCOMILL (manufactured by Aimex Co., Ltd.) under the following conditions: liquid feed rate: 1 kg/hr, disc circumferential speed: 6 m/sec, 0.5 mm-zirconia bead filled at 80% by volume, and 3 passes, to thereby prepare a wax dispersion liquid (1) having a volume average particle diameter of 0.6 μm.

—Preparation of Wax Dispersion Liquid (2)—

| | |
|---|---|
| Amorphous polyester resin (d) | 300 parts |
| Carnauba wax (molecular weight: 1,800, acid value: 2.7 mgKOH/g, penetration: 1.7 mm (40° C.)) | 90 parts |
| Ethyl acetate | 1,000 parts |

These raw materials were charged, and dissolved at 79° C. while stirring, followed by rapidly quenching to 4° C. The mixture was dispersed with a bead mill, ULTRA VISCOMILL (manufactured by Aimex Co., Ltd.) under the following conditions: liquid feed rate: 1 kg/hr, disc circumferential speed: 6 m/sec, 0.5 mm-zirconia bead filled at 80% by volume, 3 passes, to thereby prepare a wax dispersion liquid (2) having a volume average particle diameter of 0.6 μm.

—Crystalline Low Molecular Compound—

Behenic acid (NAA222S, manufactured by NOF CORPORATION, melting point: 78° C.)

Behenyl alcohol (NAA180, manufactured by NOF CORPORATION, melting point: 62° C.)

Diglycerine distearate (hydroxyl value: 80 mgKOH/g, melting point: 62° C.)

Distearyl monostearate (acid value: 120 mgKOH/g, melting point: 72° C.)

Oleamide (NEUTRON, manufactured by NIPPON FINE CHEMICAL CO., LTD., melting point: 74° C.)

Stearyl stearate (BRIAN DPS-60, manufactured by Matsumoto Yushi-Seiyaku Co., Ltd., acid value: 10 mgKOH/g, melting point: 62° C.)

Dibenzyl oxalate (melting point: 102° C.)

Lauric acid (melting point: 45° C.)

Lactamide (melting point: 74° C.)

—Preparation of Oil Phases (1) to (19)—

The raw materials shown in Tables 7-1 and 7-2 were dispersed with a bead mill, ULTRA VISCOMILL (manufactured by Aimex Co., Ltd.) under the following conditions: liquid feed rate: 1 kg/hr, disc circumferential speed: 6 m/sec, 0.5 mm-zirconia bead filled at 80% by volume and 3 passes. To the mixture, a ketimine compound (2.5 parts) was further added, to thereby respectively prepare oil phases (1) to (19).

TABLE 7-1

| Oil phase | First binder resin | | Pre-Polymer | Wax dispersion liquid | | Master-Batch | | Crystalline organic compound | | Ethyl acetate |
|---|---|---|---|---|---|---|---|---|---|---|
| No. | No. | parts | (parts) | No. | parts | No. | parts | (parts) | | (parts) |
| 1 | (a-1) | 35 | 15 | (1) | 120 | (1) | 12 | behenic acid (melting point: 78° C.) | 10 | 20 |
| 2 | (a-1) | 50 | — | (1) | 120 | (1) | 12 | behenyl alcohol (melting point: 62° C.) | 10 | 20 |
| 3 | (a-2) | 55 | — | (1) | 120 | (1) | 12 | diglycerine distearate (melting point: 62° C.) | 5 | 20 |
| 4 | (a-2) | 35 | 15 | (1) | 120 | (1) | 12 | distearyl monostearate (melting point: 72° C.) | 10 | 20 |
| 5 | (a-3) | 35 | 15 | (1) | 120 | (1) | 12 | oleamide (melting point: 74° C.) | 10 | 20 |
| 6 | (a-3) | 50 | — | (1) | 120 | (1) | 12 | stearyl stearate (melting point: 62° C.) | 10 | 20 |
| 7 | (a11-1) | 40 | 15 | (1) | 120 | (1) | 12 | behenic acid (melting point: 78° C.) | 5 | 20 |
| 8 | (a11-1) | 50 | — | (1) | 120 | (1) | 12 | behenyl alcohol (melting point: 62° C.) | 10 | 20 |
| 9 | (A-1) | 50 | — | (1) | 120 | (1) | 12 | diglycerine distearate (melting point: 62° C.) | 10 | 20 |
| 10 | (A-1) | 40 | 15 | (1) | 120 | (1) | 12 | distearyl monostearate (melting point: 72° C.) | 5 | 20 |
| 11 | (A-1) | 50 | — | (1) | 120 | (1) | 12 | stearyl stearate (melting point: 62° C.) | 10 | 20 |
| 12 | (a-1) | 35 | 15 | (1) | 120 | (1) | 12 | lactamide (melting point: 74° C.) | 10 | 20 |
| 13 | (a-1) | 35 | 15 | (1) | 120 | (1) | 12 | diglycerine distearate (melting point: 62° C.) | 10 | 20 |
| 14 | (a-1) | 50 | — | (1) | 120 | (1) | 12 | behenic acid (melting point: 78° C.) | 10 | 20 |

TABLE 7-2

| Oil phase | First binder resin | | Pre-Polymer | Wax dispersion liquid | | Master-batch | | Crystalline organic compound | | Ethyl acetate |
|---|---|---|---|---|---|---|---|---|---|---|
| No. | No. | parts | (parts) | No. | parts | No. | parts | (parts) | | (parts) |
| 15 | (a-1) | 45 | 15 | (1) | 120 | (1) | 12 | — | — | 20 |
| 16 | (a-1) | 50 | — | (1) | 120 | (1) | 12 | dibenzyl oxalate (melting point: 102° C.) | 10 | 20 |
| 17 | (a-1) | 50 | — | (1) | 120 | (1) | 12 | lauric acid (melting point: 45° C.) | 10 | 20 |
| 18 | (d) | 55 | — | (2) | 120 | (3) | 12 | diglycerine distearate (melting point: 62° C.) | 5 | 20 |
| 19 | (d) | 35 | 15 | (2) | 120 | (3) | 12 | stearic acid (melting point: 68° C.) | 10 | 20 |

—Production of Toner Bases (1) to (19)—

Next, in another container 150 parts of the aqueous phase (1) was charged, and while the aqueous phase (1) was stirred at 12,000 rpm using a TK homomixer (manufactured by Tokushu Kika Kogyo Co., Ltd.), 100 parts of Oil phase (1) was added thereto and mixed for 10 minutes to obtain an emulsion slurry. Further, into a kolben equipped with a stirrer and a thermometer, 100 parts of the emulsion slurry were charged, and the solvent was removed at 30° C. for 10 hours while stirring at a stirring circumferential speed of 20 m/min, followed by washing, filtering, and drying. Thereafter, the resultant product was sieved with a mesh with openings of 75 μm, to thereby produce a toner base (1).

Similarly, the aqueous phase (2) to the aqueous phase (19) and the oil phase (2) to the oil phase (19) were respectively used to produce a toner base (2) to a toner base (19).

—Preparation of Resin Solutions (1) to (6)—

In a reaction vessel, ethyl acetate (80 parts), and the amorphous polyester resins (A-1) to (A-3), (a-4) to (a-6), and polyester prepolymer in amounts as shown in Table 8 were respectively mixed and stirred to thereby prepare resin solutions (1) to (6).

TABLE 8

| | | Amorphous polyester resin (parts) | Polyester prepolymer (parts) |
|---|---|---|---|
| Resin solution (1) | (A-1) | 75 | 15 |
| Resin solution (2) | (A-2) | 70 | 20 |
| Resin solution (3) | (A-3) | 75 | 15 |
| Resin solution (4) | (a-4) | 90 | — |
| Resin solution (5) | (a-5) | 90 | — |
| Resin solution (6) | (a-6) | 90 | — |

—Preparation of Emulsion—

To the resin solution 1, 10 parts of the crystalline polyester resin (b-1), 5 parts of carnauba wax (molecular weight: 1,800, acid value: 2.7 mgKOH/g, penetration: 1.7 mm (40° C.)) and 5 parts of the masterbatch (2) were added and dispersed with a bead mill, ULTRA VISCOMILL (manufactured by Aimex Co., Ltd.) under the following conditions: liquid feed rate: 1 kg/hr, disc circumferential speed: 6 m/sec, 0.5 mm-zirconia bead filled at 80% by volume and 3 passes. Further, 2.5 parts of the ketimine compound was added to the solution to obtain a toner material liquid.

Next, into the vessel, 150 parts of the aqueous phase (20) were poured, and while the aqueous phase being stirred at 12,000 rpm with a TK homomixer (manufactured by Tokushu Kika Kogyo Co., Ltd.), 100 parts of the toner material liquid was added thereto and mixed for 10 minutes to obtain an emulsion slurry.

Further, into a kolben equipped with a stirrer and a thermometer, 100 parts of the emulsion slurry were charged, and the solvent was removed at 30° C. for 10 hours while stirring at a stirring circumferential speed of 20 m/min, to thereby obtain a dispersion slurry.

Next, 100 parts of the dispersion slurry were filtered under reduced pressure, and 100 parts by mass of ion exchange water were added to the resulting filtration cake and mixed at 12,000 rpm for 10 minutes using the TK homomixer, followed by a filtration treatment.

Into the resulting filtration cake, 300 parts of ion exchange water were added, mixed at 12,000 rpm for 10 minutes using the TK homomixer and then filtered twice.

Into the resulting filtration cake, 20 parts of 10% aqueous sodium hydroxide solution were added, mixed at 12,000 rpm for 30 minutes using the TK homomixer, and filtered under reduced pressure.

Into the resulting filtration cake, 300 parts of ion exchange water were added, mixed at 12,000 rpm for 10 minutes using the TK homomixer and then filtered twice.

Into the resulting filtration cake, 20 parts of 10% hydrochloric acid were added, mixed at 12,000 rpm for 10 minutes using the TK homomixer. Subsequently, into the resulting filtration cake, a fluorine-containing quaternary ammonium salt compound, FTERGENT F-310 (produced by Neos Co., Ltd. was added, in the form of a 5% ethanol solution, so that the fluorine-containing quaternary ammonium salt was contained in an amount equal to 0.1 parts with respect to 100 parts of solid contents of the toner, followed by stirring for 10 minutes and then filtering.

Into the resulting filtration cake, 300 parts of ion exchange water were added, mixed at 12,000 rpm for 10 minutes using the TK homomixer, and then filtered twice, thereby obtaining a final filtration cake.

The final filtration cake was dried with a circular air-drier at 40° C. for 36 hours and sieved with a mesh with openings of 75 thereby producing a toner base (20).

Toner bases (21) to (35) were each produced in the same manner as in the toner base (20), except that the type of the resin solution, the type of the crystalline polyester resin (b), the formulation amount of the crystalline polyester resin (b), the formulation amount of the amorphous polyester resin, and the formulation amount of polyester prepolymer were changed as shown in Table 9.

TABLE 9

| | Resin solution | Amorphous polyester resin (parts) | | Polyester prepolymer (parts) | Crystalline polyester resin (parts) | |
|---|---|---|---|---|---|---|
| Toner base (20) | (1) | (A-1) | 75 | 15 | (b-1) | 10 |
| Toner base (21) | (1) | (A-1) | 75 | 15 | (b-2) | 10 |
| Toner base (22) | (1) | (A-1) | 75 | 15 | (b-3) | 10 |
| Toner base (23) | (2) | (A-2) | 70 | 20 | (b-1) | 10 |
| Toner base (24) | (3) | (A-3) | 75 | 15 | (b-1) | 10 |
| Toner base (25) | (4) | (a-4) | 90 | — | (b-1) | 10 |
| Toner base (26) | (4) | (a-4) | 90 | — | (b-2) | 10 |
| Toner base (27) | (4) | (a-4) | 90 | — | (b-3) | 10 |
| Toner base (28) | (5) | (a-5) | 90 | — | (b-1) | 10 |
| Toner base (29) | (1) | (A-1) | 75 | 15 | (b-1) | 35 |
| Toner base (30) | (1) | (A-1) | 75 | 15 | (b-4) | 10 |
| Toner base (31) | (1) | (A-1) | 75 | 15 | (b-5) | 10 |
| Toner base (32) | (1) | (A-1) | 60 | — | (b-1) | 40 |
| Toner base (33) | (1) | (A-1) | 85 | 15 | — | — |
| Toner base (34) | (4) | (a-4) | 100 | — | — | — |
| Toner base (35) | (6) | (a-6) | 90 | — | (b-1) | 10 |

—Production of Toners (1) to (35)—

Each of the resulting toner bases (1) to (35) (100 parts) and a hydrophobic silica (1.0 part) serving as an external additive (H2000, produced by Clariant Japan K.K.) were mixed by a HENSCHEL MIXER (manufactured by Mitsui Mining Co., Ltd.) at a circumferential speed of 30 m/sec for 30 seconds and the mixing was stopped for 1 minute, and this process was repeated 5 times. After that, the mixed product was then sieved with a mesh with openings of 35 μm, to thereby respectively produce a toner (1) to a toner (35).

<Production of Carrier>

| | |
|---|---|
| Silicone resin (organo straight silicone) | 100 parts |
| γ-(2-aminoethyl)aminopropyl trimethoxysilane | 5 parts |
| Carbon black | 10 parts |
| Toluene | 100 parts |

The above-described raw materials were dispersed for 20 minutes using a HOMOMIXER to prepare a resin layer coating liquid. The resin layer coating liquid was applied on a surface of a spherically-shaped ferrite (1,000 parts) having a volume average particle diameter of 35 μm, using a fluidized bed coater, to thereby produce a carrier.

<Production of Developer>

Each of the toner (1) to toner (35) (5 parts) and the carrier (95 parts) were mixed to produce developers of Examples 1 to 27 and Comparative Examples 1 to 8

Next, the resulting developers were each evaluated for their fixability, heat resistant storage stability, environmental stability, image density, and haze degree in the following manners. The evaluation results are shown in Tables 10-1 and 10-2.

<Evaluation Method>

<<Measurement of Volume Average Particle Diameter (Dv), Number Average Particle Diameter (Dn), and Ratio (Dv/Dn)>>

The particle size distributions of the toners (toner base) were measured using COULTER MULTISIZER. Specifically, COULTER MULTISIZER III (manufactured by Beckman Coulter, Inc.) was used as a measuring apparatus, a personal computer and an interface (available from Nikkaki Co., LTD.) for outputting a number distribution and a volume distribution were connected to the measuring apparatus, and a 1% NaCl aqueous solution was prepared as an electrolytic solution, using primary sodium chloride. As for the measuring method, into 100 mL to 150 mL of this aqueous solution as an electrolytic solution, 0.1 mL to 5 mL of a surfactant (alkylbenzene sulfonate) as a dispersant was added, and also 2 mg to 20 mg of a measurement sample was added, then a dispersing process was carried out for about 1 minute to about 3 minutes using an ultrasonic dispersing device. Further, 100 mL to 200 mL of an electrolytic aqueous solution was poured into a beaker, then the dispersion liquid of the sample was added so as to have a predetermined concentration, and the volume average particle diameter (Dv) and the number average particle diameter (Dn) were calculated by averaging the particle diameters of 50,000 particles, using COULTER MULTISIZER III wish an aperture of 100 μm. Based upon the volume average particle diameter (Dv) and the number average particle diameter (Dn) obtained, the ratio (Dv/Dn) was calculated.

<<Confirmation of Crystalline State of Crystalline Organic Compound in Toner (XRD Method)>>

The crystalline state of the crystalline organic compound in a toner could be confirmed using a crystal analysis X-ray diffraction apparatus (X'Pert MRDX'Pert MRD, product of Philips Co.). The measurement method is described as follows. First, only a crystalline organic compound was brayed in a mortar to prepare sample powder. The thus-prepared sample powder was uniformly applied to a sample holder. Subsequently, the sample holder was set in the diffraction apparatus, following by measurement, to thereby give diffraction spectra of the crystalline organic compound. Next, a toner powder was applied on the holder, and then the holder is subjected to measurement similar to the above. A binder resin used in each toner was applied on the holder, and then the holder is subjected to measurement similar to the above. In the diffraction spectra of the obtained crystalline organic compound, a peak of a wave number which did not overlap with a peak of the binder resin alone was selected as a peak for identification. In the case where a peak for identification was observed in a toner was judged as "crystallinity was present". In the case where a peak for identification was not observed in a toner was judged as "crystallinity was absent".

<<Measurement of Melting Peak Endotherm of Crystalline Organic Compound>>

A melting peak endotherm of the crystalline organic compound was measured using a differential scanning calorimeter (DSC) system ("DSC-60", product of Shimadzu Corporation). First, about 5.0 mg of a binder resin or a toner (sample) was placed in a sample container made of aluminum; the sample container was placed on a holder unit; and the holder unit was set in an electric furnace. Using a differential scanning calorimeter ("DSC-60", product of Shimadzu Corporation), a DSC curve of the sample was obtained by increasing or decreasing its temperature in a nitrogen atmosphere as follows. A melting peak endotherm of the crystalline organic compound in the first temperature increase (hereinafter, referred to as Q1) is calculated in the following manner. The sample was heated from 20° C. to 150° C. at a temperature increasing rate of 10° C./min; Using the thus-obtained DSC curve and an analysis program of a DSC-60 system, Q1 was calculated in a shoulder of the melting peak endotherm of the crystalline organic compound corresponding to the first temperature increase.

A melting peak endotherm of the crystalline organic compound in the second temperature increase (hereinafter, referred to as Q2) was calculated in the following manner. After the first temperature increase, the sample was cooled from 150° C. to 0° C. at a temperature decreasing rate of 10° C./min, and heated again to 150° C. at a temperature increasing rate of 10° C./min; Using the thus-obtained DSC curve and an analysis program of a DSC-60 system, Q2 was calculated in a shoulder of the melting peak endotherm of the crystalline organic compound corresponding to the second temperature increase.

<Fixability>

In an electrophotographic copier (MF-200, manufactured by Ricoh Company, Ltd.) using a TEFLON roller as a fixing roller, its fixing unit was remolded for use in evaluation on fixability of toner. Using the electrophotographic copier, a solid image was formed, with a toner-adhesion amount of 0.85 mg/cm$^2$±0.1 mg/cm$^2$, on regular paper and heavy paper, i.e., transfer paper Type 6200 (produced by Ricoh Company Ltd.) and copy-printing paper <135> (produced by NBS Ricoh Co., Ltd.), while changing the temperature of a fixing belt. On that occasion, a maximum limit temperature at which no hot offset had occurred on the regular paper was determined as a maximum limit fixing temperature. A minimum limit temperature at which the residual ratio of the image density after the solid image formed on the heavy paper had been rubbed with a pad became 70% or more was determined as a minimum limit fixing temperature. The maximum limit fixing temperature and the minimum limit fixing temperature were evaluated based on the following evaluation criteria.

[Evaluation Criteria of Maximum Limit Fixing Temperature]

A: The maximum limit fixing temperature was 190° C. or higher.

B: The maximum limit fixing temperature was 180° C. or higher and lower than 190° C.

C: The maximum limit fixing temperature was 170° C. or higher and lower than 180° C.

D: The maximum limit fixing temperature was lower than 170° C.

[Evaluation Criteria of Minimum Limit Fixing Temperature]

A: The minimum limit fixing temperature was lower than 115° C.

B: The minimum limit fixing temperature was 115° C. or higher and lower than 125° C.

C: The minimum limit fixing temperature was 125° C. or higher and lower than 135° C.

D: The minimum limit fixing temperature was 135° C. or higher.

<<Heat Resistant Storage Stability (Penetration)>>

The penetration was measured by filling each toner into a 50 mL glass container, leaving the glass container filled with the toner in a thermostat bath at 50° C. for 24 hours, followed by cooling the toner to 24° C., and then carrying out a penetration test (JIS K2235-1991) thereto. The penetration was evaluated based on the following evaluation criteria. Note that, the higher the penetration is, the more the excellent heat resistant storage stability the toner has. In the case where the penetration is less than 5 mm, a problem is likely to occur.

[Evaluation Criteria]

A; 25 mm or more

B: 15 mm or more and less than 25 mm

C: 5 mm or more and less than 15 mm

D: less than 5 mm

<Environmental Stability>

Each of the developers was stirred using a ball mill for 5 minutes in an environment at a temperature of 23° C. and a relative humidity of 50% (M/M environment), and then sampled in an amount of 1.0 g. The samples were blown dry with nitrogen gas for 1 minute using a blow-off charge amount measurement device (TB-200, manufactured by Kyocera Chemical Corporation) to measure the charged amount. The measurement of charged amounts of each of the developers was performed for evaluation under the following two environmental conditions, i.e., at a temperature 40° C. and a relative humidity 90% (H/H environment); and at a temperature 10° C. and a relative humidity 30% (L/L environment). A degree of environmental variability was calculated based on the following equation, and the calculated degree of environmental variability was evaluated based on the following evaluation criteria. It can be said that the lower the degree of environmental variability, the more stable chargeability and better environmental stability the developer has.

$$\text{A degree of environmental variability} = 2 \times \frac{([L/L] - [H/H])}{([L/L] + [H/H])} \times 100\ (\%)$$

in the equation, [L/L] means a charge amount at the L/L environment, and [H/H] means a charge amount at the H/H environment.

[Evaluation Criteria]

A: The degree of environmental variability was less than 40%.

B: The degree of environmental variability was 40% or more and less than 50%.

C: The degree of environmental variability was 50% or more and less than 60%.

D: The degree of environmental variability was 60% or more.

<<Image Density>>

Using a tandem color image forming apparatus (IMAGIO NEO 450, manufactured by Ricoh Company, Ltd.), a solid image was formed, with a toner-adhesion amount of 1.00 mg/cm$^2$±0.05 mg/cm$^2$, on copy-printing paper TYPE 6000 <70W> (manufactured by Ricoh Company, Ltd.), while the surface temperature of the fixing roller being controlled to 160° C.±2° C. Image densities of arbitrarily selected six portions of the formed solid image were measured using a spectrometer (938 Spectrodensitometer, manufactured by X-Rite) to determine the average image density, followed by evaluation according to the following criteria.

[Evaluation Criteria]

A: The image density was 2.0 or higher.

B: The image density was 1.70 or higher and lower than 2.0.

C: The image density was lower than 1.70.

<Haze Degree>

As image samples for use in evaluation of fixability of toner, monochrome image samples were developed on OHP sheets, Type PPC-DX (manufactured by Ricoh Company, Ltd.) with the temperature of the fixing belt being set at 160° C. The haze degree of each of the monochrome image samples was read and measured by a direct-reading haze measuring computer (Model HGM-2DP, manufactured by Suga Tester Co., Ltd.). Haze degree is also called "degree of cloudiness" and measured as an indicator showing the transparency of toner. The lower the haze value, the higher the transparency of the toner is, and when OHP sheet is used, excellent color developing ability is exhibited.

[Evaluation Criteria]

A: The haze degree was less than 20%.

B: The haze degree was 20% or more and less than 30%.

C: The haze degree was 30% or more.

<Total Evaluation>

From the above evaluation results, each developer was comprehensively judged, and evaluated based on the following evaluation criteria.

[Evaluation Criteria]

A: Four As and no D was evaluated as excellent.

B: One or less C and no D was evaluated as good.

C: Two or more Cs and no D was evaluated as poor.

D: One or more D was evaluated as extremely poor.

TABLE 10-1

| | | Dv (μm) | Dn (μm) | Dv/Dn | Crystallinity of crystalline organic compound in toner | Q2/Q1 | Fixing temperature Minimum limit | Fixing temperature Maximum limit |
|---|---|---|---|---|---|---|---|---|
| Ex. 1 | Toner (1) | 5.3 | 4.6 | 1.15 | present | 0.2 | A | A |
| Ex. 2 | Toner (2) | 5.5 | 4.8 | 1.15 | present | 0.2 | A | A |
| Ex. 3 | Toner (3) | 5.2 | 4.3 | 1.21 | present | 0.3 | B | A |
| Ex. 4 | Toner (4) | 5.2 | 4.4 | 1.18 | present | 0.2 | A | A |
| Ex. 5 | Toner (5) | 5.9 | 4.9 | 1.20 | present | 0.2 | A | A |
| Ex. 6 | Toner (6) | 5.3 | 4.7 | 1.13 | present | 0.3 | B | A |
| Ex. 7 | Toner (7) | 5.6 | 4.9 | 1.14 | present | 0.3 | B | A |
| Ex. 8 | Toner (8) | 5.5 | 4.8 | 1.15 | present | 0.3 | B | A |
| Ex. 9 | Toner (9) | 5.1 | 4.6 | 1.11 | present | 0.2 | A | A |
| Ex. 10 | Toner (10) | 5.8 | 4.7 | 1.23 | present | 0.3 | B | A |
| Ex. 11 | Toner (11) | 5.3 | 4.5 | 1.18 | present | 0.3 | B | A |
| Ex. 12 | Toner (12) | 5.5 | 4.8 | 1.15 | present | 0.2 | A | A |
| Ex. 13 | Toner (13) | 4.7 | 3.7 | 1.27 | present | 0.2 | A | B |
| Ex. 14 | Toner (14) | 5.8 | 4.8 | 1.21 | present | 0.2 | A | B |
| Ex. 15 | Toner (20) | 5.6 | 4.9 | 1.14 | present | 0.3 | C | A |
| Ex. 16 | Toner (21) | 5.6 | 4.7 | 1.19 | present | 0.2 | B | A |
| Ex. 17 | Toner (22) | 5.5 | 4.6 | 1.20 | present | 0.2 | A | A |
| Ex. 18 | Toner (23) | 5.3 | 4.4 | 1.20 | present | 0.3 | C | B |
| Ex. 19 | Toner (24) | 5.7 | 4.9 | 1.16 | present | 0.2 | B | A |
| Ex. 20 | Toner (25) | 5.7 | 4.9 | 1.16 | present | 0.3 | C | A |
| Ex. 21 | Toner (26) | 5.7 | 4.6 | 1.24 | present | 0.2 | B | A |
| Ex. 22 | Toner (27) | 5.6 | 4.6 | 1.22 | present | 0.2 | A | A |
| Ex. 23 | Toner (28) | 5.9 | 4.7 | 1.26 | present | 0.3 | C | B |
| Ex. 24 | Toner (29) | 5.9 | 4.7 | 1.26 | present | 0.2 | B | B |
| Ex. 25 | Toner (30) | 5.7 | 4.7 | 1.21 | present | 0.2 | C | A |
| Ex. 26 | Toner (31) | 5.8 | 4.8 | 1.21 | present | 0.2 | A | A |
| Ex. 27 | Toner (32) | 5.5 | 4.7 | 1.17 | present | 0.2 | A | B |
| Comp. Ex. 1 | Toner (15) | 5.7 | 4.9 | 1.16 | absent | N/A | A | A |
| Comp. Ex. 2 | Toner (16) | 5.4 | 4.7 | 1.15 | present | 0.7 | C | A |
| Comp. Ex. 3 | Toner (17) | 5.5 | 4.6 | 1.20 | present | 0.3 | A | B |
| Comp. Ex. 4 | Toner (18) | 5.9 | 5.1 | 1.16 | present | 0.8 | D | B |
| Comp. Ex. 5 | Toner (19) | 5.2 | 4.4 | 1.18 | present | 0.8 | D | C |
| Comp. Ex. 6 | Toner (33) | 5.6 | 4.7 | 1.19 | absent | N/A | D | B |
| Comp. Ex. 7 | Toner (34) | 5.5 | 4.5 | 1.22 | absent | N/A | D | B |
| Comp. Ex. 8 | Toner (35) | 5.6 | 4.8 | 1.17 | present | 0.4 | D | A |

TABLE 10-2

| | | Heat resistant storage stability | Environ-mental stability | Image density | Haze degree | Total eval-uation |
|---|---|---|---|---|---|---|
| Ex. 1 | Toner (1) | A | A | A | A | A |
| Ex. 2 | Toner (2) | A | A | A | A | A |
| Ex. 3 | Toner (3) | A | A | A | A | B |
| Ex. 4 | Toner (4) | A | A | A | A | A |
| Ex .5 | Toner (5) | A | A | A | A | A |
| Ex. 6 | Toner (6) | A | A | A | A | B |
| Ex. 7 | Toner (7) | A | A | A | A | B |
| Ex. 8 | Toner (8) | A | A | A | A | B |
| Ex. 9 | Toner (9) | A | A | A | A | A |
| Ex. 10 | Toner (10) | A | A | A | A | B |
| Ex. 11 | Toner (11) | A | A | A | A | B |
| Ex. 12 | Toner (12) | A | A | A | A | A |
| Ex. 13 | Toner (13) | C | B | A | A | B |
| Ex. 14 | Toner (14) | C | B | A | A | B |
| Ex. 15 | Toner (20) | A | A | A | A | B |
| Ex. 16 | Toner (21) | A | A | A | A | B |
| Ex. 17 | Toner (22) | B | A | A | A | B |
| Ex. 18 | Toner (23) | A | A | A | A | B |
| Ex. 19 | Toner (24) | B | A | A | A | B |
| Ex. 20 | Toner (25) | A | A | A | A | B |
| Ex. 21 | Toner (26) | A | A | A | A | B |
| Ex. 22 | Toner (27) | B | A | A | A | B |
| Ex. 23 | Toner (28) | A | A | A | A | B |
| Ex. 24 | Toner (29) | B | B | A | A | B |
| Ex. 25 | Toner (30) | A | A | A | A | B |
| Ex. 26 | Toner (31) | A | A | A | A | A |
| Ex. 27 | Toner (32) | C | B | A | A | B |
| Comp. Ex. 1 | Toner (15) | D | D | B | A | D |

TABLE 10-2-continued

| | | Heat resistant storage stability | Environ-mental stability | Image density | Haze degree | Total eval-uation |
|---|---|---|---|---|---|---|
| Comp. Ex. 2 | Toner (16) | A | B | B | A | C |
| Comp. Ex. 3 | Toner (17) | D | D | B | A | D |
| Comp. Ex. 4 | Toner (18) | C | C | B | C | D |
| Comp. Ex. 5 | Toner (19) | D | D | B | C | D |
| Comp. Ex. 6 | Toner (33) | B | A | A | A | D |
| Comp. Ex. 7 | Toner (34) | B | A | A | A | D |
| Comp. Ex. 8 | Toner (35) | B | D | A | A | D |

From Tables 10-1 and 10-2, the developers of Examples 1 to 27 obtained superior results in the wide range of fixing temperature, image density, environmental stability, and haze degree to the developer of Comparative Examples 1 to 8, and satisfied both the low temperature fixing ability and the heat resistant storage stability.

What is claimed is:

1. A toner comprising:

a first binder resin;

a colorant;

a releasing agent; and a crystalline organic compound, wherein the first binder resin contains an amorphous polyester resin (a) having a polyhydroxycarboxylic acid skeleton derived from optically active monomers in a part of a main chain of the amorphous polyester resin, and the polyhydroxycarboxylic acid skeleton has an optical purity X, calculated on the monomer basis, of 80% or less, and the optical purity X is determined from the following equation, $$\text{Optical Purity } X\,(\%)=|X(L\text{-form})-X(D\text{-form})|$$

where X (L-form) represents, calculated on the monomer basis, an L-form ratio (mol %), and X (D-form) represents, calculated on the monomer basis, a D-form ratio (mol %), and wherein the crystalline organic compound is a crystalline low molecular compound which has a melting point of 60° C. to 100° C., and is a member selected from the group consisting of fatty acids having 16 to 24 carbon atoms, alcohols having 16 to 24 carbon atoms, fatty acid ester compounds, and aliphatic carboxylic acid amides;

wherein the toner satisfies the following formula (2):

$$0\leq(Q2/Q1)\leq0.30 \qquad \text{Formula (2)}$$

where Q1 is an endotherm of a melting peak derived from the crystalline organic compound when a temperature of the toner is increased from 20° C. to 150° C. at a temperature increasing rate of 10° C./min (first temperature increase), and Q2 is an endotherm of a melting peak derived from the crystalline organic compound when, after the first temperature increase, the temperature is dropped to 0° C. at a temperature decreasing rate of 10° C./min, followed by increasing to 150° C. at a temperature increasing rate of 10° C./min (second temperature increase), in DSC measurement of the toner.

2. The toner according to claim 1, further comprising shell particles each containing a second binder resin, wherein the toner has a core shell structure, in which the shell particles are attached to a surface of the toner.

3. The toner according to claim 2, wherein the second binder resin is a polyester resin (c) having a glass transition temperature of 55° C. to 80° C.

4. The toner according to claim 1, wherein the amorphous polyester resin (a) is a linear polyester diol (all) having a polyhydroxycarboxylic acid skeleton.

5. The toner according to claim 1, wherein the amorphous polyester resin (a) contains a linear polyester resin (A) which is obtained by reaction of the linear polyester diol (a11) having a polyhydroxycarboxylic acid skeleton with a polyester diol (a12) other than the polyester diol (a11), in the presence of a chain extending agent.

6. The toner according to claim 5, wherein a mass ratio, (a11)/(a12), of the linear polyester diol (a11) having a polyhydroxycarboxylic acid skeleton to the polyester diol (a12) other than the polyester diol (a11) is 31/69 to 90/10.

7. The toner according to claim 1, wherein the polyhydroxycarboxylic acid skeleton of the amorphous polyester resin (a) is obtained by ring-opening polymerizing a mixture of L-lactide and D-lactide.

8. The toner according to claim 1, wherein the polyhydroxycarboxylic acid skeleton of the amorphous polyester resin (a) is obtained by ring-opening polymerizing meso-DL-lactide.

9. A developer comprising:

a toner; and a carrier, wherein the toner is the toner as claimed in claim 1.

10. An image forming method comprising:

forming a latent electrostatic image on a latent electrostatic image bearing member;

developing the latent electrostatic image using a developer so as to form a visible image;

transferring the visible image on a recording medium; and fixing the transferred image on the recording medium, wherein the developer comprises:

a toner; and a carrier, wherein the toner is the toner as claimed in claim 1.

11. The toner according to claim 5, wherein the polyester diol (a12) comprises a reaction product between a diol and a dicarboxylic acid.

12. The toner according to claim 5, wherein the chain extending agent is a diisocyanate compound or a dicarboxylic acid compound.

* * * * *